US008183800B2

(12) United States Patent
Takayama et al.

(10) Patent No.: US 8,183,800 B2
(45) Date of Patent: May 22, 2012

(54) INDUCED VOLTAGE CONTROL DEVICE, ITS CONTROL METHOD, CHARGED PARTICLE BEAM ORBIT CONTROL DEVICE, AND ITS CONTROL METHOD

(75) Inventors: Ken Takayama, Tsuchiura (JP); Kota Torikai, Tsukuba (JP); Yoshio Arakida, Tsukuba (JP); Yoshito Shimosaki, Sayo-cho (JP); Junichi Kishiro, Tsukuba (JP); Reiko Kishiro, legal representative, Ushiku (JP)

(73) Assignee: Inter-University Research Institute Corporation High Energy Accelerator Research Organization, Tsukuba-shi, Ibaraki (JP)

( * ) Notice: Subject to any disclaimer, the term of this patent is extended or adjusted under 35 U.S.C. 154(b) by 424 days.

(21) Appl. No.: 11/994,915

(22) PCT Filed: Jun. 30, 2006

(86) PCT No.: PCT/JP2006/313518

§ 371 (c)(1),
(2), (4) Date: Feb. 16, 2010

(87) PCT Pub. No.: WO2007/004704

PCT Pub. Date: Jan. 11, 2007

(65) Prior Publication Data

US 2010/0176753 A1 Jul. 15, 2010

(30) Foreign Application Priority Data

Jul. 5, 2005 (JP) ..... 2005-196223
Jul. 7, 2005 (JP) ..... 2005-198557

(51) Int. Cl.
*H05H 15/00* (2006.01)
*H01J 23/00* (2006.01)

(52) U.S. Cl. ..... 315/503; 315/500

(58) Field of Classification Search ..... 315/500, 315/501, 502, 503, 504, 505, 506
See application file for complete search history.

(56) References Cited

U.S. PATENT DOCUMENTS 5,107,222 A * 4/1992 Tsuzuki ..... 315/500
6,472,834 B2 * 10/2002 Hiramoto et al. ..... 315/501
7,015,661 B2 * 3/2006 Korenev ..... 315/500

FOREIGN PATENT DOCUMENTS

JP 2000-232000 A 8/2000

OTHER PUBLICATIONS

K. Takayama; "Observation of the Acceleration of a Single Bunch by Using the Induction Device in the KEK Proton Synchrotron"; Phys. Rev. Lett. vol. 94, No. 14, pp. 144801_1-4, Apr. 2005.
International Search Report of PCT/JP20061313518, date of mailing Oct. 3, 2006.

* cited by examiner

*Primary Examiner* — Douglas W Owens
*Assistant Examiner* — Minh D A
(74) *Attorney, Agent, or Firm* — Westerman, Hattori, Daniels & Adrian, LLP

(57) ABSTRACT

An object of the invention is to provide the orbit control device for modulating the orbital deviations of the charged particle beam and its control method, wherein in the synchrotron making use of induction cells, the charged particle beam orbit control device is comprised of the digital signal processor for controlling the generation timing of an induced voltage in response to the beam position signal from the beam position monitor for sensing the deviations of the charged particle beam on the design orbit of the synchrotron from the design orbit and to the passage signal from the bunch monitor for sensing the passage of the bunch and the pattern generator for generating a gate signal pattern for on/off-selecting the switching electric power supply a according to the master gate signal generated by the digital signal processor.

6 Claims, 24 Drawing Sheets

Fig 7
(A)
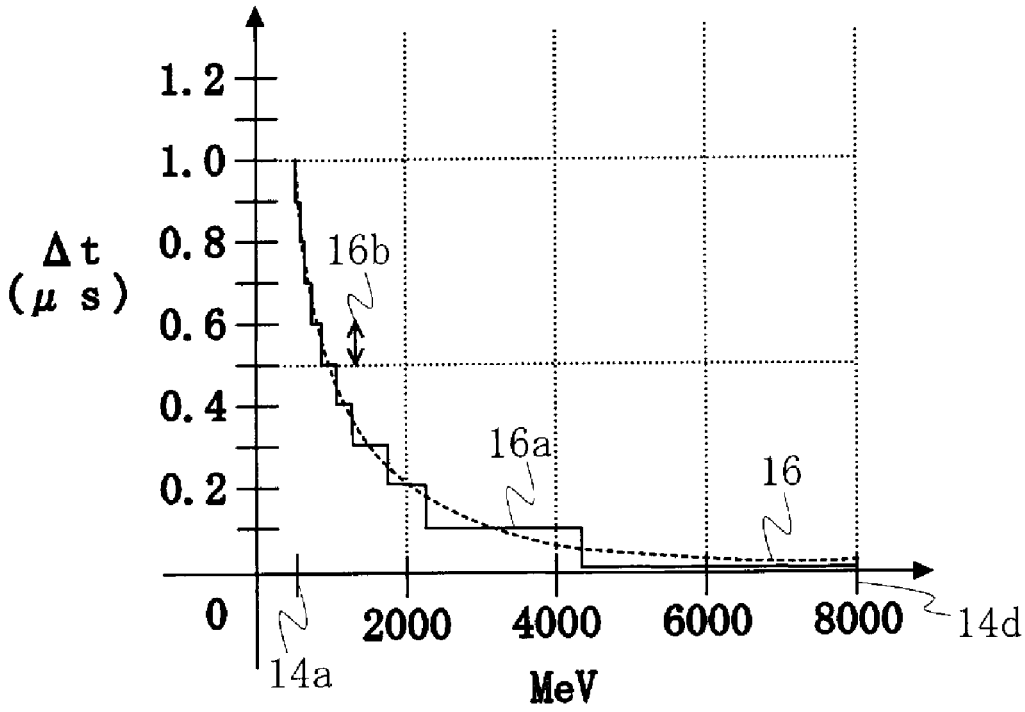
(B)
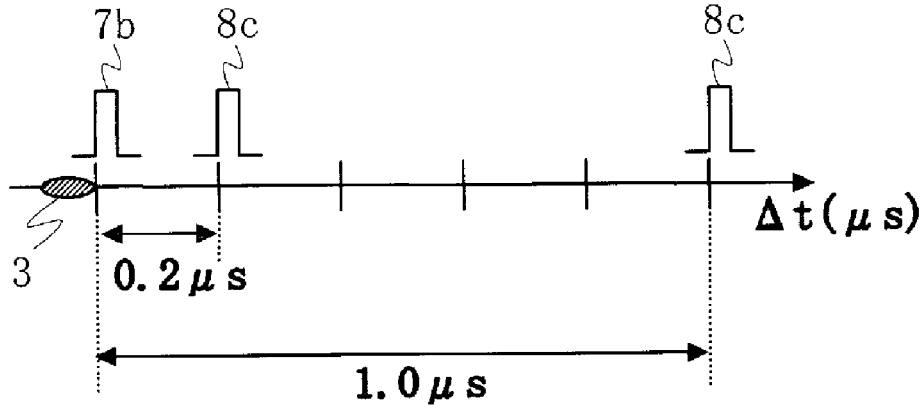

Fig 1 8
(A)
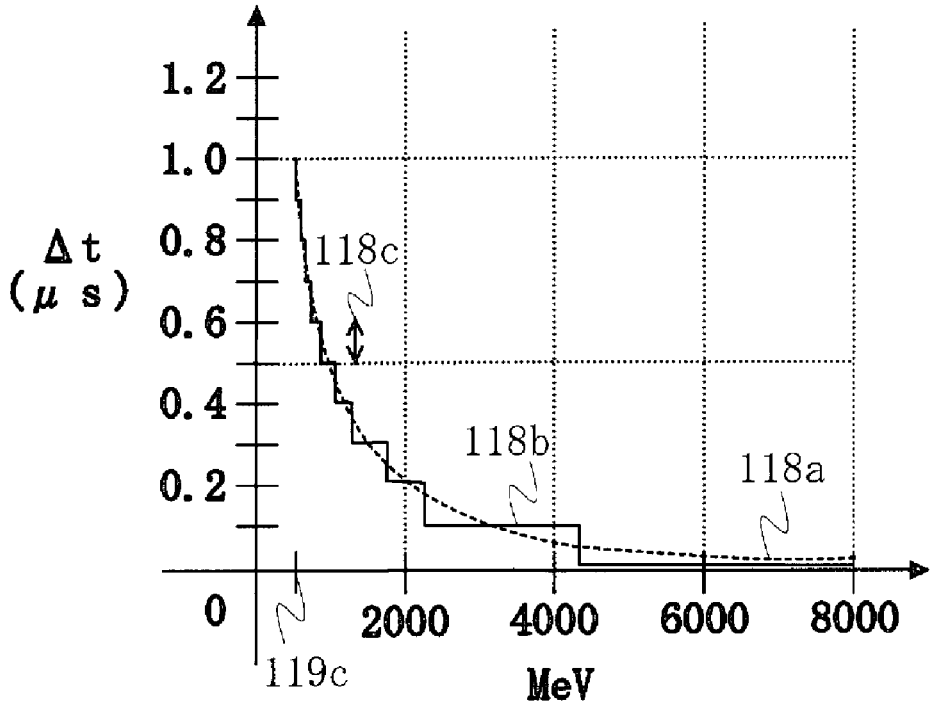
(B)
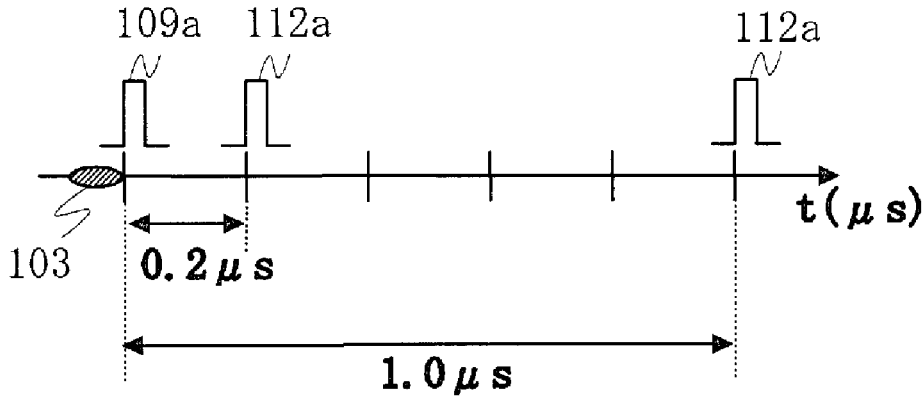

Fig 2 2
(A)
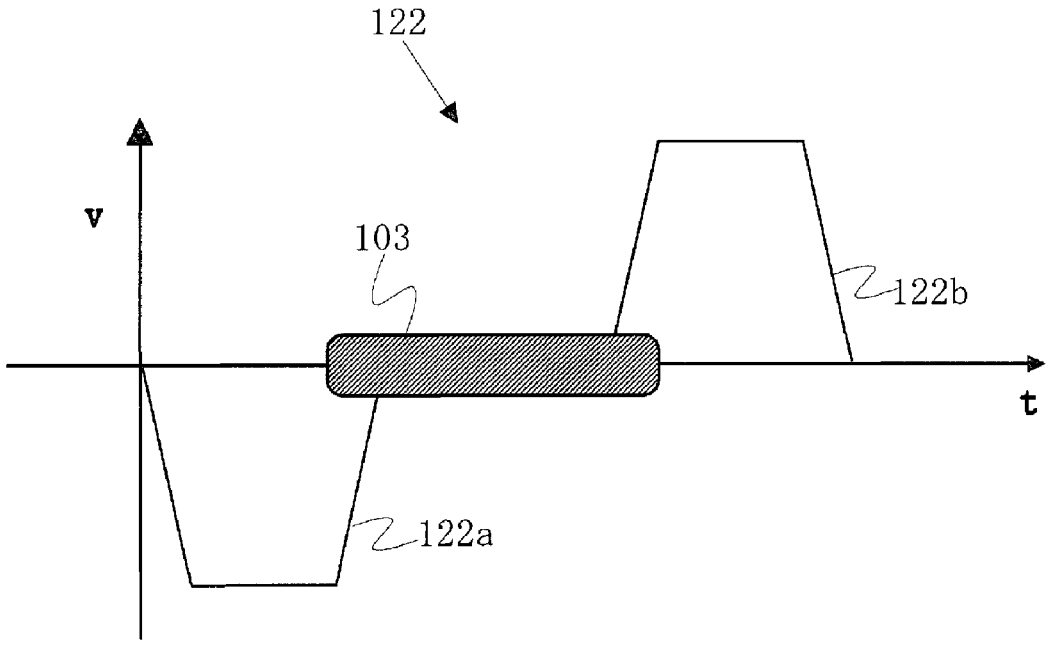
(B)
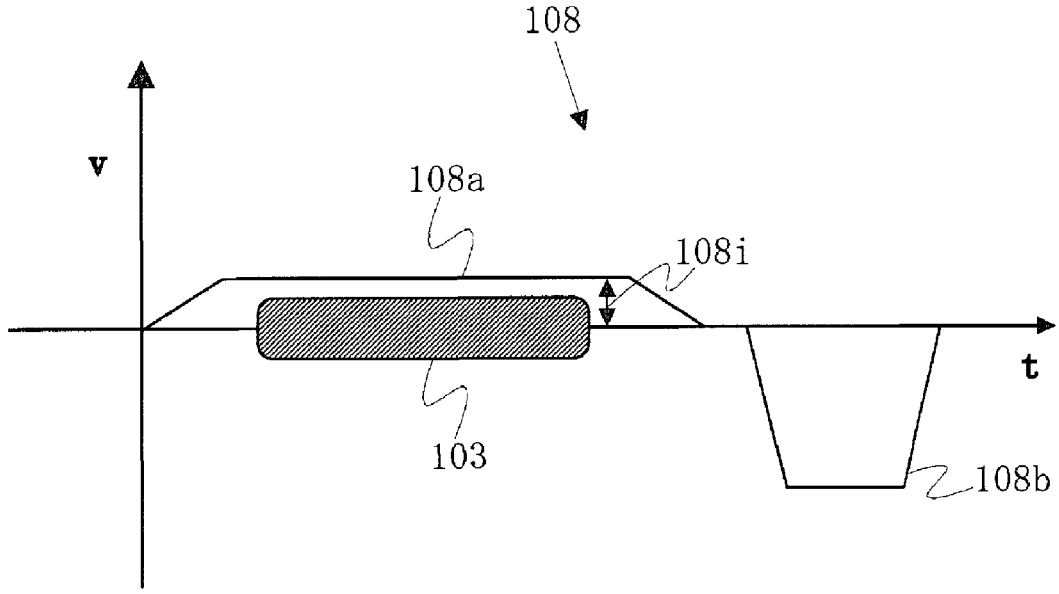

INDUCED VOLTAGE CONTROL DEVICE, ITS CONTROL METHOD, CHARGED PARTICLE BEAM ORBIT CONTROL DEVICE, AND ITS CONTROL METHOD

TECHNICAL FIELD

The present invention relates to an induced voltage control device and to a method of controlling the induced voltage control device for synchronizing an induced voltage for acceleration of a charged particle with the magnetic excitation pattern of a bending electromagnet composing the synchrotron to accelerate charged particles in a synchrotron making use of induction cells. The invention also relates to a charged particle beam orbit control device capable of maintaining a beam of charged particles on a design orbit by controlling the generation timing of the induced voltage in the synchrotron making use of induction cells and to a method of controlling the charged particle beam orbit control device.

BACKGROUND ART

A charged particle generically refers to a "particle having an electric charge," including an ion in which an element in the periodic table is in a certain positive or negative charge state, and an electron. The charged particle also includes a particle of a compound, protein and the like having a large number of constituent molecules.

First, the background art of the induced voltage control device and method of controlling the device will be described. Synchrotrons are classified into an rf synchrotron and a synchrotron making use of induction cells. The rf synchrotron is a circular accelerator for causing charged particles, such as protons, injected into a vacuum chamber by an injector to circulate on a design orbit in the vacuum duct for a charged particle beam to circulate in, using an rf cavity 4, while accelerating the particles by applying an rf acceleration voltage synchronized with the magnetic excitation pattern of a bending electromagnet composing the rf synchrotron and ensuring strong focusing.

On the other hand, the synchrotron making use of induction cells differs in the acceleration method from the rf synchrotron and is a circular accelerator that performs charged particle acceleration by applying an induced voltage using the induction cell. FIG. 13 shows the principle of proton beam acceleration using an rf cavity and FIG. 14 shows the principle of proton beam acceleration using induction cells.

FIG. 13(A) shows a condition in which injected protons are circulating on the design orbit 2 of an rf synchrotron 21 as several bunches 3. Each bunch 3, as the result of being subjected to the application of an rf acceleration voltage 21*a* in synchronization with the magnetic excitation pattern when reaching the rf cavity 4, is accelerated to a predetermined energy level.

FIG. 13(B) shows the correlation between the bunches 3 and the rf acceleration voltage 21*a* applied thereto. The axis of abscissa "t" represents a temporal change in the rf cavity 4, whereas the axis of ordinate "v" represents an rf acceleration voltage. "Vofs" is an rf acceleration voltage 21*b* necessary for the acceleration of the bunches 3 calculated from the gradient (rate of temporal change) of the magnetic excitation pattern of the bending electromagnet at a moment of acceleration.

The bunches 3 is subjected by the rf cavity 4 to the application of "Vofs" (rf acceleration voltage 21*b*) which is calculated from the gradient (rate of temporal change) of the magnetic excitation pattern of the bending electromagnet and is necessary for acceleration. The rf acceleration voltage 21*a* has both the function to provide a voltage necessary to accelerate the bunches 3 and the confinement function to prevent the bunches 3 from dispersing in the propagating axis direction thereof.

In particular, the confinement function may, in some cases, be referred to as phase stability. The above-described two functions are always required when accelerating a charged particle beam using the rf synchrotron 21. The time duration in which the rf acceleration voltage 21*a* has the above-described two functions is limited, however. It has been heretofore known that the time durations shaded in FIG. 13(B) are not available for acceleration.

Note here that phase stability refers to a state in which individual charged particles receive focusing forces in an propagating axis direction caused by the rf acceleration voltage 21*a*, to turn into the bunches 3 and circulate within the rf synchrotron 21 while moving back and forth in the propagating axis direction.

In addition, the bunches 3 refer to groups of charged particles that undergo phase stabilization to circulate on the design orbit 2.

FIG. 14(A) shows a condition in which a bunch 3 (hereinafter referred to as a super-bunch 3*b*) having a time span several to ten times the length of a charged particle beam accelerated using a existing rf synchrotron 21, thus amounting to as long as one microsecond, is accelerated by a synchrotron 22 making use of induction cells. In this case, there is the need to dispose two or more induction cells of the same structure on the design orbit 2 for the proton beam of the synchrotron 22 making use of induction cells to circulate in.

One of these two induction cells (hereinafter referred to as the induction cell for confinement 23) provides a confinement function for confining the super-bunch 3*b*, whereas the other induction cell (hereinafter referred to as the induction cell for acceleration 6) provides the function to apply a voltage necessary to accelerate the super-bunch 3*b* in synchronization with the magnetic excitation pattern of the bending electromagnet. Using these two induction cells, there are provided the confinement function and the acceleration function necessary to operate the synchrotron 22. These two induction cells can also provide the same functions to a normal bunch 3.

Note here that the induction cells in principle have the same structure as that of an induction cell for liner induction accelerators heretofore constructed. The induction cells have a double structure composed of an inner cylinder and an outer cylinder, wherein a magnetic material is inserted into the outer cylinder to create an inductance. Part of the inner cylinder connected to the vacuum chamber, through which the charged particle beam passes, is made of an insulator such as ceramics.

When a pulse voltage is applied from a DC power supply to a primary electric circuit surrounding the magnetic material, a primary current (core current) flows through a primary conductor. This primary current causes magnetic fluxes to be produced around the primary conductor, thereby exciting the magnetic material surrounded by the primary conductor.

As a result, the density of fluxes penetrating the magnetic material in a toroidal shape increases with time. At this time, an induction electric field is produced across an insulating material in secondary insulated portions, which are the both ends of the conductor's inner cylinder, according to Faraday's induction law. This induction electric field serves as an acceleration electric field. A portion where the acceleration electric field is produced is referred to as an acceleration gap. Accordingly, the induction cells may be said to be one-to-one transformers.

By connecting a switching electric power supply for generating pulse voltages to the primary electric circuits of the induction cells and externally turning on and off the switching electric power supply, it is possible to freely control the generation of acceleration electric fields.

FIG. 14(B) shows a condition in which the super-bunch 3*b* is confined and accelerated by the induction cells. The axis of abscissa "t" denotes the timing of induced voltage generation based on the time when the super-bunch 3*b* reaches the induction cell for confinement 23 and is also a time length (hereinafter referred to as a charging timing) during which an induced voltage is applied.

Note that the generation timing and the charging timing of an induced voltage applied to the induction cell for acceleration 6 are shifted by half of a revolution time period 24 from those of the induction cell for confinement 23. The axis of ordinate "v" denotes an induced voltage value. "$V_{ofs}$" denotes an acceleration voltage 9*k* which is calculated from the gradient (rate of temporal change) of a magnetic excitation pattern at a moment of acceleration and is necessary for the acceleration of the super-bunch 3.

Note here that an induced voltage refers to a voltage to be applied to charged particles by the induction cells. An induced voltage applied by the induction cell for confinement 23 is referred to as a barrier voltage. A barrier voltage applied to the head of a charged particle beam is particularly referred to as a negative barrier voltage 23*a* and a barrier voltage applied to the tail of a charged particle beam is particularly referred to as a positive barrier voltage 23*b*. The same applies to a case wherein the charged particles are the super-bunch 3*b*.

As a result, it is possible to provide phase stability to the bunches 3 in the induction cell for confinement 23, as in the rf cavity 4. However, the induction cell for acceleration 6 is needed separately since a charged particle beam cannot be accelerated with one induction cell alone.

An induced voltage applied by the induction cell for acceleration 6 is referred to as an induced voltage for acceleration. In addition, an induced voltage applied to the whole of a charged particle beam is particularly referred to as an acceleration voltage 9*a* and an induced voltage applied in order to prevent the magnetic excitation of the induction cell for acceleration 6 is particularly referred to as a reset voltage 9*b*. The same applies to a case wherein the charged particles are the super-bunch 3*b*.

Note that the reset voltage 9*b* corresponds to the positive barrier voltage 23*b* in the induction cell for confinement 23. Whereas the positive barrier voltage 23*b* is applied to the tail of the bunch 3 to confine the bunch 3, the reset voltage 9*b* is applied only to prevent magnetic core from saturating, in a time duration (time duration shown by a shaded area) in which no charged particle beams exist.

Note here that confinement is a function required since charged particles composing a charged particle beam always have a variation of kinetic energy. The variation of kinetic energy causes a difference in the time at which a charged particle beam reaches the same position after making one circuit of the design orbit 2. This time difference increases as the charged particle beam repeats circuiting unless confinement is carried out, thus causing the charged particle beam to disperse across the design orbit 2.

When the negative barrier voltage 23*a* and the positive barrier voltage 23*b* are made to be respectively applied to the head and the tail of the charged particle beam, charged particles over-energized and therefore leading in revolution lose energy and become under-energized due to the negative barrier voltage 23*a*, whereas charged particles under-energized and therefore lagging in revolution gain energy and become over-energized due to the positive barrier voltage 23*b*.

Accordingly, a particle leading in revolution lags and, conversely, a particle lagging in revolution leads. As a result, it is possible to localize a charged particle beam in a certain region of the propagating axis direction thereof. This series of actions is referred to as the confinement of charged particle beams.

Consequently, the functionality of the induction cell for confinement 23 is equivalent to the confinement function separated from among the functions of the existing rf cavity 4.

The term "for confinement" means that the induction cell in question has the function to shrink a charged particle beam injected from an injection device to the synchrotron 22 making use of induction cells to a bunch 3 having a certain length, so that the beam can be induction-accelerated by another induction cell by applying a predetermined barrier voltage provided thereby and change the beam to a charged particle beam of various lengths, and the function to provide the bunch 3 being accelerated with phase stability.

The term "for acceleration" means that the induction cell in question has the function to provide an induced voltage for acceleration to the whole of the bunch 3 after the bunch 3 is formed.

FIG. 14(C) shows only the confinement function of the induction cell for confinement 23, whereas FIG. 14(D) shows only the acceleration function of the induction cell for acceleration 6. The axis of abscissa "t(a)" denotes the generation timing and the charging timing of a barrier voltage based on the time when the super-bunch 3*b* reaches the induction cell for confinement 23. The axis of ordinate "t(b)" denotes the generation timing and the charging timing of an induced voltage for acceleration 9 based on the time when the super-bunch 3*b* reaches the induction cell for acceleration 6. Other reference numerals and symbols are the same as those of FIG. 14(B).

As shown in the Journal of the Physical Society of Japan, vol. 59, No. 9 (2004) pp. 601-610, which is Non-patent Document 1, in the case of acceleration by the synchrotron 22 making use of induction cells, it is in principle possible to use the rest of time for acceleration except the time of charging the reset voltage 9*b* (time duration shown by a shaded area). It is considered to be possible to also accelerate the super-bunch 3*b*, which has been in principle not possible with the rf synchrotron 21, by dramatically increasing the time duration available for acceleration as described above.

As described above, it is now possible to confine proton beams also with a barrier voltage, as with the rf acceleration voltage 21*a*. On the other hand, another accelerating device is needed in order to accelerate the proton beams and such an accelerating device may be comprised of the rf cavity 4 as long as protons or other charged particles are concerned. Alternatively, the accelerating device may be configured so as to confine proton beams with the rf cavity 4 and accelerate the proton beams with the induced voltage 9.

As shown in Phys. Rev. Lett. Vol. 94, No. 144801-4 (2005), which is Non-patent Document 2, the inventor et al. have already succeeded in accelerating a proton beam injected at a kinetic energy of 500 million electron volts up to 8 billion electron volts by installing the induction cell for acceleration 6 in the proton rf synchrotron 21 (hereinafter referred to as the 12 GeVPS) of High Energy Accelerator Research Organization (hereinafter referred to as KEK) and applying the induced voltage for acceleration 9 generated at regular time intervals by combining the rf cavity 4 and the induction cell for acceleration 6.

Note here that one electron volt is given by multiplying the volt, which is the unit of voltage, by the unit charge of an electron. One electron volt equals $1.602\times10^{-19}$ joule.

Next, the background art of the charged particle beam orbit control device and its control method will be described.

Synchrotrons are classified into an rf synchrotron and a synchrotron making use of induction cells. The rf synchrotron is a circular accelerator for causing charged particles, such as protons, injected into a vacuum chamber by an injector to circulate on a design orbit in the vacuum chamber for a charged particle beam to circulate in, using an rf cavity, while accelerating the particles by applying an rf acceleration voltage synchronized with the magnetic excitation pattern of a bending electromagnet composing the rf synchrotron and maintaining the beam revolution orbit.

On the other hand, the synchrotron making use of induction cells differs in the acceleration method from the rf synchrotron and is a circular accelerator that performs acceleration by applying an induced voltage to a charged particle beam using an induction cell.

FIG. 22 shows the principle of accelerating charged particle beams using induction cells and the types of induced voltages. The induction cells are classified into an induction cell for confinement designed to confine charged particle beams in the propagating axis direction thereof (hereinafter referred to as an induction cell for confinement) and an induction cell for applying an induced voltage designed to accelerate the charged particle beam in the propagating axis direction of ions (hereinafter referred to as an induction cell for acceleration).

Note that in some cases an rf cavity may be used in place of the induction cell for confinement, in order to confine charged particle beams in the propagating axis direction of ions thereof.

FIG. 22(A) shows a condition in which a charged particle beam is confined by an induction cell for confinement. An induced voltage applied to the charged particle beam by the induction cell for confinement is referred to as a barrier voltage 122.

In particular, an induced voltage opposite in direction to the propagating axis direction of a group of charged particles (hereinafter referred to as the bunch 103) and applied to the head of this charged particle beam is referred to as a negative barrier voltage 122*a* and an induced voltage the same in direction as the propagating axis direction of the group of charged particles and applied to the tail of this charged particle beam is referred to as a positive barrier voltage 122*b*. These voltages are intended to provide the charged particle beam with the phase stability, as with a existing rf cavity.

Note that the axis of abscissa "t" represents temporal change in the induction cell for acceleration and the axis of ordinate "v" represents a barrier voltage value (the value of an induced voltage for acceleration in FIG. 22(B)) to be applied.

FIG. 22(B) shows a condition in which a charged particle beam is accelerated by the induction cell for acceleration. An induced voltage applied to the charged particle beam by the induction cell for acceleration is referred to as an induced voltage for acceleration 108. In particular, the induced voltage 108 for acceleration applied to the whole of a bunch 103 and necessary to accelerate the charged particle beam in the propagating axis direction thereof is referred to as an acceleration voltage 108*a* and the value thereof is referred to as an acceleration voltage amplitude 108*i*.

In addition, the induced voltage for acceleration 108, which is applied when the bunch 103 does not exist in the induction cell for acceleration and is heteropolar to the acceleration voltage 108*a*, is referred to as a reset voltage 108*b*. This reset voltage 108*b* is intended to prevent the magnetic excitation of the induction cell for acceleration.

With the induced voltage for acceleration 108 and the barrier voltage 122, it is considered possible to accelerate not only protons and specific charged particles but also any charged particles, as in a existing rf synchrotron, using a single unit of a circular accelerator, up to an arbitrary energy level permitted by the magnetic flux density of a bending electromagnet composing the synchrotron (hereinafter referred to as an arbitrary energy level).

Furthermore, as shown in the Journal of the Physical Society of Japan, vol. 59, No. 9 (2004) pp. 601-610, which is Non-patent Document 1, it is possible to also accelerate a bunch 103 (super-bunch) having a time span several to ten times the length of a charged particle beam accelerated using a existing rf synchrotron, thus amounting to as long as one microsecond, by using the induction cells. Accordingly, nuclear physics and high-energy physics experiments are considered to make a dramatic progress.

Note there that the induction cells mentioned above in principle have the same structure as that of an induction cell for liner induction accelerators heretofore constructed. The induction cells have a double structure composed of an inner cylinder and an outer cylinder, wherein a magnetic material is inserted into the outer cylinder to create an inductance. Part of the inner cylinder connected to the vacuum chamber, through which the charged particle beam passes, is made of an insulator such as ceramics.

When a pulse voltage is applied from a DC power supply to a primary electric circuit surrounding the magnetic material, a primary current (core current) flows through a primary conductor. This primary current causes magnetic fluxes to be produced around the primary conductor, thereby exciting the magnetic material surrounded by the primary conductor.

As a result, the density of fluxes penetrating the magnetic material in a toroidal shape increases with time. At this time, an induction electric field is produced across an insulating material in secondary insulated portions, which are the both ends of the conductor's inner cylinder, according to Faraday's induction law. This induction electric field serves as an acceleration electric field. A portion where the acceleration electric field is produced is referred to as an acceleration gap. Accordingly, the induction cells may be said to be one-to-one transformers.

By connecting a switching electric power supply for generating pulse voltages to the primary electric circuits of the induction cells and externally turning on and off the switching electric power supply, it is possible to freely control the generation of acceleration electric fields.

Now, the switching electric power supply and the equivalent electric circuit diagram of the induction cell for acceleration will be described (FIG. 23). The equivalent electric circuit diagram 123 of an induction accelerating device for acceleration can be represented as a circuit wherein a switching electric power supply 105*a* that constantly receives power from a DC power supply 105*b* is connected to an induction cell for acceleration 107 through a transmission line. The induction cell for acceleration 107 is represented as a parallel circuit of an inductance component L, a capacitance component C and a resistance component R. The voltage developing across the parallel circuit is an induced voltage 108 for acceleration that a bunch 103 senses.

The state of the circuit shown in FIG. 23 is such that a first switch 124*a* and a fourth switch 124*d* are turned on by a gate signal pattern 113*a*, a voltage charged to a bank capacitor 124 is applied to the induction cell for acceleration 107, and an acceleration voltage 108*a* for accelerating the bunch 103 to an acceleration gap 107*a* is present.

Next, the turned-on first switch 124*a* and fourth switch 124*d* are turned off and a second switch 124*b* and a third switch 124*c* are turned on by the gate signal pattern 113*a*, thus producing a reset voltage 108*b* opposite in direction to the induced voltage in the acceleration gap 107*a* and thereby resetting the magnetic excitation of the magnetic material of the induction cell for acceleration 107.

Then, the second switch 124*b* and the third switch 124*c* are turned off and the first switch 124*a* and the fourth switch 124*d* are turned on by the gate signal pattern 113*a*. As the result of such a series of switching actions as described above being repeated by the gate signal pattern 113*a*, it is possible to generate the induced voltage 108 for acceleration necessary to accelerate charged particle beams.

The gate signal pattern 113*a* is a signal for controlling the driving of the switching electric power supply 105*a* and is digitally controlled by an induction accelerating device for acceleration composed of a digital signal processor 112 and a pattern generator 113, according to the passage signal 109*a* of the bunch 103.

Note that the acceleration voltage 108*a* applied to the bunch 103 is equivalent to a value calculated from the product of a current value and a matching resistance 125 in the circuit. Consequently, it is possible to know the value of the applied acceleration voltage 108*a* by measuring the current value using an induced voltage monitor 126, which is an ammeter or the like.

As shown in Phys. Rev. Lett. Vol. 94, No. 144801-4 (2005), which is Non-patent Document 2, the inventor et al. have already succeeded in accelerating a proton beam injected at a kinetic energy of 500 million electron volts up to 8 billion electron volts by installing the induction cell for acceleration 107 in the proton rf synchrotron 21 (hereinafter referred to as the 12 GeVPS) of High Energy Accelerator Research Organization (hereinafter referred to as KEK) and applying the induced voltage 108 for acceleration generated at regular time intervals by combining the rf cavity and the induction cell for acceleration 107.

Note here that one electron volt is given by multiplying the volt, which is the unit of voltage, by the unit charge of an electron. One electron volt equals $1.602\times10^{-19}$ joule.

Now, problems to be solved by the induced voltage control device and its control method will be described first. While it has been described earlier that the induced voltage for acceleration 9 necessary to accelerate a charged particle beam is determined by the gradient (rate of temporal change) of the magnetic excitation pattern 15 of a bending electromagnet, the rate of temporal change in the magnetic field temporally has a different value, depending on the magnetic excitation pattern. For this reason, a voltage to be applied to the charged particle beam must be temporally varied from the start to the end of acceleration of the charged particle beam.

Conventionally, there have been no devices for generating the induced voltage for acceleration 9 to be applied to charged particle beams and, therefore, there have been no methods of adjusting the induced voltage for acceleration. On the other hand, there has conventionally been a method of modulating the amplitude of a pulse voltage and the pulse width thereof general power supply devices which output commercial-frequency alternative current by modulated pulse voltage in order to adjust an output voltage. With the existing method, however, it is not possible to synchronize the induced voltage for acceleration 9 with a magnetic excitation pattern 15.

In order to obtain a stable output power of several tens of kilowatts necessary for a device for generating induced voltages (hereinafter referred to as an induction accelerating device), a large static capacitance (bank capacitor) must be loaded to the high-voltage charging portion of the switching electric power supply for determining the pulse voltage amplitude. Since the purpose of the charged voltage of this bank capacitor is to stabilize the pulse voltage output, the charged voltage cannot be varied at high speeds. Consequently, it is in reality not possible to have the pulse voltage amplitude controlled at high speeds.

Hence, the present invention is intended to solve the aforementioned problems. An object of the invention, therefore, is to provide a device capable of accelerating an arbitrary charged particle beam to an arbitrary energy level permitted by the magnetic flux density of a bending electromagnet composing the synchrotron making use of induction cells (hereinafter referred to as an arbitrary energy level) and its control method, by applying the required acceleration voltage 9*a*, even if it is a constant acceleration voltage provided by the induction cell for acceleration 6, in synchronization with every magnetic excitation pattern, including the nonlinear excitation region thereof, immediately after the bunch 3 is injected into a synchrotron making use of induction cells.

Note that the content of Non-patent Document 2 is a report that the inventor et al. were able to accelerate a proton beam using the constant acceleration voltage 9*a* applied at regular time intervals in the linear excitation region of a magnetic excitation pattern.

Next, problems to be solved by the charged particle beam orbit control device and its control method will be described. FIG. 24 shows the orbit of a charged particle beam and a condition in which the charged particle beam is confined in a horizontal direction by magnetic fields. A synchrotron maintains a bunch 103 on a design orbit 102 by means of magnetic flux density 103*a* provided by bending electromagnets composing the synchrotron.

In the absence of the magnetic flux density 103*a* provided by the bending electromagnet, the bunch 103 collides with the wall surfaces of a vacuum chamber due to a centrifugal force 103*b* that the charged particle beam has, and is lost. This magnetic flux density 103*a* varies with acceleration time. This variation is referred to as a magnetic excitation pattern (FIG. 19). This magnetic excitation pattern allows the revolution frequency band width of a charged particle beam to be uniquely determined once the type of charged particles, the acceleration energy level thereof, and the circumferential length of a circular accelerator are defined.

Consequently, the induced voltage for acceleration 108 must be applied, like an rf acceleration voltage, to the charged particle beam in synchronization with this magnetic excitation pattern, in order to accelerate the beam in the propagating axis direction thereof.

The orbit of a charged particle beam is not the vacuum chamber center 102*a* of the synchrotron, but is a design orbit 102 for the charged particle beam to circulate in situated either on the outside or on the inside of the vacuum chamber center 102*a* determined by the location of the bending electromagnet composing the synchrotron. Note that "$\rho_0$" is an average radius 102*d* from the centroid of the circular accelerator to the central beam orbit in the vacuum chamber 102*a*.

Note here that the term "synchronization" means that the acceleration voltage 108*a* is applied to the charged particle beam in conformity with a change in the magnetic excitation pattern, so that a balance is achieved between Lorentz force based on the magnetic flux density 103*a* of the bending electromagnet composing the synchrotron and the centrifugal force 103*b* that works outwardly by the acceleration of the charged particle beam.

However, the acceleration voltage 108*i* applied at each revolution of the bunch 103 is not constant but more or less increases or decreases. This stems from a variety of reasons, including that the charged voltage of a bank capacitor 124 deviates from the ideal value thereof.

If as a result, the acceleration voltage 108*i* actually applied is excessively lower than the acceleration voltage 108*i* ideal for synchronization with the magnetic excitation pattern, the charged particle beam deviates from the design orbit 102 toward the inside 102*b* thereof. On the other hand, if the acceleration voltage 108*i* actually applied is excessively higher than the ideal acceleration voltage 108*i*, the charged particle beam deviates from the design orbit 102 toward the outside 102*c* thereof.

In a existing rf synchrotron, it was possible to accelerate or decelerate a charged particle beam and maintain the beam on the design orbit 102 by shifting the phase of an rf voltage in an accelerating or decelerating direction.

In the induction cell for confinement, however, although it is possible to shift the time of generation of the barrier voltage 122, it is not possible to bring the bunch 103, which has deviated from the design orbit 102 toward the outside 102*c*, i.e., has become unable to synchronize with the magnetic excitation pattern, back on the design orbit 102.

Using a steering magnet or the like, an attempt has been made conventionally to correct an orbit for an actual proton beam to circulate in to the design orbit 102. However, correction using a steering magnet is intended to locally correct the orbit of the bunch 103 that has deviated from the design orbit 102.

Since the parameter "magnetic field strength" does not appear in the equation of beam acceleration, the time propagation of the revolution velocity 103*c* of the beam easily lost synchronization state with the predetermined magnetic excitation pattern. Accordingly, it is not possible to bring the bunch 103, whose energy has deviated from a designed value, back on the design orbit 102 by varying the magnetic flux density.

As a method for bringing the charged particle beam back on the design orbit 102, it is conceivable that the magnitude of the acceleration voltage 108*i* is changed. However, a device for generating the acceleration voltage 108*i* (hereinafter referred to as the induction accelerating device for acceleration) requires loading a large bank capacitor 124 (static capacitance) to the high-voltage charging portion of the switching electric power supply 105*a* for determining the pulse voltage amplitude, in order to obtain a stable output power of several tens of kilowatts necessary for the induction cell for acceleration 107.

Since the purpose of the charged voltage of this bank capacitor 124 is to stabilize the pulse voltage output, the charged voltage cannot be varied at high speeds. Consequently, it is in reality not possible to have the pulse voltage amplitude controlled at high speeds.

It is therefore not possible to largely vary the voltage value in a short time since the output voltage is uniquely determined once the DC power supply 105*b* and the bank capacitor 124 to be used are defined. For this reason, in a method of modulating the pulse voltage amplitude, it is not possible to synchronize the acceleration voltage 108*a* with the magnetic excitation pattern.

Alternatively, it is conceivable that an rf cavity is used concurrently as a cavity for controlling the orbit of the charged particle beam by its acceleration voltage. It is in reality impossible, however, to control the rf cavity's voltage to accelerate an arbitrary charged particle within an arbitrary energy range by a single synchrotron.

This is because the revolution frequency from a point in time immediately after injection to the end of acceleration becomes extremely low for particularly heavy charged particles, whereas the revolution frequency of the charged particle beam needs to be synchronized with the magnetic excitation pattern.

In every rf cavity, an rf voltage is generated based on the principle of resonance between inductance and capacitance. On the other hand, there are limits on the frequency of the rf acceleration voltage that can be generated since the frequency of the rf voltage is proportional to approximately −½ power of an inductance. As a result, it is not possible for the rf cavity to apply a required rf acceleration voltage.

In addition, if "Z/A", which is a ratio of the charge number "Z" to the mass number "A" of charged particles, differs in a synchrotron making use of an rf cavity, the frequency change during acceleration itself must be changed for reasons of limits on the principle in which high frequencies are used.

Unless errors in the above-described acceleration voltage 108*i* to be applied are eliminated in a synchrotron making use of induction cells, the charged particle beam deviates to the outside 102*c* from the design orbit 102 due to the centrifugal force 103*b* that the charged particle beam has, once the charged particle beam receives the acceleration voltage 108*i* higher than the required acceleration voltage 108*i*. Thus it is no longer possible to accelerate the charged particle beam.

Hence, the present invention is intended to solve the aforementioned problems. An object of the invention, therefore, is to provide an orbit control device for modulating the orbital deviations of the charged particle beam by modulating in real time the equivalent acceleration voltage 108*i* (hereinafter referred to as the pulse density (FIG. 21)) corresponding to the ideal acceleration voltage 108*i* and applying the acceleration voltage 108*a* based on the corrected pulse density to the charged particle beam in a unit that collectively represents a specific number of revolutions of the charged particle beam and provides the acceleration voltage 108*i* equivalent to the ideal acceleration voltage 108*i* for a specific time period (hereinafter referred to as the control time block (FIG. 20)), and to provide a method of controlling the orbit control device.

DISCLOSURE OF THE INVENTION

In order to solve the aforementioned problems, in a synchrotron making use of induction cells, an induced voltage control device 8 for controlling the generation timing of the induced voltage for acceleration 9 in accordance with the present invention comprises: a variable delay time pattern calculator 13*a* for storing a required variable delay time pattern 16*a* corresponding to an ideal variable delay time pattern 16 calculated according to a magnetic excitation pattern 15 and generating a variable delay time signal 13*b* corresponding to a variable delay time 13 according to the required variable delay time pattern 16*a*; a variable delay time generator 13*c* for generating a pulse 13*d* corresponding to the variable delay time 13 in response to the passage signal 7*a* of a bunch 3 from a bunch monitor 7 placed on a design orbit 2 for a charged particle beam to circulate in and to the variable delay time signal 13*b* from the variable delay time calculator 13*a*; an on/off selector 13*e* for storing an equivalent acceleration voltage amplitude pattern 9*e* corresponding to an ideal acceleration voltage amplitude pattern 9*c* calculated according to the magnetic excitation pattern 15 and generating a pulse 13*f* for on/off-selecting an induced voltage for acceleration 9 in response to a pulse 13*d* corresponding to the variable delay time 13 from the variable delay time generator

13*c*; a digital signal processor 8*d* including a master gate signal output module 13*g* for generating a master gate signal 8*c* which is a pulse suited for a pattern generator 8*b* and outputting the master gate signal 8*c* after the elapse of the variable delay time 13 in response to the pulse 13*f* from the on/off selector 13*e*; and a pattern generator 8*b* for converting the master gate signal 8*c* to the gate signal pattern 8*a* of a switching electric power supply 5*b*, which drives an induction cell for acceleration.

In addition, a method of induced voltage control in accordance with the present invention is realized, in a synchrotron making use of induction cells, by using a variable delay time calculator 13*a* for storing a required variable delay time pattern 16*a* corresponding to an ideal variable delay time pattern 16 calculated according to a magnetic excitation pattern 15 and generating a variable delay time signal 13*b* corresponding to a variable delay time 13 according to the required variable delay time pattern 16*a*, a variable delay time generator 13*c* for generating a pulse 13*d* corresponding to the variable delay time 13 in response to the passage signal 7*a* of a bunch 3 from a bunch monitor 7 placed on a design orbit 2 for a charged particle beam to circulate in and to the variable delay time signal 13*b* from the variable delay time calculator 13*a*, an on/off selector 13*e* for storing an equivalent acceleration voltage amplitude pattern 9*e* corresponding to an ideal acceleration voltage amplitude pattern 9*c* calculated according to the magnetic excitation pattern 15 and generating a pulse 13*f* for on/off-selecting an induced voltage for acceleration 9 in response to a pulse 13*d* corresponding to the variable delay time 13 from the variable delay time generator 13*c*, a digital signal processor 8*d* including a master gate signal output module 13*g* for generating a master gate signal 8*c* which is a pulse suited for a pattern generator 8*b* and outputting the master gate signal 8*c* after the elapse of the variable delay time 13 in response to the pulse 13*f* from the on/off selector 13*e*, and the pattern generator 8*b* for converting the master gate signal 8*c* to the gate signal pattern 8*a* of a switching electric power supply 5*b*, which drives an induction cell for acceleration; and thereby regulating the pulse density 17 of the induced voltage 9 of a control time block 15*c* in order to accelerate an arbitrary charged particle beam to an arbitrary energy level.

Furthermore, in a synchrotron 101 making use of induction cells, a charged particle beam orbit control device 106 comprises:

a variable delay time pattern calculator 114 for storing a required variable delay time pattern 118*b* corresponding to an ideal variable delay time pattern 118*a* calculated according to a magnetic excitation pattern 119 and generating a variable delay time signal 114*a* corresponding to a variable delay time 118 according to the required variable delay time pattern 118*b;* a variable delay time generator 115 for generating a pulse 115*a* corresponding to the variable delay time 118 in response to the passage signal 109*a* of a bunch 103 from a bunch monitor 109 placed on a design orbit 102 for a bunch 103 to circulate in and to the variable delay time signal 114*a* from the variable delay time calculator 114;

an acceleration voltage calculator 116 for storing an equivalent acceleration voltage amplitude pattern 108*d* corresponding to an ideal acceleration voltage amplitude pattern 108*c* calculated according to the magnetic excitation pattern 119 and generating a pulse 116*a* for on/off-selecting an induced voltage for acceleration 108 in response to a pulse 115*a* corresponding to the variable delay time 118 from the variable delay time generator 115 and a beam position signal 111*a* from a position monitor 111 for sensing the deviation of a charged particle beam on a design orbit 102 from the design orbit 102;

a digital signal processor 112 including a master gate signal output module 117 for generating a master gate signal 112*a* which is a pulse suited for a pattern generator 113 and in response to the pulse 116*a* from the acceleration voltage calculator 116; and the pattern generator 113 for generating a gate signal pattern 113*a* for on/off-selecting the switching electric power supply 105*a*, which drives an induction cell for acceleration, according to the master gate signal 112*a* generated by the digital signal processor 112.

In addition, a method of charged particle beam orbit control is realized, in a synchrotron 101 making use of induction cells, by using a variable delay time calculator 114 for storing a required variable delay time pattern 118*b* corresponding to an ideal variable delay time pattern 118*a* calculated according to a magnetic excitation pattern 119 and generating a variable delay time signal 114*a* corresponding to a variable delay time 118 according to the required variable delay time pattern 118*b*; a variable delay time generator 115 for generating a pulse 115*a* corresponding to the variable delay time 118 in response to the passage signal 109*a* of a bunch 103 from a bunch monitor 109 placed on a design orbit 102 for a charged particle beam to circulate in and to the variable delay time signal 114*a* from the variable delay time calculator 114; an acceleration voltage calculator 116 for storing an equivalent acceleration voltage amplitude pattern 108*d* corresponding to an ideal acceleration voltage amplitude pattern 108*c* calculated according to the magnetic excitation pattern 119 and generating a pulse 116*a* for on/off-selecting an induced voltage for acceleration 108 in response to a pulse 115*a* corresponding to the variable delay time 118 from the variable delay time generator 115 and a beam position signal 111*a* from a beam position monitor 111 for sensing the deviation of the charged particle beam on a design orbit 102 from the design orbit 102; a digital signal processor 112 including a master gate signal output module 117 for generating a master gate signal 112*a* which is a pulse suited for a pattern generator 113 in response to the pulse 116*a* from the acceleration voltage calculator 116; and the pattern generator 113 for converting the master gate signal 112*a* to a gate signal pattern 113*a* which is a combination of on and off states of the current path of a switching electric power supply 105*a*, which drives an induction cell for acceleration, and thereby stopping applying an excessive acceleration voltage 108*a* judging from the pulse density 120 of a control time block 121.

BRIEF DESCRIPTION OF THE DRAWINGS

FIG. 7 is a graphical drawing of the correlation between an acceleration energy level and a variable delay time;

FIG. 10 is a graphical drawing of experimental results;

FIG. 11 is a graphical view wherein the experimental results were processed;

FIG. 12 is a graphical drawing of the correlation between a fast ramping cycle and an equivalent acceleration voltage;

FIG. 13 is a schematic drawing of the acceleration principle of a proton beam based on an rf cavity;

FIG. 14 is a schematic drawing of the acceleration principle of a proton beam based on an induction cell;

FIG. 15 is a block diagram illustrating a synchrotron making use of induction cells incorporating the present invention;

FIG. 16 is a functional configuration diagram of a digital signal processor;

FIG. 17 is an explanatory drawing with respect to a variable delay time;

FIG. 18 is a graphical drawing of the correlation between an acceleration energy level and a variable delay time;

FIG. 19 is an explanatory drawing explaining an ideal acceleration voltage amplitude and an equivalent acceleration voltage amplitude;

FIG. 21 is a graphical drawing of a method of controlling the orbit of a charged particle beam by interrupting the generation of an acceleration voltage;

FIG. 22 is a graphical drawing of the principle of beam acceleration by an induced voltage;

FIG. 23 is an equivalent electric circuit diagram of an induction accelerating device for acceleration; and FIG. 24 shows the orbit of a charged particle beam and a condition in which the charged particle beam is confined in a horizontal direction by magnetic fields.

BEST MODE FOR CARRYING OUT THE INVENTION

Figure 1:
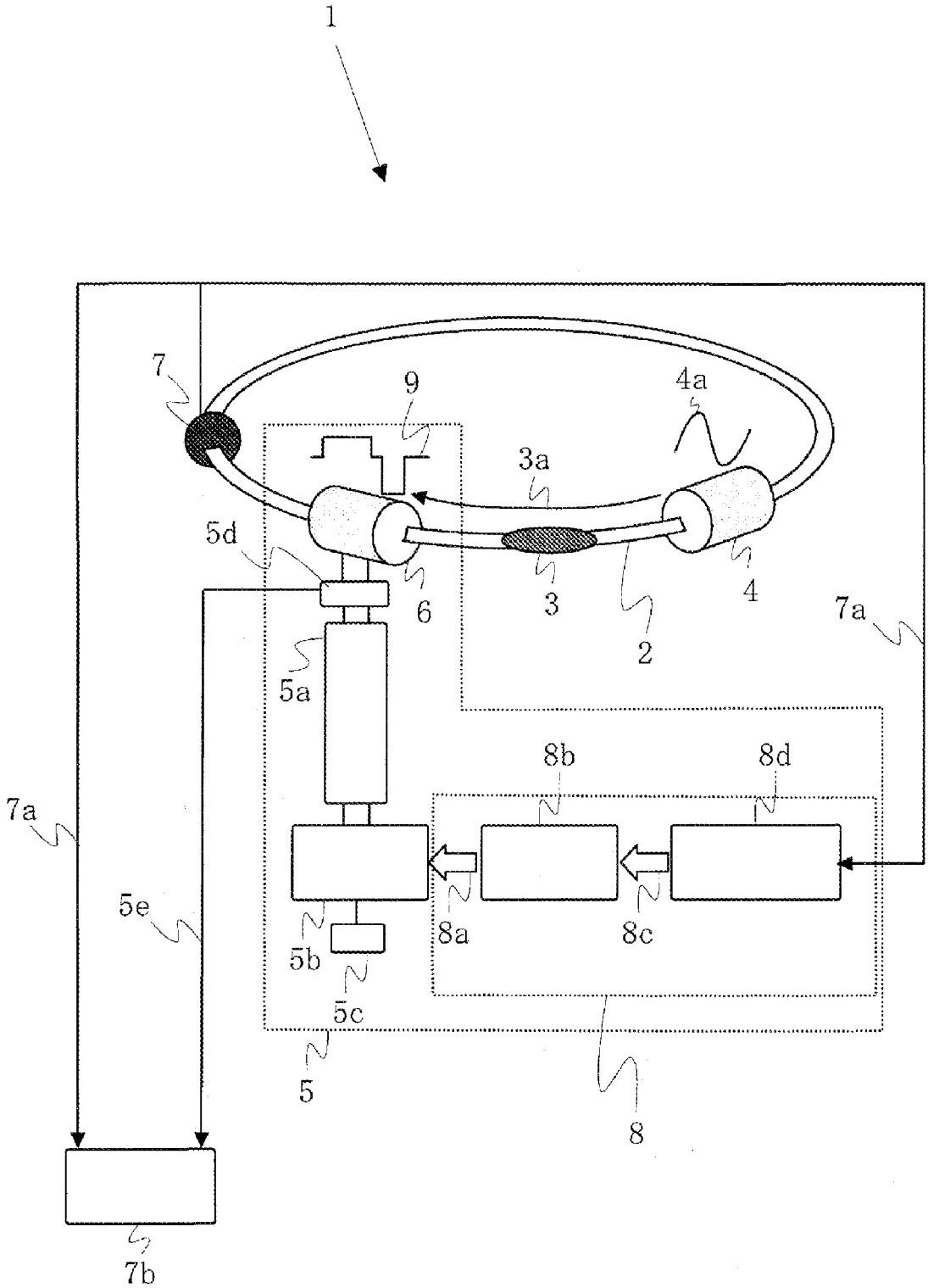
FIG. 1 is a schematic drawing of an experimental synchrotron incorporating the present invention.

Hereinafter, an induced voltage control device of the present invention will be described in detail with reference to the accompanying drawings. FIG. 1 is a schematic view of an experimental synchrotron making use of induction cells controlled by an induced voltage control device of the present invention.

As an experimental synchrotron 1 used in the present invention, the existing 12 GeVPS apparatus of KEK was used directly, including a bending electromagnet, a focusing quadrupole electromagnet, or the like that assures the strong focusing of a design orbit 2 for a proton beam accelerated to a certain energy level and injected by a preinjector to circulate in. The proton beam was longitudinally confined by controlling a radio frequency wave 4*a* provided by an rf accelerating device including a existing rf cavity 4. For the acceleration of the proton beam, an induction accelerating device for acceleration 5 newly built into the 12 GeV PS apparatus was used. The induction accelerating device for acceleration 5, which is connected to a vacuum chamber within which the design orbit 2 for a bunch 3 to circulate in exists, is comprised of an induction cell for acceleration 6 for applying an induced voltage 9 for acceleration to accelerate the bunch 3 in its longitudinal axis direction of ions 3*a*, a high-speed switching electric power supply 5*b* for providing a pulse voltage to the induction cell for acceleration 6 through a transmission line 5*a*, a DC power supply 5*c* for supplying power to the switching electric power supply 5*b*, an induced voltage control device 8 for controlling the on/off operation of the switching electric power supply 5*b*, and an induced voltage monitor 5*d* for monitoring a magnitude of an induced voltage applied from the induction cell for acceleration 6.

The induced voltage control device 8 of the present invention is comprised of a pattern generator 8*b* for generating a gate signal pattern 8*a* for controlling the on/off operation of the switching electric power supply 5*b* and a digital signal processor 8*d* for calculating a master gate signal 8*c* that is an original signal from which the gate signal pattern 8*a* is generated by the pattern generator 8*b*.

The gate signal pattern 8*a* is a signal sequence for controlling the induced voltage for acceleration 9 provided by the induction cell for acceleration 6. Specifically, the gate signal pattern 8*a* is comprised of a signal for determining the generation timing and charging timing of an acceleration voltage 9*a* and the generation timing and charging timing of a reset voltage 9*b* and a signal for determining a time during which the induced voltage for acceleration 9 positioned between the acceleration voltage 9*a* and the reset voltage 9*b* is not applied. Consequently, it is possible to adjust the generation timing and charging time-period of the induced voltage for acceleration 9 in conformity with the length of a charged particle beam to be accelerated, using the gate signal pattern 8*a*.

The pattern generator 8*b* is a device for converting the master gate signal 8*c* to a combination of on and off states of the current path of the switching electric power supply 5*b*.

Figure 2:
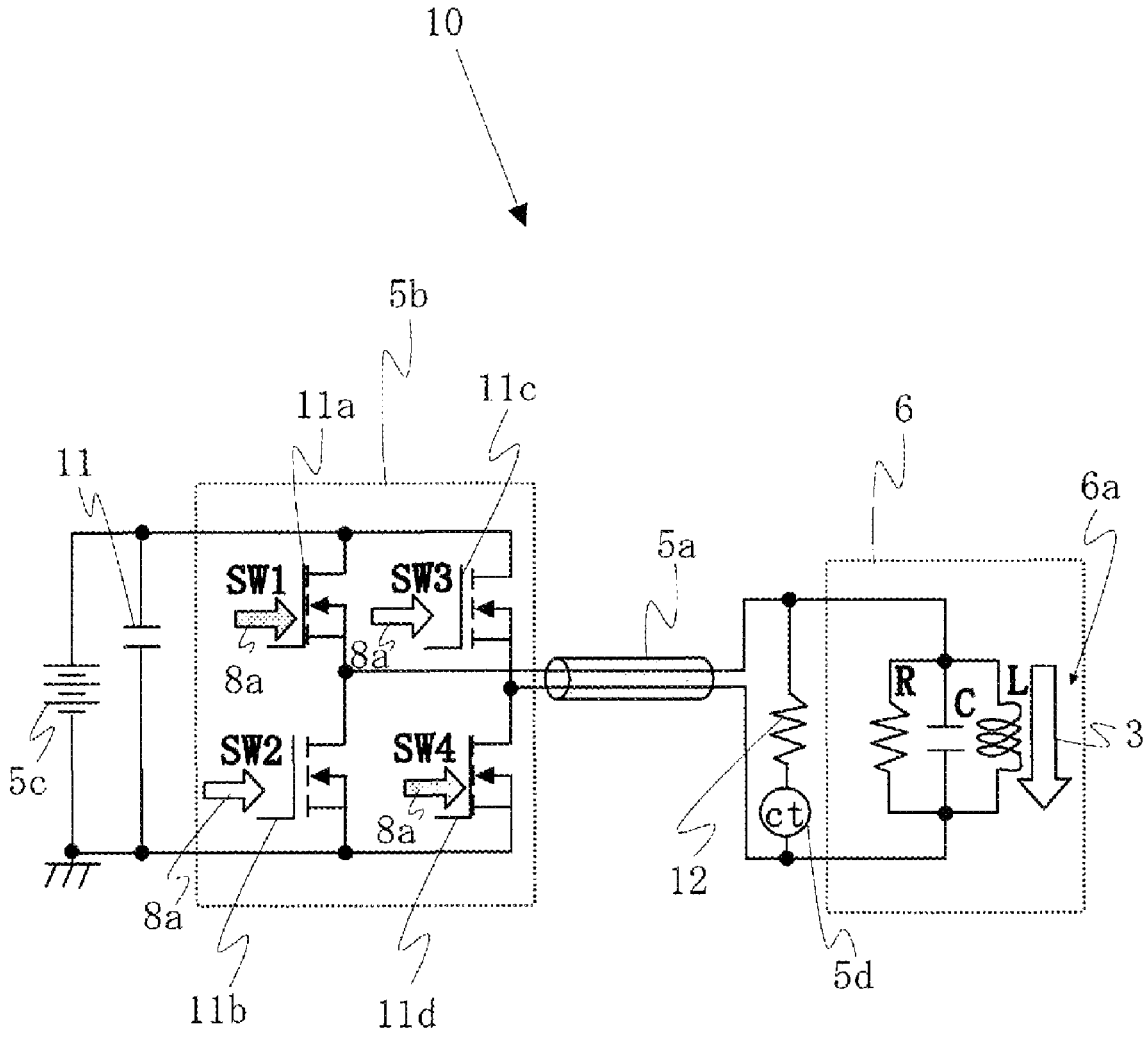
FIG. 2 is an equivalent electric circuit diagram of an induction accelerating device for acceleration.

The switching electric power supply 5*b* generally has a plurality of current paths and generates positive and negative voltages in a load (induction cell for acceleration 6 here) by regulating a current passing through each of these paths and controlling the direction of the current (FIG. 2).

In order to synchronize the generation timing and charging time-period of the induced voltage for acceleration 9 with the passage of the bunch 3 through induction cell, control is performed with the digital signal processor 8*d* using a passage signal 7*a* which is the passage information of the bunch 3 provided from a bunch monitor 7 for sensing the passage of the bunch 3 attached to the vacuum chamber.

Note that an oscilloscope 7*b* for detecting the passage signal 7*a* of the bunch 3 and an induced voltage signal 5*e* was connected to the experimental synchrotron 1 in order to observe acceleration experimental results.

FIG. 2 is an equivalent electric circuit diagram of an induction accelerating device for acceleration. The equivalent electric circuit diagram 10 of the induction accelerating device for acceleration can be represented as a circuit wherein the switching electric power supply 5*b*, which constantly receives power from the DC power supply 5*c*, is connected to the induction cell for acceleration 6 through a transmission line 5*a*. The induction cell for acceleration 6 is represented as a parallel circuit of an induction component L, a capacitance component C and a resistance component R. The voltage developing across the parallel circuit is an acceleration voltage 9*a* that a bunch 3 senses.

The state of the circuit shown in FIG. 2 is such that a first switch 11*a* and a fourth switch 11*d* are turned on by a gate signal pattern 8*a*, a voltage charged to a bank capacitor 11 is applied to the induction cell for acceleration 6, and an acceleration voltage 9*a* for accelerating the bunch 3 to an acceleration gap 6*a* is present.

Next, the turned-on first switch 11*a* and fourth switch 11*d* are turned off and a second switch 11*b* and a third switch 11*c* are turned on by the gate signal pattern 8*a*, thus producing a reset voltage 9*b* opposite in direction to the induced voltage in the acceleration gap 6*a* and thereby resetting the magnetic excitation of the magnetic material of the induction cell for acceleration 6.

Then, the second switch 11*b* and the third switch 11*c* are turned off and the first switch 11*a* and the fourth switch 11*d* are turned on by the gate signal pattern 8*a*. As the result of such a series of switching actions as described above being repeated by the gate signal pattern 8*a*, it is possible to generate the induced voltage 9 for acceleration necessary to accelerate the bunch 3.

The gate signal pattern 8*a* is a signal for controlling the driving of the switching electric power supply 5*b* and is digitally controlled by an induction accelerating device for acceleration 8 composed of a digital signal processor 8*d* and a pattern generator 8*b*, according to the passage signal 7*a* of the bunch 3.

Note that the value of the induced voltage for acceleration 9 applied to the bunch 3 is equivalent to a value calculated from the product of a current and a matching resistance 12 in the circuit. Consequently, it is possible to acquire the value of the applied induced voltage for acceleration 9 by measuring the current value using an "induced voltage monitor" 5*d*, in which an ammeter is embedded. Hence, it is possible to utilize the value for a method of induced voltage control by feeding back the value of the induced voltage for acceleration 9 as an induced voltage signal 5*e* to the digital signal processor 8*d*.

Figure 3:
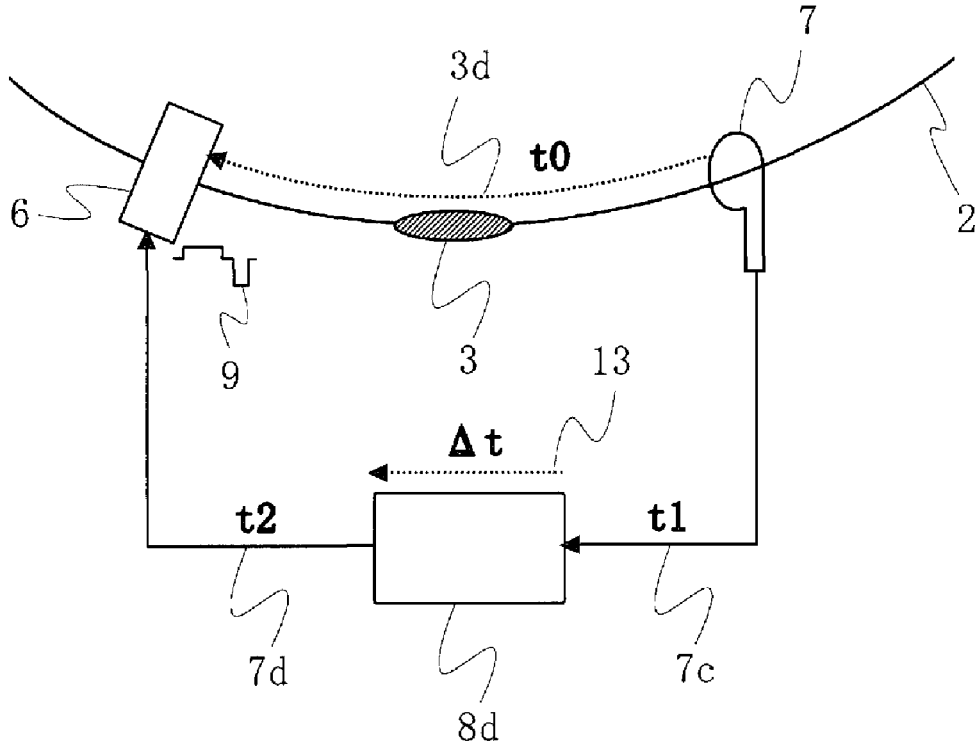
FIG. 3 is an explanatory drawing with respect to a variable delay time.

FIG. 3 is an explanatory drawing with respect to a variable delay time for synchronizing the revolution of a bunch with the generation timing of an induced voltage for acceleration. In order to accelerate a charged particle beam with the induced voltage for acceleration 9, the acceleration voltage 9*a* must be applied in synchronization with the time at which the bunch 3 reaches the induction cell for acceleration 6.

Furthermore, the revolution frequency at which the charged particle beam being accelerated circulates on the design orbit 2 per (revolution frequency: $f_{REV}$) changes through acceleration. For example, when accelerating a proton beam in the 12 GeVPS of KEK, the revolution frequency of the proton beam varies from 667 kHz to 882 kHz.

Consequently, in order to accelerate the charged particle beam just as intended, the acceleration voltage 9*a* must be applied in synchronization with the circulating time 3*d* of the bunch 3 that changes with the acceleration time, and the reset voltage 9*b* must be generated within a time duration during which the bunch 3 does not exist in the induction cell for acceleration 6.

Furthermore, there is a need to route signal cables for connecting between respective devices composing the accelerator over prolonged distances since components of a circular accelerator including a synchrotron making use of induction cells is installed and located in an accelerator tunnel. In addition, the velocity of a signal propagating through a signal line has a finite and fixed value. Therefore, there is no guarantee that the transmission time at which a signal passes through each device is the same as that before the configuration is altered, if the configuration of the circular accelerator is altered. For this reason, in the case of a circular accelerator including a synchrotron making use of induction cells, the charging timing must be re-set if an alteration is made to the components of the accelerator.

Hence, in order to solve the aforementioned problems, it was decided to adjust the time period from when the passage signal 7*a* of the bunch monitor 7 was generated to when the acceleration voltage 9*a* was applied, using the digital signal processor 8*d*. Specifically, control was performed within the digital signal processor 8*d* on the time period from when the passage signal 7*a* was received from the bunch monitor 7 to when the master gate signal 8*c* was generated. Hereinafter, this time period to be controlled is referred to as a variable delay time 13.

"Δt", which is the variable delay time 13, can be evaluated by Equation (1) shown below, assuming that a circulating time 3*d* taken by the bunch 3 to reach the induction cell for acceleration 6 from the bunch monitor 7 placed in any position on the design orbit 2 is "$t_0$", a transmission time 7*c* taken by the passage signal 7*a* to travel from the bunch monitor 7 to the digital signal processor 8*d* is "$t_1$", and a transmission time 7*d* required until the acceleration voltage 9*a* is applied by the induction cell for acceleration 6 according to the master gate signal 8*c* output from the digital signal processor 8*d* is "$t_2$".

$$\Delta t = t_0 - (t_1 + t_2) \quad \text{Equation (1)}$$

For example, assuming that the circulating time 3*d* of the bunch 3 at a certain acceleration time is 1 μs, the transmission time 7*c* of the passage signal 7*a* is 0.2 μs, and the transmission time 7*d* taken from when the master gate signal 8*c* is generated to when the acceleration voltage 9*a* is generated is 0.3 μs, then the required variable delay time 13 is 0.5 μs.

"Δt" varies with the lapse of the acceleration time. This is because "$t_0$" changes with the lapse of the acceleration time as the result of the charged particle beam being accelerated. Consequently, in order to apply the acceleration voltage 9*a* to the bunch 3, "Δt" needs to be calculated for each revolution of the bunch 3. On the other hand, "$t_1$" and "$t_2$" are set to fixed values once respective components composing the synchrotron making use of induction cells are determined.

"$t_0$" can be evaluated from the revolution frequency ($f_{REV}$(t)) of the charged particle beam and a length (L) from the bunch monitor 7 to the induction cell for acceleration 6 of the design orbit 2 for the charged particle beam to circulate on. Alternatively, "$t_0$" may be actually measured.

Here, there is shown a method of evaluating "$t_0$" from the revolution frequency ($f_{REV}$(t)) of the charged particle beam. Assuming that the overall length of the design orbit 2 for the charged particle beam to circulate on is "$C_0$", then "$t_0$" can be calculated in real time by Equation (2) shown below.

$$t_0 = L/(f_{REV}(t) \cdot C_0) \text{ [sec]} \quad \text{Equation (2)}$$

$f_{REV}$(t) can be evaluated by Equation (3) shown below.

$$f_{REV}(t) = \beta(t) \cdot c / C_0 \text{ [Hz]} \quad \text{Equation (3)}$$

where β(t) is a relativistic particle velocity and "c" is a light velocity ($c = 2.998 \times 10^8$ [m/s]). β(t) can be evaluated by Equation (4) shown below.

$$\beta(t) = \sqrt{1 - (1/(\gamma(t)^2))} \text{[dimensionless]} \quad \text{Equation (4)}$$

where "γ(t)" is a relativistic coefficient. "γ(t)" can be evaluated by Equation (5) shown below.

$$\gamma(t) = 1 + \Delta T(t)/E_0 \text{[dimensionless]} \quad \text{Equation (5)}$$

where "ΔT(t)" is an energy increment given by the acceleration voltage 9*a* and "$E_0$" is the static mass of the charged particle. "ΔT(t)" can be evaluated by Equation (6) shown below.

$$\Delta T(t) = \rho \cdot C_0 \cdot e \cdot \Delta B(t) \text{ [eV]} \quad \text{Equation (6)}$$

where "ρ" is the curvature radius of the bending electromagnet, "$C_0$" is the overall length of the design orbit 2 for the charged particle beam to circulate in, "e" is the charge amount the charged particle has, and "ΔB(t)" is an increment in beam-bending magnetic flux density from the start of acceleration.

The static mass ($E_0$) and the charge amount (e) of the charged particle vary depending on the type thereof.

The abovementioned series of equations for evaluating "Δt", which is the variable delay time 13, is referred to as definitional equations. When evaluating the variable delay time 13 in real time, the definitional equations are programmed in the variable delay time calculator 13*a* of the digital signal processor 8*d*.

Consequently, the variable delay time 13 is uniquely determined by the revolution frequency of a charged particle beam once the distance (L) from the bunch monitor 7 to the induction cell for acceleration 6 and the overall length ($C_0$) of the design orbit 2 for the charged particle beam to circulate in are determined. In addition, the revolution frequency of the charged particle beam is also uniquely determined by the magnetic excitation pattern 15.

Furthermore, once the type of charged particle and the settings of the synchrotron making use of induction cells are determined, the variable delay time 13 required at a certain point of acceleration is also uniquely determined. Accordingly, assuming that the bunch 3 accelerates in an ideal manner according to the magnetic excitation pattern 15, it is possible to calculate the variable delay time 13 in advance.

However, as described above, the acceleration voltage 9*a* applied to the charged particle beam does not take a constant value every time. Accordingly, in order to carry out efficient acceleration, it is desirable to calculate the variable delay time 13 in real time.

Figure 4:
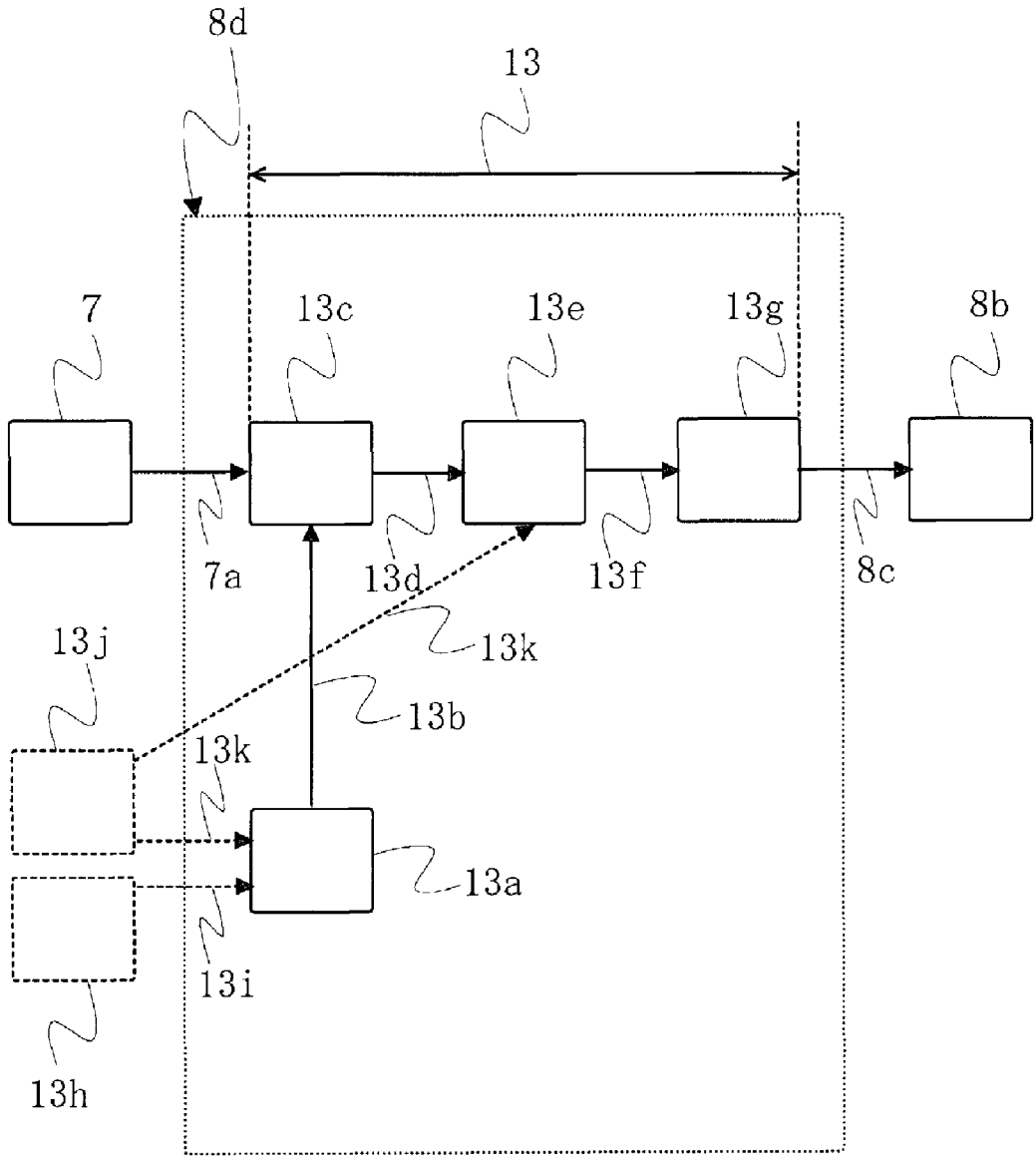
FIG. 4 is a functional configuration diagram of a digital signal processor.

FIG. 4 is a functional configuration diagram of a digital signal processor. The digital signal processor 8*d* is comprised of a variable delay time calculator 13*a*, a variable delay time generator 13*c*, an on/off selector 13*e* and a master gate signal output module 13*g*.

The variable delay time calculator 13*a* is a device for determining the variable delay time 13. By storing information on the type of charged particle and definitional equations for the variable delay time 13 calculated according to the magnetic excitation pattern 15 in the variable delay time calculator 13*a*, it is possible to calculate the variable delay time 13 in real time.

Information on the type of charged particle refers to the mass and charge number of the charged particle to be accelerated. As described above, the energy that the charged particle gains from the induction voltage for acceleration 9 is proportional to the charge state and the velocity of the charged particle thus gained is dependent on the mass thereof. Consequently, information on the type of charged particle is previously provided since a change in the variable delay time 13 depends on the velocity of the charged particle.

Alternatively, if the type of charged particle and the magnetic excitation pattern 15 have been previously determined, the variable delay time 13 may be previously calculated according to definitional equations and stored as a required variable delay time pattern (FIG. 7).

Note that in a case where the variable delay time 13 is calculated in real time for each revolution of the bunch 3, it is also possible to calculate the variable delay time 13 for each revolution of the bunch 3 in the same way as the variable delay time 13 is calculated beforehand by causing the variable delay time calculator 13*a* to receive the magnetic flux density at that time as a beam-bending magnetic flux density signal 13*k* from a bending electromagnet 13*j* composing the synchrotron making use of induction cells and provide information on the type of charged particle.

In addition, if a velocity signal 13*i* corresponding to the term "β(t)·c" in Equation (3) is provided in real time directly to the variable delay time calculator 13*a* using a velocity monitor 13*h* for measuring the revolution speed of the bunch 3, it is also possible to calculate the variable delay time 13 in real time according to Equations (1) and (2) described above, without having to provide information on the type of charged particle.

By calculating the variable delay time 13 in real time, it is possible to correct the generation timing of the acceleration voltage 9*a* and accurately apply the acceleration voltage 9*a* to the bunch 3 even if the acceleration voltage amplitude 9*k* deviates from a predetermined output voltage of a DC power supply 5*c*, a bank capacitor 11 or the like composing the induction accelerating device for acceleration 5 or even if a sudden fluctuation occurs in the revolution velocity of the charged particle beam due to some sort of disturbance. As a result, it is possible to even more reliably accelerate the charged particle beam.

The variable delay time 13 calculated or provided beforehand as described above is output to a variable delay time generator 13*c* as a variable delay time signal 13*b* which is in the form of digital data.

The variable delay time generator 13*c* is a counter based on a given frequency and is a device for retaining a passage signal 7*a* within the digital signal processor 8*d* for a given time period and then letting the signal pass therethrough. For example, if the counter in the generator operates at frequency of 1 kHz, the numeric value 1000 thereof is equivalent to one second. This means that it is possible to control the length of the variable delay time 13 by inputting a numeric value corresponding to the variable delay time 13 to the variable delay time generator 13*c*.

Specifically, the variable delay time generator 13*c* calculates the timing for generating the next induced voltage for acceleration 9 and outputs a pulse 13*d* which is information on the variable delay time 13 to an on/off selector 13*e* for each bunch 3 passing through the bunch monitor 7, according to the passage signal 7*a* from the bunch monitor 7 and the variable delay time signal 13*b* which is a numeric value corresponding to the variable delay time 13 output by the variable delay time calculator 13*a*.

For example, if the variable delay time signal 13*b* having a numeric value of 150 is output by the variable delay time calculator 13*a* to the variable delay time generator 13*c* which is a 1 kHz counter, then the variable delay time generator 13*c* generates the pulse 13*d* 0.15 seconds after receiving the passage signal 7*a* from the bunch monitor 7.

Note here that the passage signal 7*a* refers to a pulse generated in synchronization with the moment the bunch 3 passes through the bunch monitor 7. The pulse includes a voltage-type pulse, a current-type pulse and a optical-type pulse having an appropriate level of signal amplitude, depending on the type of medium or cable that transfers the pulse. The bunch monitor 7 for obtaining the passage signal 7*a* may be a monitor for sensing the passage of protons conventionally used for the rf synchrotron 21.

The passage signal 7*a* is used to provide the passage timing of a charged particle beam as numerical time data to the digital signal processor 8*d*. The position of the charged particle beam in its propagating axis direction 3*a* on the design orbit 2 is determined by the rising edge of a pulse generated due to the passage of the charged particle beam. In other words, the passage signal 7*a* is a reference for the start of the variable delay time 13.

The on/off selector 13*e* is a device for deciding whether to generate (on) or not generate (off) the induced voltage for acceleration 9.

For example, if in a case where the acceleration voltage 9*k* required at a given moment is 0.5 kV, "1" and "0" are defined as "1=Pulse 13*f* is generated; 0=Pulse 13*f* is not generated" and a pattern of 0s and 1s as to whether or not the acceleration voltage 9*a* is applied for each revolution of the bunch 3 using the acceleration voltage 9*a* having a given value of 1.0 kV as [1, 0, . . . , 0, 1] (five 1s and five 0s) while the bunch 3 circulates ten times, then an average acceleration voltage amplitude 9*h* that the bunch 3 has received during the ten revolutions is equivalent to 0.5 kV. In this way, the on/off selector 13*e* digitally modulates the acceleration voltage 9*a*.

The acceleration voltage amplitude 9*k* required at a given operating point in time can be given as an equivalent acceleration voltage amplitude pattern (FIG. 6) corresponding to an ideal acceleration voltage amplitude pattern (FIG. 6) calculated beforehand from the magnetic excitation pattern 15 if the type of charged particle and the magnetic excitation pattern 15 are fixed in advance.

The equivalent acceleration voltage amplitude pattern (FIG. 6) refers to a data set wherein, for example, the acceleration voltage amplitude 9*k* is set to 0 kV for 0.1 seconds from the start of acceleration, to 0.1 kV for a period between 0.1 to 0.2 seconds, to 0.2 kV for a period between 0.2 to 0.3 seconds, . . . , and to 1.0 kV for a period between 0.9 to 1.0 second, in a case where the acceleration voltage amplitude 9*k* is varied from 0 V to 1 kV in 1 second and controlled at a time interval of 0.1 seconds.

In addition, the acceleration voltage amplitude 9*k* required at a given operating point in time can be calculated in real time for each revolution of the bunch 3. When calculating the acceleration voltage amplitude 9*k* required at a given operating point in time, it is only necessary to calculate the acceleration voltage amplitude 9*k* according to the same computing equations as those used when the acceleration voltage amplitude 9*k* is previously calculated by receiving the magnetic flux density at that time as a beam-bending magnetic flux density signal 13*k* from a bending electromagnet 13*j* composing the synchrotron making use of induction cells.

The on/off selector 13*e* outputs a pulse 13*f* for controlling the generation of a master gate signal 8*c* determined according to the acceleration voltage amplitude 9*k* required at a given operating point in time during the acceleration of a charged particle beam given as described above, to a master gate signal output module 13*g*.

The master gate signal output module 13*g* is a device for generating a pulse, i.e., the master gate signal 8*c* for transferring the pulse 13*f*, which has passed the digital signal processor 8*d* and contains information on both the variable delay time 13 and on the on/off states of the induced voltage for acceleration 9, to the pattern generator 8*b*.

The rising edge of a pulse, which is the master gate signal 8*c* output from the master gate signal output module 13*g*, is used as the generation timing of the induced voltage for acceleration 9. The master gate signal output module 13*g* also plays the role of converting the pulse 13*f* output from the on/off selector 13*e* to a voltage-type pulse, a current-type pulse or a optical-type pulse having an appropriate level of signal amplitude, depending on the type of medium or cable that transfers the pulse to the pattern generator 8*b*.

Like the passage signal 7*a*, the master gate signal 8*c* is a rectangular voltage pulse which is output from the master gate signal output module 13*g* the moment the variable delay time 13 for synchronizing the timing of the charged particle beam with the timing of the acceleration voltage 9*a* has elapsed. The pattern generator 8*b* comes into operation by recognizing the rising edge of a pulse which is the master gate signal 8*c*.

The digital signal processor 8*d* configured as described above outputs the master gate signal 8*c*, on which the master gate signal pattern 8*a* for controlling the drive of the switching electric power supply 5*b* is based, to the pattern generator 8*b* with reference to the passage signal 7*a* from the bunch monitor 7 on the design orbit 2 for a charged particle beam to circulate in. It is therefore can be said that the digital signal processor 8*d* performs the on/off-regulation of the induced voltage for acceleration 9.

In particular, it is possible to apply the acceleration voltage 9*a* synchronized with the revolution frequency of a charged particle beam according to the magnetic excitation pattern 15 of the bending electromagnet 13*j* without having to change any settings, by calculating the variable delay time 13 and the required acceleration voltage amplitude 9*k* in real time.

In addition, in a case where the variable delay time 13 is to be calculated beforehand, it is possible to always synchronize the charged particle beam with the generation timing of the induced voltage for acceleration 9 simply by rewriting a required variable delay time pattern (FIG. 7) corresponding to an ideal variable delay time pattern (FIG. 7) within the variable delay time calculator 13*a* and an equivalent acceleration voltage amplitude pattern within the on/off selector 13*e* to calculation results in conformity with the charged particle selected and the magnetic excitation pattern 15. Consequently, it is possible to reliably accelerate an arbitrary charged particle to an arbitrary energy level.

Figure 5:
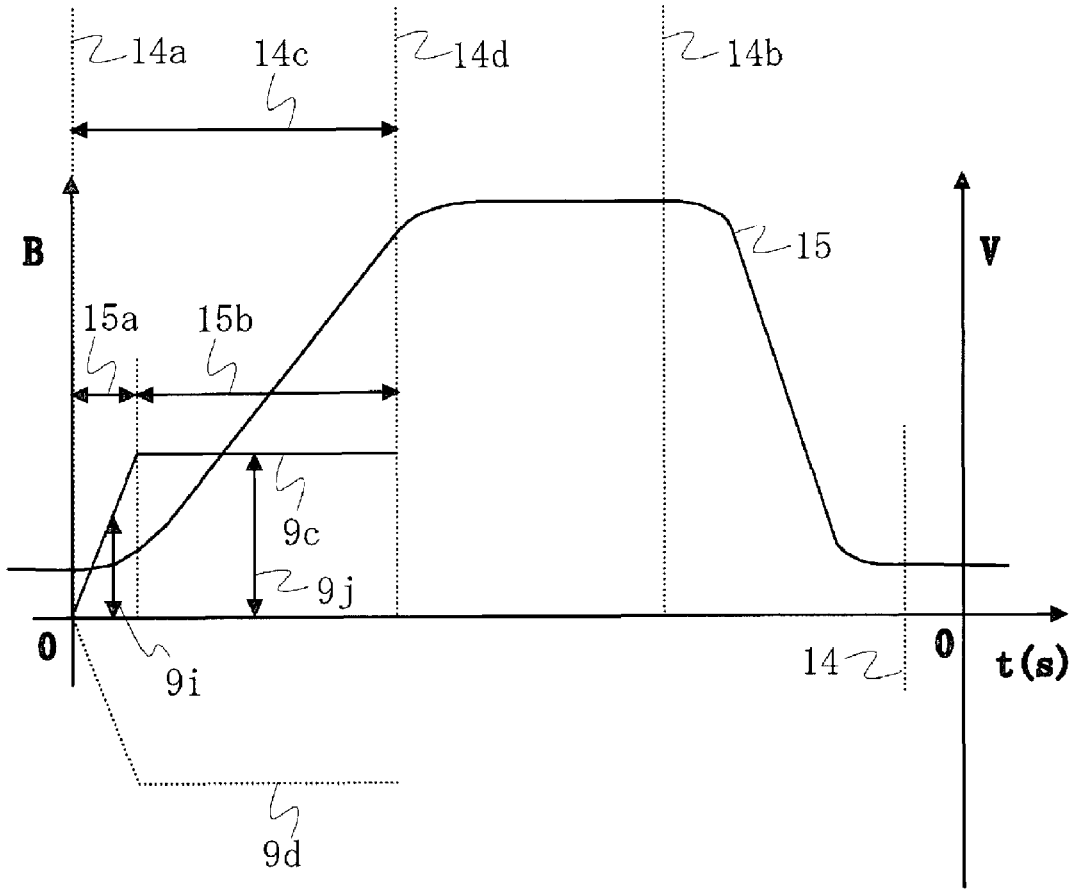
FIG. 5 is a graphical drawing of the correlation between a slow ramping cycle in a synchrotron and an acceleration voltage.

FIG. 5 is a graphical drawing of the correlation between the magnetic flux density in a single cycle and a required corresponding acceleration voltage. The axis of abscissa "t(s)" represents the operating time of a synchrotron for this experiment 1 in units of seconds. The first axis of ordinate "B" represents the magnetic flux density of a bending electromagnet 13*j* composing an experimental synchrotron 1. The second axis of ordinate "v" represents an induced voltage value. Note that this is one of the patterns of proton acceleration by the 12 GeVPS of KEK.

Slow cycling refers to acceleration based on a slow-cycling magnetic excitation pattern 15 wherein one period 14, which is a time from when a proton beam is injected (14*a*) from a preinjector, accelerated and extracted (14*b*) to when the next injection (14*a*) is ready, is in the order of several seconds.

In this magnetic excitation pattern 15, the magnetic flux density gradually increases immediately after the proton beam is injected (14*a*) the magnetic flux density reaches its maximum at the time of extraction (14*b*). At this time, the magnetic flux density greatly changes during an acceleration time 14*c* available for the acceleration of the proton beam, i.e., during a period from the injection (14*a*) to the end of acceleration (14*d*).

In particular, the magnetic flux density increases in a quadric manner immediately after the injection (14*a*) of the proton beam. The magnetic excitation pattern 15 in this time duration is referred to as a nonlinear excitation region in time 15*a*. This is due to the fact that a change in magnetic fields generated by the bending electromagnet 13*j* is temporally continuous.

Thereafter, the magnetic flux density increases linearly with respect to time until the end of acceleration (14*d*) is reached. The magnetic excitation pattern 15 in this time duration is referred to as a linear excitation region 15*b*.

Consequently, in order to accelerate the charged particle beam, a regulated voltage needs to be generated in synchronization with this change in the magnetic flux density. An acceleration voltage amplitude ($V_{acc}$) required in synchronization with the magnetic excitation pattern 15 at that time (hereinafter referred to as an ideal acceleration voltage amplitude pattern 9*c*) has the correlation represented by Equation (7) shown below.

$$V_{acc} \propto dB/dt \qquad \text{Equation (7)}$$

This means that the required acceleration voltage amplitude 9*k* at a given operating point in time is proportional to the rate of temporal change in the magnetic excitation pattern 15 at that time.

Accordingly, a required acceleration voltage 9*i* changes in linear proportion to a temporal change in the acceleration time 14*c* since the magnetic flux density increases in a quadric manner in the nonlinear excitation region 15*a*.

On the other hand, the required acceleration voltage amplitude 9*j* in the linear excitation region 15*b* is constant, irrespective of a change in the acceleration time 14*c*. Note that the content of Non-patent Document 2 mentioned earlier is a report that a proton beam can be accelerated using the constant acceleration voltage 9*a* applied at regular time intervals in this linear excitation region 15*b*.

Furthermore, it is needless to say that the reset voltage 9*b* must be applied next time after the acceleration voltage 9*a* is applied since it is not possible to continue applying the acceleration voltage 9*a* as described above. Here, a group of ideal acceleration voltage amplitude patterns 9*c* and heteropolar reset voltages 9*b* is referred to as an ideal reset voltage value pattern 9*d*.

Consequently, in order to synchronize this acceleration voltage 9*a* with the magnetic excitation pattern 15 of the nonlinear excitation region 15*a*, it is necessary to increase the acceleration voltage amplitude 9*i* along with temporal change.

However, since the induction cell for acceleration 6 itself does not have any induced voltage regulation mechanisms, the acceleration voltage amplitude 9*i* is only available as a constant voltage. It is conceivable though that the acceleration voltage amplitude 9*i* is varied by controlling the charging voltage of a bank capacitor 11 generated by the induction cell for acceleration 6. Since the bank capacitor 11 is normally loaded for the purpose of suppressing fluctuations in the charging voltage, it is in reality not possible, however, to use the method of modulating the charging voltage of the bank capacitor 11 for the purpose of promptly modulating the acceleration voltage amplitude 9*i*.

Hence, it was decided to synchronize the generation timing of the acceleration voltage 9*a* with the nonlinear excitation region 15*a* using an induced voltage control device 8.

Figure 6:
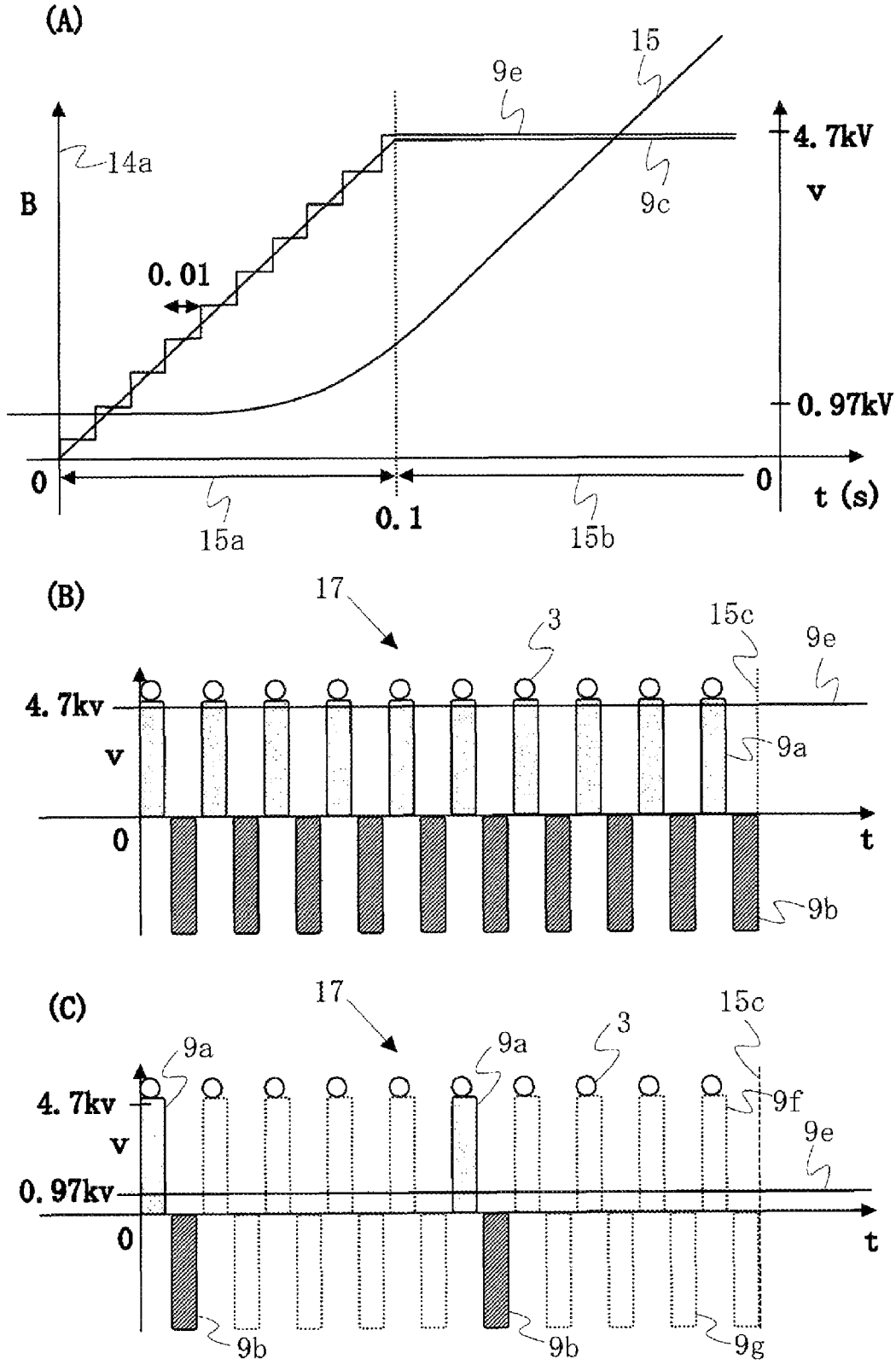
FIG. 6 is a graphical drawing of a method of controlling an equivalent acceleration voltage by means of pulse density modulation.

FIG. 6 is a graphical drawing of a method of controlling an equivalent acceleration voltage by means of pulse density modulation. FIG. 6(A) is a partially enlarged view of the acceleration time 14*c* shown in FIG. 5. In addition, the meanings of symbols are the same as those of FIG. 5.

FIG. 6(B) shows a group of the generation timings of the induced voltage for acceleration 9 (hereinafter referred to as a pulse density 17) for a given revolution frequency of the bunch 3 in the linear excitation region 15*b* of FIG. 6(A). FIG. 6(C) shows the pulse density 17 in the nonlinear excitation region 15*a* of FIG. 6(A).

In order to accelerate a proton beam in synchronization with the largely-varying magnetic excitation pattern 15, it must first be premised that the acceleration voltage 9*a* which has a constant voltage amplitude can be applied for each revolution of the proton beam using the induction cell for acceleration 6 capable of applying the required acceleration voltage amplitude 9*j* in the linear excitation region 15*b*.

For example, assuming that the required acceleration voltage amplitude 9*j* in the linear excitation region 15*b* is 4.7 kV from Equation (7), then there is the need for the induction cell for acceleration 6 capable of applying an acceleration voltage 9*a* of 4.7 kV or higher. The pulse density 17 at that time is shown in FIG. 6(B).

FIG. 6(B) shows that adjustments are made so that an acceleration voltage 9*a* of 4.7 kV, as well as the reset voltage 9*b*, is applied for each revolution of the bunch 3 since the required acceleration voltage amplitude 9*j* in the linear excitation region 15*b* of FIG. 6(A) is 4.7 kV. The number of the bunch 3's revolutions for which the pulse density 17 is controlled by grouping a given number of revolutions as described above is referred to as a control time block 15*c*.

Then, it is necessary to provide the ideal acceleration voltage amplitude pattern 9*c* to the bunch 3 to achieve synchronization with the nonlinear excitation region 15*a*. Even if the induction cell for acceleration 6 capable of applying only a constant-value acceleration voltage 9*a* is used, it is possible to provide the acceleration voltage amplitude 9*k* equivalent to the ideal acceleration voltage amplitude pattern 9*c* by modulating the frequency rate of applying the acceleration voltage 9*a* in the control time block 15*c*.

That is, it is possible to provide the acceleration voltage amplitude 9*k*, which is equivalent to the ideal acceleration voltage amplitude pattern 9*c* for a given time period, by increasing the frequency of applying the acceleration voltage 9*a* in the control time block 15*c* in incremental steps from 0 so that the acceleration voltage 9*a* is applied for each revolution of the bunch 3. A group of such equivalent acceleration voltage amplitudes 9*k* is referred to as an equivalent acceleration voltage amplitude pattern 9*e*.

For example, assuming that the maximum value of the required acceleration voltage amplitude 9*i* in the nonlinear excitation region 15*a* is 4.7 kV and the control time block 15*c* of the acceleration voltage 9*a* is 10 revolutions, then it is possible to adjust the acceleration voltage amplitude 9*k* in increments of 0.47 kV from 0 kV to 4.7 kV. As a result, it is possible to divide the equivalent acceleration voltage amplitude 9*k* in the nonlinear excitation region 15*a* into 10 steps. The pulse density 17 at that time is shown in FIG. 6(C).

FIG. 6(C) shows an example of a method for controlling the pulse density 17 in a case where the equivalent acceleration voltage amplitude 9*k* is 0.97 kV in the nonlinear excitation region 15*a*. If the number of the bunch 3's revolutions of the control time block 15*c* is 10, then the acceleration voltage 9*a* having a constant value of 4.7 kV is applied for any two of the ten revolution.

Specifically, it is only necessary to generate the acceleration voltages 9*a* and the reset voltage 9*b* shown by solid lines in FIG. 6(C). This can be technically realized by stopping applying acceleration voltages 9*f* and reset voltages 9*g* shown by dotted lines in real time.

Controlling the application of the acceleration voltage 9*a* in this way means that a voltage of 0.97 kV, which is the required acceleration voltage 9*i*, has been applied. Note that needless to say, the reset voltage 9*b* must be applied following the acceleration voltage 9*a*.

In addition, if the acceleration voltage amplitude 9*i* having a value smaller than 0.47 kV is required, then it is only necessary to adjust the ratio of the application frequency of the acceleration voltage 9*a* to the revolution frequency of the bunch 3. For example, if 0.093 kV is required as the acceleration voltage amplitude 9*i*, then it is only necessary to apply the acceleration voltage 9*a* twice for every 100 revolutions of the bunch 3.

Assuming here that the nonlinear excitation region 15*a* is defined as 0.1 seconds, then the time length of each step when the control time block 15*c* is specified as 10 is 0.01 seconds.

That is, the adjustment of the acceleration voltage amplitude 9*i* based on the control of the pulse density 17 is possible by carrying out control to stop the generation of the master gate signal pattern 8*a* according to the passage signal 7*a* from the bunch monitor 7, using the induced voltage control device 8 comprised of the digital signal processor 8*d* and the pattern generator 8*b*.

Note that the acceleration voltage amplitude ($V_{ave}$) applied to the bunch 3 during the control time block 15*c* is determined by Equation (8) shown below, from the constant acceleration voltage amplitude ($V_0$) applied by the induction cell for acceleration 6, the number of times the acceleration voltage 9*a* of the control time block 15*c* has been applied ($N_{on}$) and the number of times the acceleration voltage 9*a* has been turned off ($N_{off}$).

$$V_{ave}=V_0 \cdot N_{on}/(N_{on}+N_{off}) \quad \text{Equation (8)}$$

That is, according to the induced voltage control device 8 of the present invention, it is possible to apply the acceleration voltage 9*a* to the proton beam in synchronization with the slow-cycling magnetic excitation pattern 15, by adjusting the pulse density 17 of the control time block 15*c* using such a method as described above even if the induction cell for acceleration 6 is capable of only applying the acceleration voltage 9*a* having an almost constant voltage amplitude ($V_0$).

FIG. 7 is a graphical drawing of the correlation between an acceleration energy level and a variable delay time. FIG. 7(A) shows the correlation between the energy level of a proton beam and the variable delay time 13. Note that the graph represents values obtained when the induced voltage control device 8 of the present invention was built in the 12 GeVPS of KEK and a proton beam was injected (14*a*) into the experimental synchrotron 1.

The axis of abscissa "MeV" represents the energy level of a proton beam in units of megaelectronvolts. 1 MeV corresponds to $1.602\times10^{-13}$ joule. The axis of ordinate "Δt(μs)" represents the variable delay time 13 in units of microseconds.

The graph of FIG. 7(A) shows an ideal variable delay time pattern 16 and a required variable delay time pattern 16*a* corresponding to the ideal variable delay time pattern 16.

The ideal variable delay time pattern 16 refers to the variable delay time 13 adapted to a change in the energy level and required in a period from the time when the bunch 3 passes through the bunch monitor 7 to the time when the digital signal processor 8*d* outputs the master gate signal 8*c*, assuming that the variable delay time 13 is adjusted for each revolution of the proton beam in order to apply the acceleration voltage 9*a* in synchronization with a change in the revolution velocity of the proton beam.

The required variable delay time pattern 16*a* refers to the variable delay time 13 adapted to a change in the energy level, whereby the acceleration voltage 9*a* can be applied to a charged particle beam, as with the ideal variable delay time pattern 16. This is because the control accuracy of a pulse 13*d* appropriate for the variable delay time 13 of the variable delay time generator 13*c* is ±0.01 μs and also because there is a temporal span in the charging timing of the acceleration voltage 9*a* and, therefore, it is possible to carry out fully efficient acceleration without losing the charged particle even if the variable delay time 13 is not controlled for each revolution of the bunch 3, though it is ideally desirable to control the variable delay time 13 for each revolution of the charged particle beam.

Hence, the variable delay time 13 is controlled by a given unit of fixed time. This unit is referred to as a control time block 16*b*, which is 0.1 μs here.

From the graph shown in FIG. 7(A), it is understood that the ideal variable delay time 13 for synchronizing the generation timing of the acceleration voltage 9 with the proton beam at a low energy level immediately after the injection (14*a*) requires a length of approximately 1.0 μs in acceleration using the 12 GeVPS of KEK.

In addition, the proton beam increases its energy level as the acceleration time 14*c* elapses and the variable delay time 13 shortens accordingly. In particular, it is understood that the value of the required variable delay time pattern 16*a* is extremely close to 0 in a period from the point of approximately 4500 MeV to the end of acceleration (14*d*).

FIG. 7(B) shows a condition in which the time taken until the master gate signal 8*c* calculated and output by the digital signal processor 8*d* is output becomes shorter as the acceleration time 14*c* elapses. The axis of abscissa "Δt(μs)" represents the variable delay time 13 in units of microseconds. Note that the axis of abscissa "Δt(μs)" corresponds to the axis of ordinate shown in FIG. 7(A).

For example, a proton beam that requires the variable delay time to be 1.0 μs immediately after injection (14*a*) only requires the variable delay time 13 to be as short as 0.2 μs for a time duration near an energy level of 2000 MeV.

This means that by controlling the time taken until the master gate signal 8*c* is output according to the passage signal 7*a* available from the bunch monitor 7 using the digital signal processor 8*d*, i.e., by controlling the variable delay time 13, it is possible to apply the acceleration voltage 9*a* in synchronization with the revolution frequency of the bunch 3, from a lower energy level immediately after injection (14*a*) to a high energy level in the last half period of acceleration.

Figure 8:
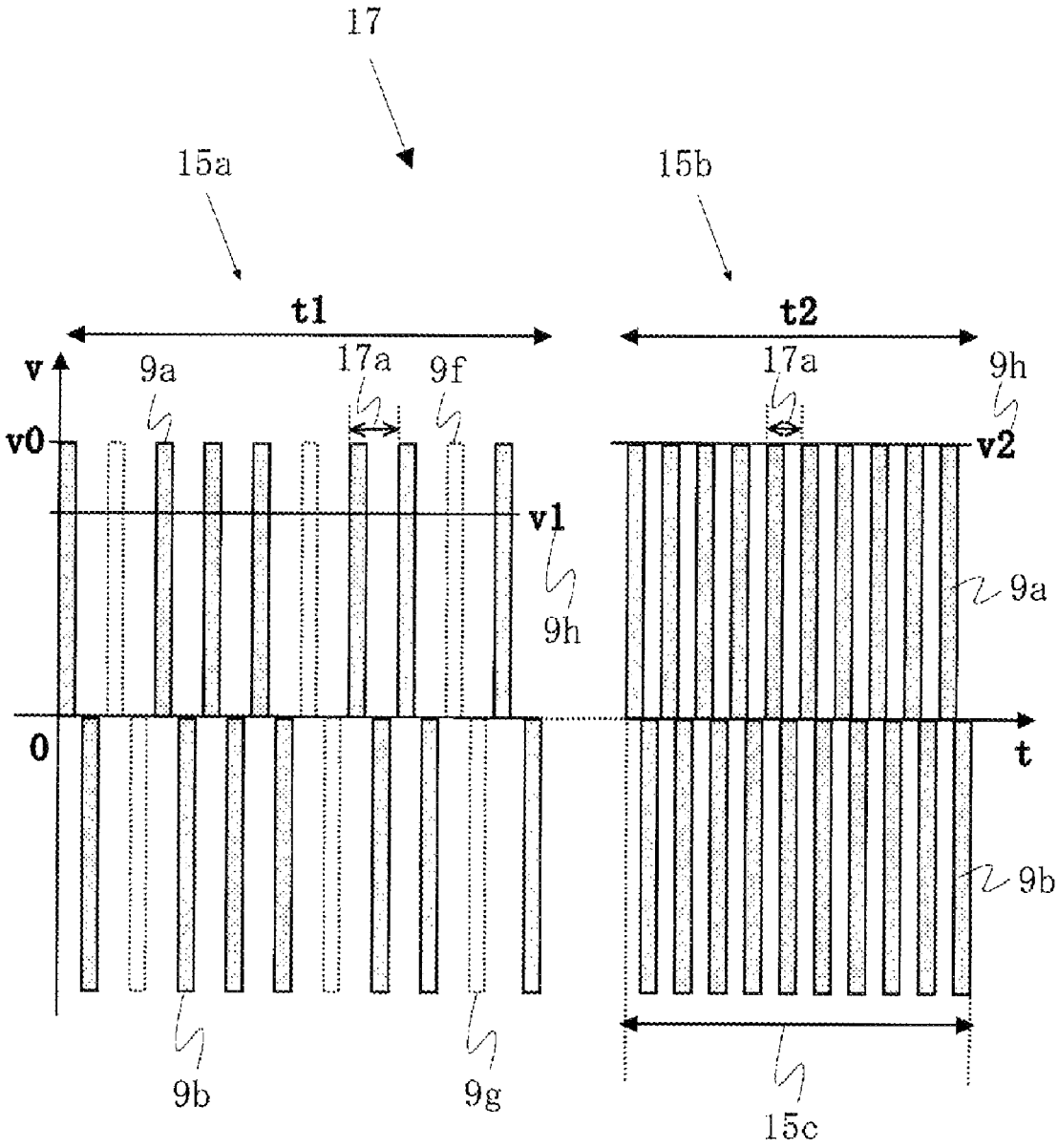
FIG. 8 is a graphical view exemplifying a method of controlling an induced voltage for acceleration by means of pulse density modulation.

FIG. 8 is a graphical view exemplifying a method of controlling an induced voltage for acceleration by means of pulse density modulation. The meanings of symbols "t" and "v" are the same as those of FIG. 6. Symbol "$t_1$" denotes the time required for the control time block 15*c* in a case where the control time block 15*c* in the nonlinear excitation region 15*a* is ten-odd revolutions. Symbol "$t_2$" denotes the time required for the control time block 15*c* in a case where the control time block 15*c* in the linear excitation region 15*b* is ten-odd revolutions.

An acceleration voltage 9*f* shown by a dotted line denotes an acceleration voltage not applied even if the bunch 3 reaches the induction cell for acceleration 6. Likewise, a reset voltage 9*g* shown by a dotted line denotes a reset voltage not applied.

Symbol "$v_1$" denotes an average acceleration voltage amplitude 9*h* applied to the bunch 3 during "$t_1$". "$v_1$" can be calculated as $v1=7/10 \cdot v_0=0.7v_0$ since the acceleration voltage 9*a* having a constant voltage amplitude of "$v_0$" is applied during "$t_1$", i.e., for seven out of ten passages of the bunch 3 through the induced voltage for acceleration 6. This also holds true for the reset voltage 9*b*.

As a matter of course, it is also possible to provide the ideal acceleration voltage amplitude 9*i* which is required for the linear excitation region 15*b* and has a constant value. "$v_2$", which is the average acceleration voltage amplitude 9*h* at that time, is calculated as $v2=10/10 \cdot v_0=v_0$ since the acceleration voltage 9*a* having a constant voltage amplitude of "$v_0$" is applied to the bunch 3 passing through the induction cell for acceleration 6 during "$t_2$" for each revolution of the bunch 3.

Furthermore, it is possible for the time interval between the continuously applied acceleration voltages 9*a* (hereinafter referred to as a pulse interval 17*a*) to consequently cope with the shortening of the revolution time period 24 of the bunch 3 by following the required variable delay time pattern 16*a*.

By controlling the pulse density 17 using the induced voltage control device 8 as described above, it is possible for even the induction cell for acceleration 6 capable of applying only the constant acceleration voltage 9*a* to achieve synchronization with the magnetic excitation pattern 15 in the largely-varying nonlinear excitation region 15*a*, by providing the induction cell for acceleration 6 with the equivalent acceleration voltage amplitude pattern 9*e* corresponding to the ideal acceleration voltage amplitude pattern 9*c*.

Consequently, by controlling the pulse density 17 of the induced voltage for acceleration 9 using the induced voltage control device 8 of the present invention, it is possible to accelerate an arbitrary charged particle to an arbitrary energy level in conformity with every magnetic excitation pattern.

Figure 9:
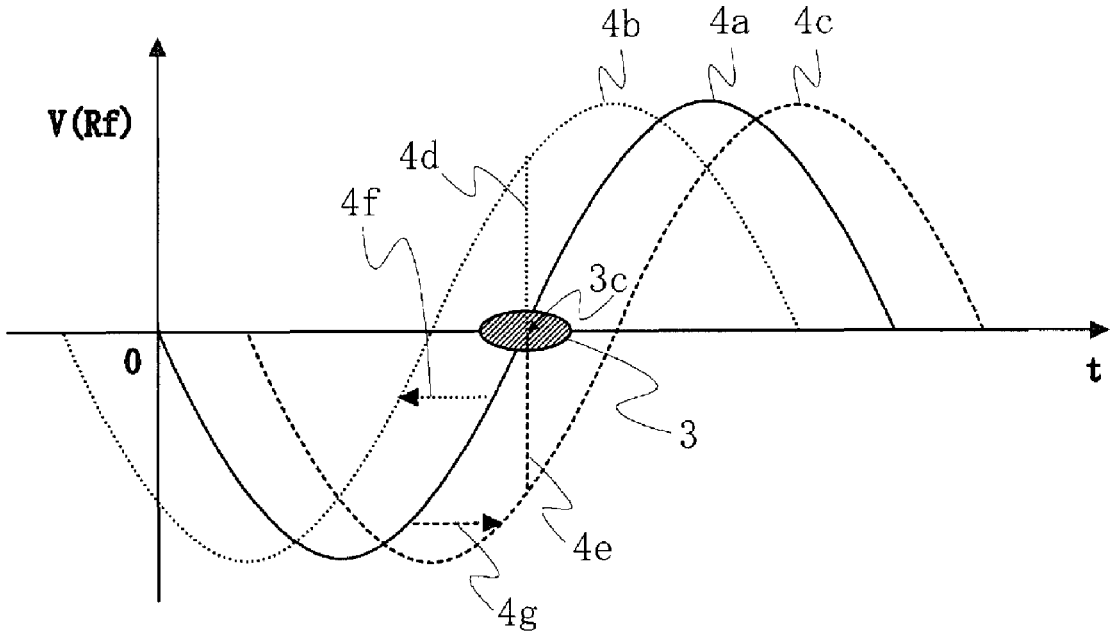
FIG. 9 is a graphical view explaining the experimental principle of acceleration control by means of pulse density modulation.
Figure 1:
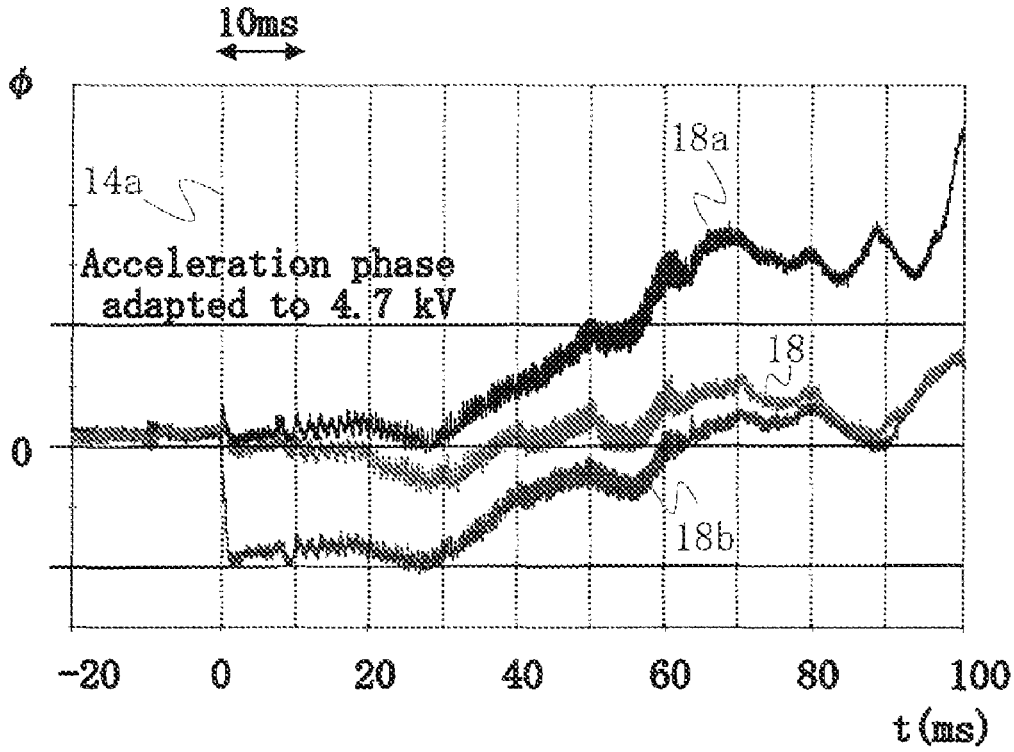
Figure 1:
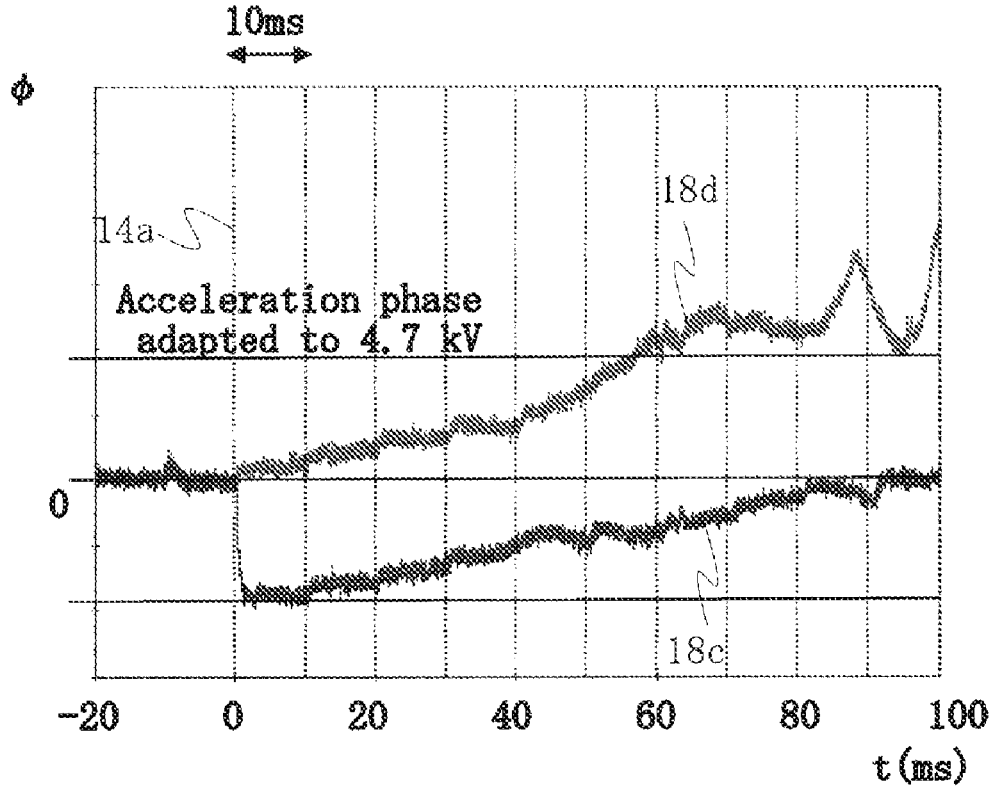
Figure 1:
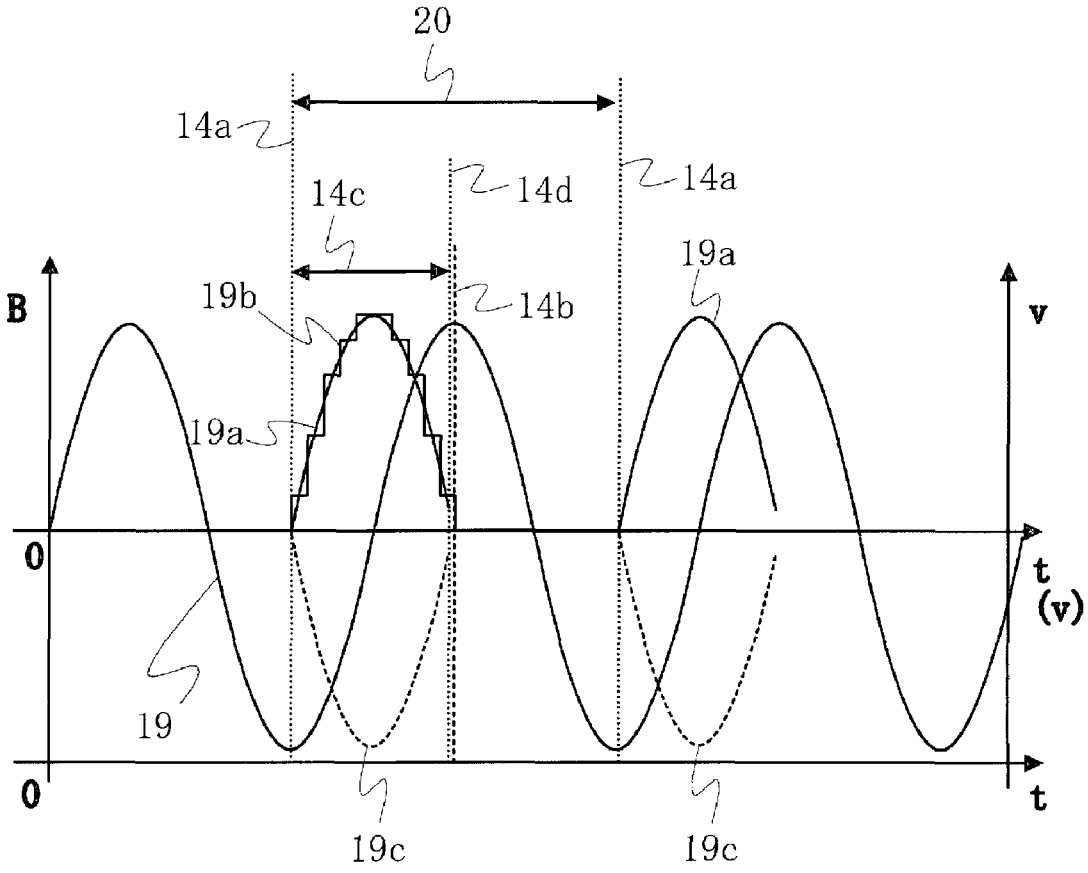
Figure 1:
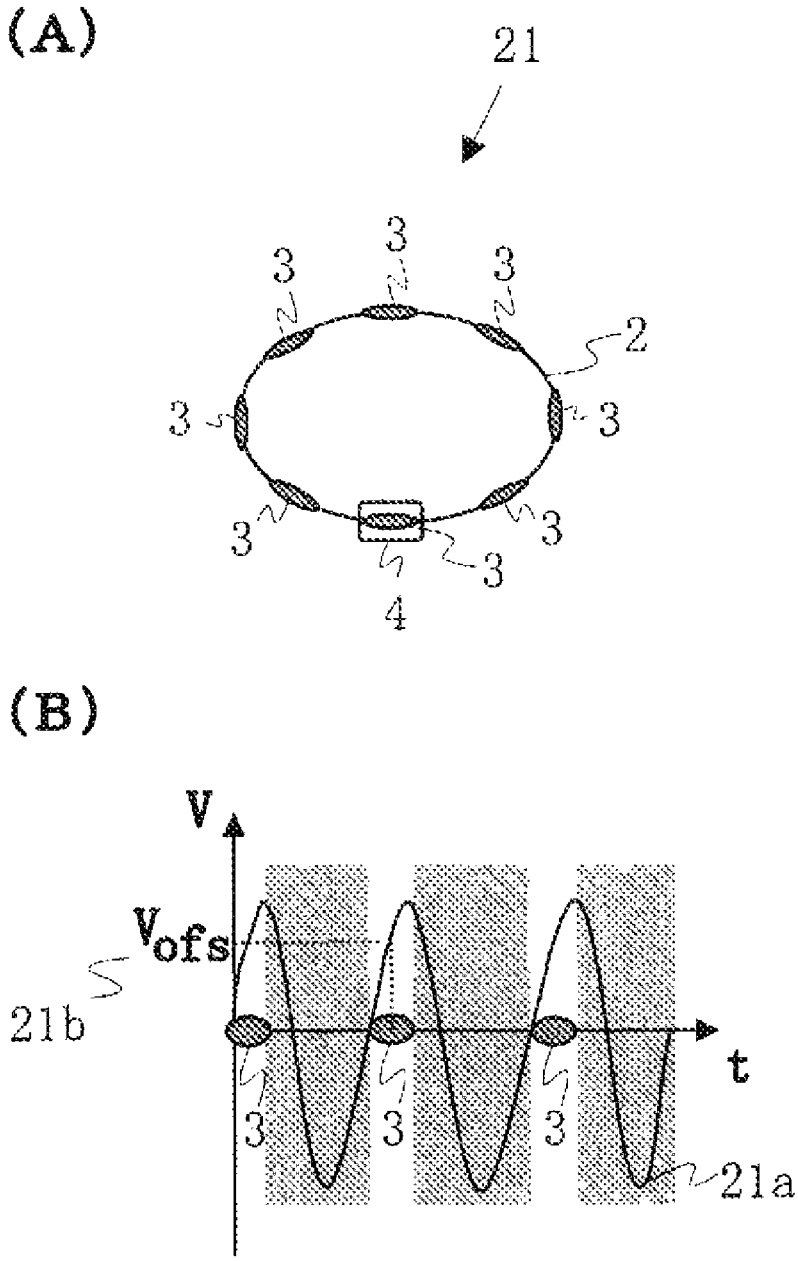
Figure 1:
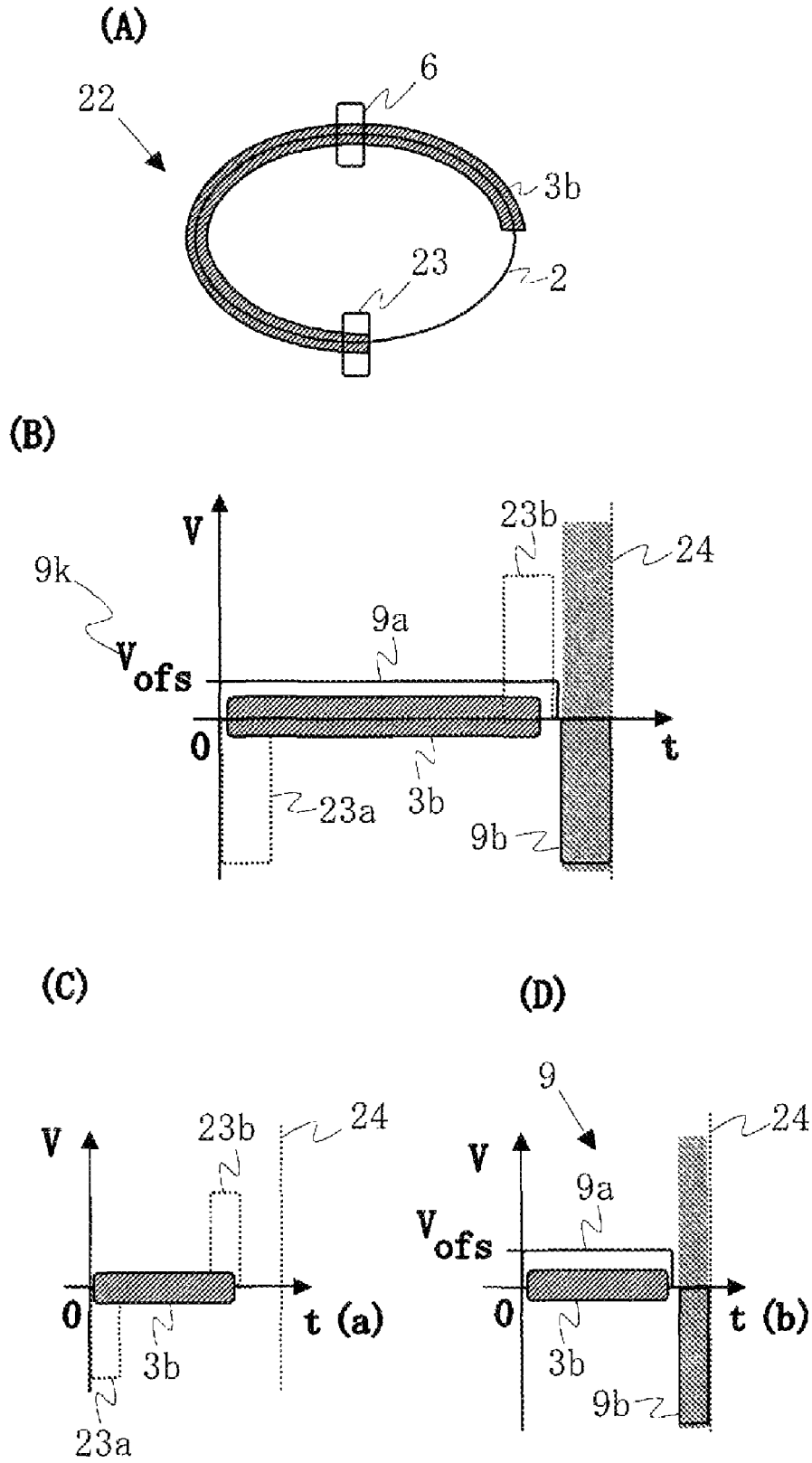
Figure 1:
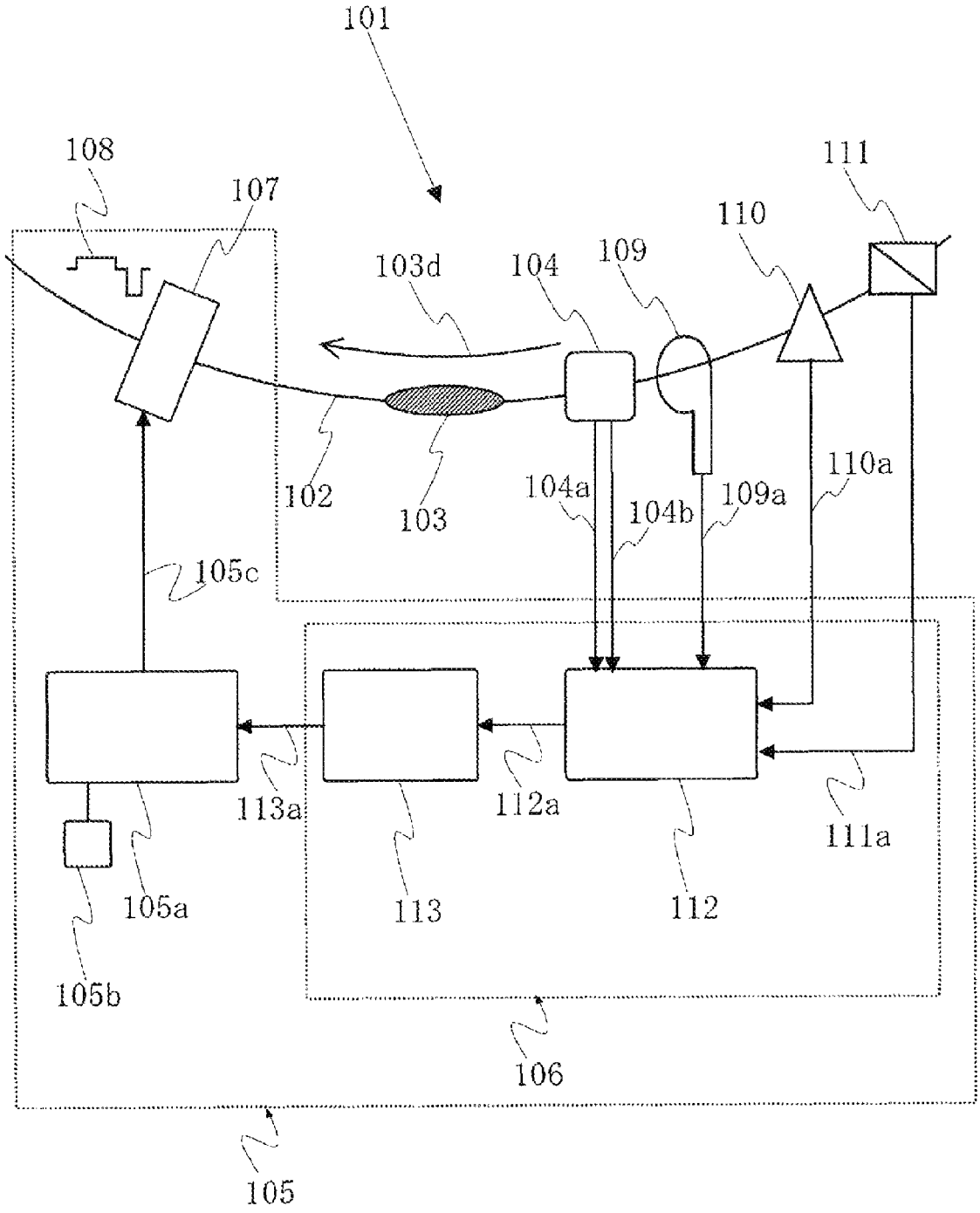
Figure 1:
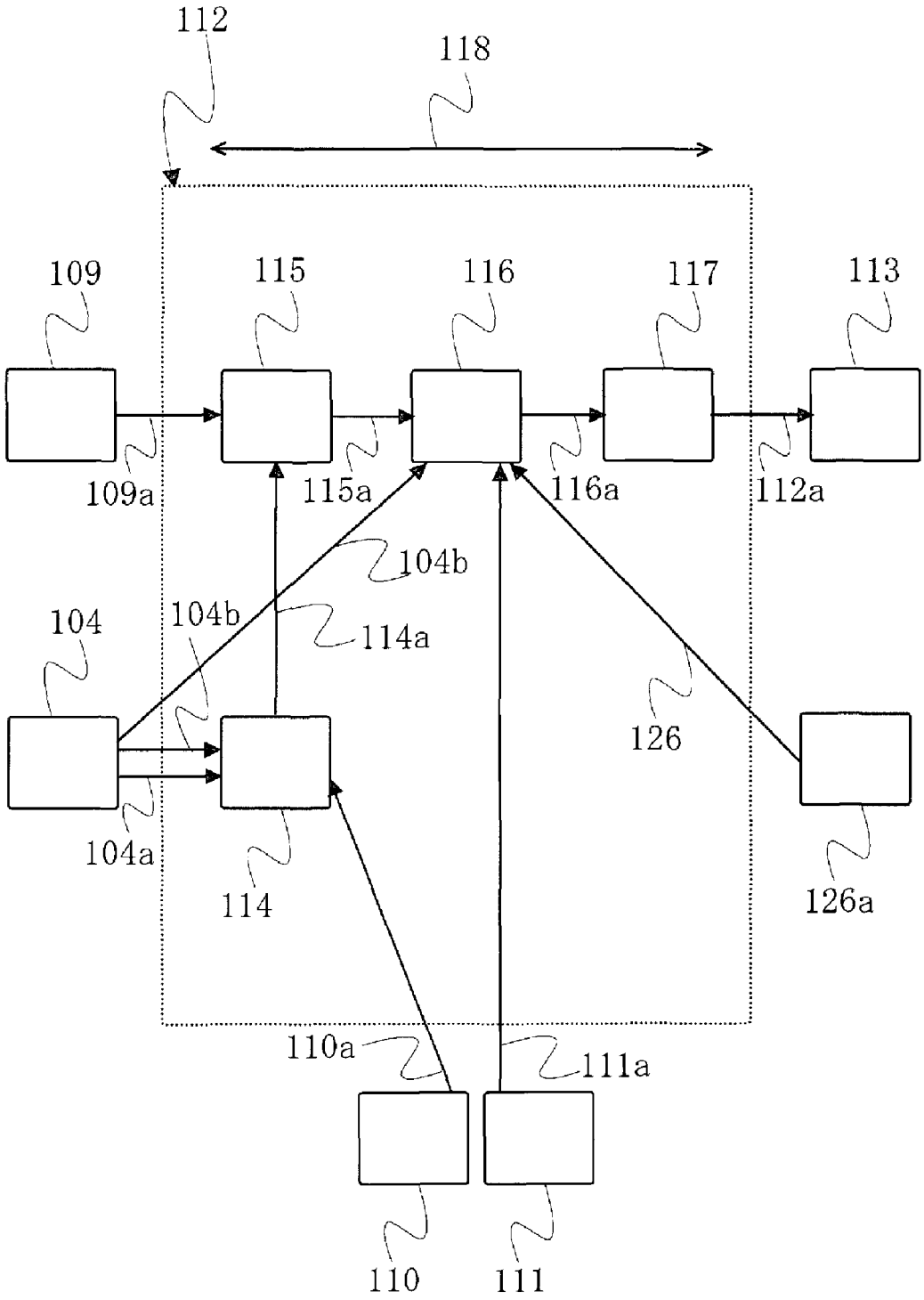
Figure 1:
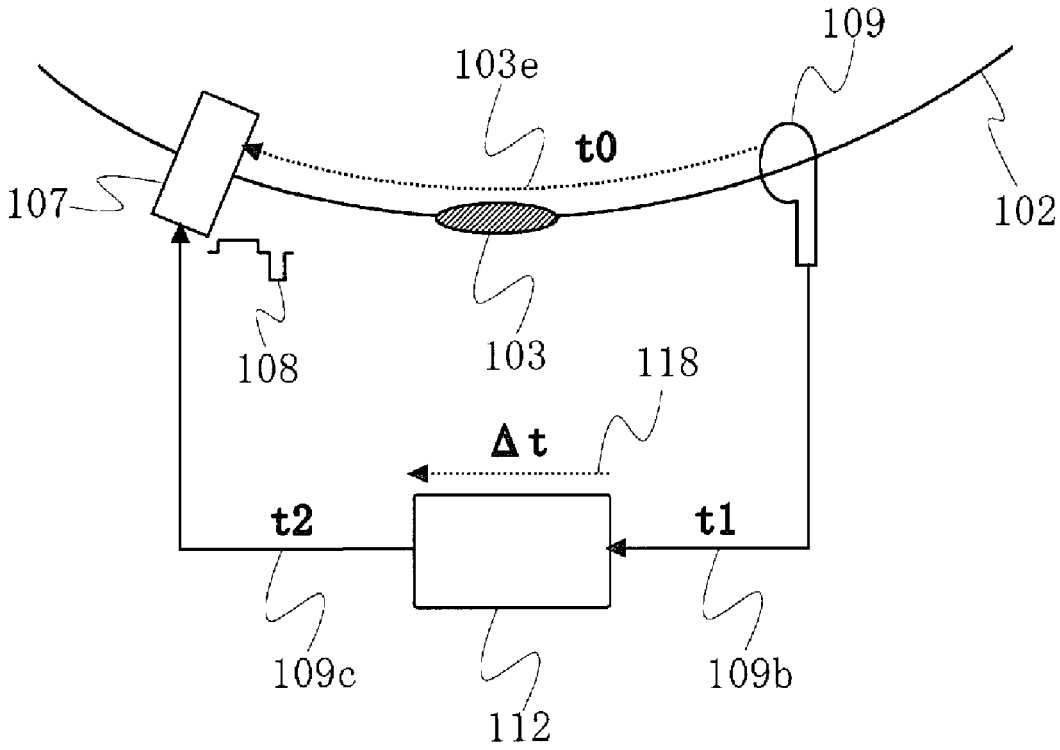
Figure 1:
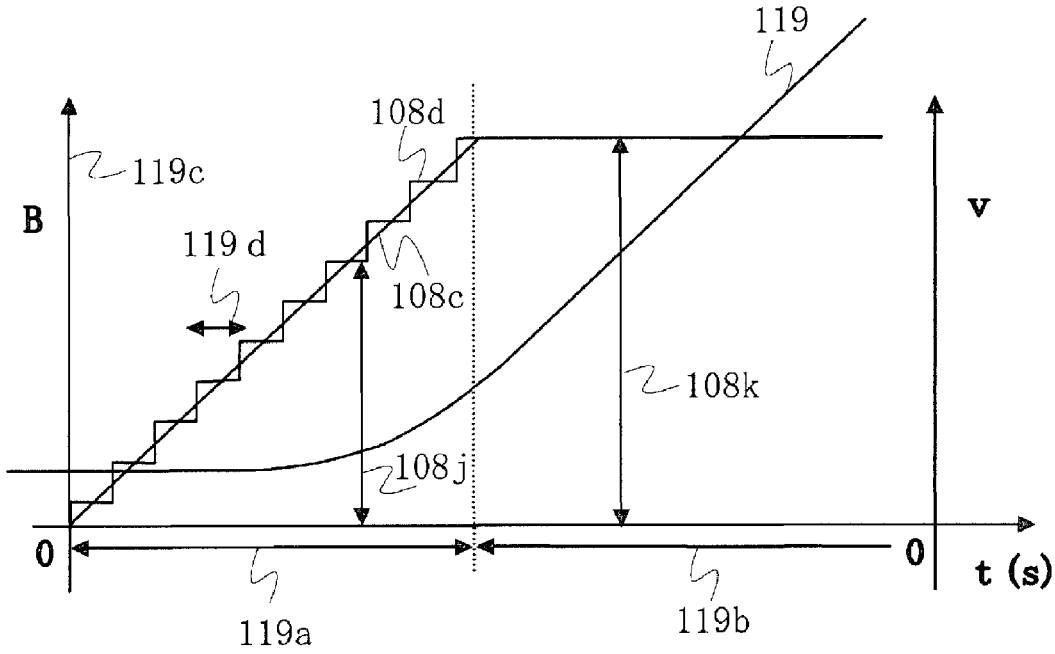

FIG. 9 is a graphical view explaining the experimental principle of acceleration control by means of pulse density modulation. Note that the axis of abscissa "t" represents a temporal change in the rf cavity 4 and the axis of ordinate "V(RF)" represents an rf acceleration voltage amplitude 21*b*.

Hereinafter, the experimental principle will be described when a verification was made using an experimental hybrid-type synchrotron 1 configured by building the induction cell for acceleration 6 in the 12 GeVPS of KEK, as to whether or not proton beams can be accelerated by controlling the pulse density 17 with the induced voltage control device 8 of the present invention.

As the experimental principle, there was employed a method of examining whether or not the acceleration voltage 9*a* applied indirectly by the induction cell for acceleration 6 was synchronized with the magnetic excitation pattern 15 by concurrently using the acceleration voltage 9*a* and the radio-frequency wave 4*a* applied by the rf cavity 4.

The rf cavity 4 used in this experiment is a device capable of automatically controlling the phase of the rf acceleration voltage 21*a* so as to zero the rf acceleration voltage amplitude 21*b* applied to the bunch center 3*c*, if the equivalent acceleration voltage amplitude 9*k* can be applied to the bunch 3 so that the acceleration voltage 9*a* applied by the induction cell for acceleration 6 is synchronized with the magnetic excitation pattern 15.

Automatically controlling the phase of the rf acceleration voltage 21*a* means shifting the phase in a decelerating direction 4*g*, so as to apply a negative voltage 4*e* to the bunch 3 if the acceleration voltage 9*a* to be applied from the induction cell for acceleration 6 is applied to the bunch 3 in excess of the ideal acceleration voltage amplitude pattern 9*c* based on the magnetic excitation pattern 15, or shifting the phase in a accelerating direction 4*f*, so as to apply a positive voltage 4*d* if the acceleration voltage 9*a* is insufficient with respect to the ideal acceleration voltage amplitude pattern 9*c* based on the magnetic excitation pattern 15.

In order to examine how the phase of the rf acceleration voltage 21*a* is controlled, the rf acceleration voltage amplitude 21*b* of the bunch center 3*c* was measured. As a result, it was confirmed that the induced voltage for acceleration 9 was synchronized with the magnetic excitation pattern 15 if the rf acceleration voltage amplitude 21*b* of the bunch center 3*c* was 0. This means that the control of the pulse density 17 based on the induced voltage control device 8 may be evaluated as being appropriate.

On the other hand, the phase of the radio-frequency wave 4*a* is shifted in the accelerating direction 4*f* to the position of the radio-frequency wave 4*b*, so that the positive voltage 4*d* is applied to the bunch center 3*c*, and is thus synchronized with the magnetic excitation pattern 15, since the acceleration voltage 9*a* is insufficient with respect to the equivalent acceleration voltage amplitude pattern 9*e* corresponding to the ideal acceleration voltage amplitude pattern 9*c* if the rf acceleration voltage 21*a* of the bunch center 3*c* is the positive voltage 4*d*. Thus, the control of the pulse density 17 based on the induced voltage control device 8 may be evaluated as being inappropriate.

In contrast, the phase of the radio-frequency wave 4*a* is shifted in the decelerating direction 4*g* to the position of the radio-frequency wave 4*c*, so that the negative voltage 4*e* is applied to the bunch center 3*c*, and is thus synchronized with the magnetic excitation pattern 15, since the acceleration voltage 9*a* is excessive with respect to the equivalent acceleration voltage amplitude pattern 9*e* corresponding to the ideal acceleration voltage amplitude pattern 9*c* if the rf acceleration voltage 21*a* of the bunch center 3*c* is the negative voltage 4*e*. Thus, the control of the pulse density 17 based on the induced voltage control device 8 may also be evaluated as being inappropriate.

Accordingly, by measuring the rf voltage value of the bunch center 3*c*, it is possible to know whether the control of the pulse density 17 based on the induced voltage control device 8 has been carried out in an appropriate manner in order to apply the acceleration voltage 9*a* synchronized with the magnetic excitation pattern 15.

FIG. 10 is a graphical drawing of experimental results. Specifically, FIG. 10 shows the result of measuring rf voltage values when a proton beam was accelerated using the experimental synchrotron 1 which is the modified 12 GeVPS of KEK shown in FIG. 1.

The axis of abscissa "t(ms)" represents, in units of milliseconds, the lapse of the acceleration time 14*c* based on the point in time when a proton beam was injected (14*a*) into the experimental synchrotron 1. The axis of ordinate "v" represents a phase Φ and 4.7 kv in the figure refers to an acceleration phase corresponding to an induced voltage value of 4.7 kV.

For the magnetic excitation pattern 15 used in the experiments, there was selected a pattern (from 0 to 100 ms) given immediately after injection (14*a*) wherein the variation of the ideal acceleration voltage amplitude 9*k* in the nonlinear excitation region 15*a* shown in FIG. 6(A) was particularly remarkable.

An experimental example 18 is the result when the control of the pulse density 17 based on the induced voltage control device 8 of the present invention was carried out under the conditions described below.

The control time block 15*c* of the pulse density 17 was specified as the 10 revolutions of the bunch 3. Consequently, the equivalent acceleration voltage amplitude pattern in the nonlinear excitation region 15*a* can be divided into 10 steps. Each fixed length of time given by this division is 10 ms. This means that the abovementioned acceleration voltage amplitude pattern is the same as the equivalent acceleration voltage amplitude pattern 9*e* shown in FIG. 6(A).

For the required variable delay time pattern, there was used the required variable delay time pattern 16*a* corresponding to the ideal variable delay time pattern 16 shown in FIG. 7(A). The control time block 16*b* at that time is 0.1 microseconds.

A comparative example (1) 18*a* is the result of carrying out acceleration using the rf acceleration voltage 21*a* only, without applying the acceleration voltage 9*a* by the induction cell for acceleration 6. The result shown in this comparative example (1) 18*a* denotes the ideal acceleration voltage amplitude pattern 9*c* in the experimental region of the nonlinear excitation region 15*a*. The maximum acceleration voltage amplitude 9*i* in the nonlinear excitation region 15*a* becomes equal to the acceleration voltage amplitude 9*j* in the linear excitation region 15*b*, and is 4.7 kV in this case. Therefore, the value of the reset voltage 9*b* is −4.7 kV.

A comparative example (2) 18*b* is the result of applying the constant acceleration voltage 9*a* for each revolution of the bunch 3 without controlling the pulse density 17.

Note that if the acceleration voltage 9*a* applied by the induction cell for acceleration 6 is completely synchronized with the magnetic excitation pattern 15, the graph is plotted horizontally across the position "0" of the axis of ordinate.

Now, the experimental results shown in FIG. 10 will be described. In a experimental example 18, the rf acceleration voltage amplitude 21*b* applied by the rf cavity 4 to the bunch center 3*c* was almost 0 kV.

Accordingly, it was confirmed from the result of the experimental example 18 that a proton beam can be accelerated also in the nonlinear excitation region 15*a* with the induced voltage for acceleration 9 by modulating the pulse density 17 using the induced voltage control device 8 of the present invention.

On the other hand, in the comparative example (2) 18*b*, an acceleration voltage 9*a* of 4.7 kV was applied for each passage of the bunch 3 without controlling the pulse density 17 using the induced voltage control device 8 of the present invention (control based on the required variable delay time pattern 16*a* was carried out as a matter of course though the voltage sequence was not followed by the equivalent acceleration voltage amplitude pattern 9*e*).

Thus, the phase of the radio-frequency wave 4*a* was shifted in the decelerating direction 4*g* immediately after injection (14*a*) in the comparative example (2) 18*b*, so that a negative voltage 4*e* of approximately −4.7 kV was applied in order to reduce energy that the bunch 3 received from the acceleration voltage 9*a* excessively applied by the induction cell for acceleration 6 and thereby synchronize the acceleration voltage 9*a* with the magnetic excitation pattern 15.

In addition, since the ideal acceleration voltage amplitude pattern 9*c* for synchronization with the magnetic excitation pattern 15 also approached the 4.7 kV acceleration voltage 9*a* applied by the induction cell for acceleration 6 along with the lapse of the acceleration time 14*c*, the negative voltage 4*e* of the rf acceleration voltage 21*a* applied by the rf cavity 4 decreased and the rf acceleration voltage amplitude 21*b* applied by the rf cavity 4 eventually reached almost 0 kV.

Accordingly, it was confirmed from the result of the comparative example (2) 18*b* that a proton beam cannot be accelerated in the nonlinear excitation region 15*a* using the constant induced voltage for acceleration 9 alone unless the pulse density 17 was modulated.

As heretofore described, it was confirmed from the results shown in FIG. 10 that a proton beam can be accelerated also in the nonlinear excitation region 15*a* with the induced voltage for acceleration 9 by modulating the pulse density 17 using the induced voltage control device 8 of the present invention.

In addition, the revolution time period 24 of the bunch 3 was gradually shortened along with the lapse of the acceleration time 14*c* and, thus, it was also confirmed from the experimental results that the generation timing of the acceleration voltage 9*a* was able to be controlled by the required variable delay time pattern 16*a* in synchronization with the revolution time period 24 being gradually shortened.

Accordingly, it can be said that by previously providing the required variable delay time pattern 16*a* to the variable delay time calculator 13*a* of the induced voltage control device 8 in accordance with the present invention, it was possible to control the pulse density 17 and provide the proton beam with the equivalent acceleration voltage amplitude pattern 9*e* corresponding to the ideal acceleration voltage amplitude pattern 9*c* capable of being calculated according to the magnetic excitation pattern 15 in the nonlinear excitation region 15*a*.

That is, it can be said that since the proton beam can be accelerated, an arbitrary charged particle can be accelerated to an arbitrary energy level even if the type of charged particle or the magnetic excitation pattern 15 is changed, by providing the variable delay time calculator 13*a* with the required variable delay time pattern thus changed and providing the on/off selector 13*e* with the equivalent acceleration voltage amplitude pattern 9*e* corresponding to the ideal acceleration voltage amplitude pattern 9*c* based on the magnetic excitation pattern 15.

FIG. 11 is a graphical view wherein the experimental results in FIG. 10 were processed. Since it was not possible to fully confirm a change in the acceleration voltage amplitude 9*i* in the nonlinear region divided into 10 steps in FIG. 10, a graph was created by processing the results obtained as shown in FIG. 10 using the method described hereunder. Note that the meanings of the symbols are the same as those of FIG. 10.

A verification (1) 18*c* is a graph representing the result of subtracting the rf acceleration voltage amplitude 21*b* in the experimental example 18 from the rf acceleration voltage amplitude 21*b* in the comparative example (1) 18*a*.

On the other hand, a verification (2) 18*d* is a graph representing the result of subtracting the rf acceleration voltage amplitude 21*b* in the experimental example 18 from the rf acceleration voltage amplitude 21*b* in the comparative example (2) 18*b*.

By the processing noted above, it is possible to remove effects of noise in a monitoring process. Note that the position where v=0 corresponds to the result when the control of the pulse density 17 is carried out.

From the results shown in FIG. 11, it is possible to confirm a rise in the acceleration voltage amplitude 9*i* for each 10 ms corresponding to the equivalent acceleration voltage amplitude pattern 9*e* in the nonlinear excitation region 15*a* (from 0 to 100 ms), as the result of the pulse density 17 being controlled by defining every 10 revolutions of the bunch 3 as the control time block 15*c*.

FIG. 12 is a graphical drawing of the correlation between a fast cycle and an equivalent acceleration voltage. The method of synchrotron operation includes a slow-cycling method and a fast-cycling method. Both methods have magnetic excitation patterns, i.e., the magnetic excitation patterns 15 and 19, which vary with time in the course of accelerating a charged particle beam.

As described above, an arbitrary charged particle can be accelerated to an arbitrary energy level in synchronization with the slow-cycling magnetic excitation pattern 15, using the constant acceleration voltage 9*a*. According to the induced voltage control device 8 and its control method of the present invention, it is possible for the induced voltage for acceleration 9 to synchronize with even the fast-cycling magnetic excitation pattern 19.

Fast cycling refers to acceleration based on the fast-cycling magnetic excitation pattern 19 wherein one period 20, which is a time from when a charged particle is injected (14*a*) from a preinjector, accelerated and emitted (14*b*) to when the next injection (14*a*) is ready, is in the order of several tens of milliseconds.

The first axis of ordinate "B" represents the magnetic flux density of a synchrotron making use of induction cells and the second axis of ordinate "v" represents an induced voltage value. The first axis of abscissa "t" represents a temporal change in the magnetic excitation pattern 19 and the second axis of abscissa "t(v)" represents the generation timing of the induced voltage for acceleration 9, wherein both the temporal change and the generation timing are based on the time when a charged particle beam is injected (14*a*) into the synchrotron making use of induction cells.

The fast-cycling magnetic excitation pattern 19 causes the amplitude thereof to be plotted as a sinusoidal curve and the value of the induced voltage for acceleration 9 synchronized with this magnetic excitation pattern 19 is calculated according to Equation (7) mentioned earlier in the same way as evaluated from the slow-cycling magnetic excitation pattern 15.

The acceleration voltage amplitude 9*k* calculated by Equation (7) is the ideal acceleration voltage amplitude pattern 19*a*. Since the ideal acceleration voltage amplitude pattern 19*a* is proportional to the temporal differentiation of a magnetic field change at a given operating point in time of the magnetic excitation pattern 19, it is theoretically possible to determine a change in the acceleration voltage 9*k* of cosine-curve type.

As a matter of course, there must be generated the reset voltage 9*b* equivalent to the ideal reset voltage value pattern 19*c* opposite in direction to the ideal acceleration voltage amplitude pattern 19*a* in a time duration in which any charged particle beam does not exist.

In order to apply the acceleration voltage 9*a* in synchronization with this magnetic excitation pattern 19, it should be noted that the required acceleration voltage amplitude 9*k* increases or decreases drastically with time, compared with the slow-cycling magnetic excitation pattern 15.

However, according to the induced voltage control device 8 and its control method of the present invention, it is possible to control the acceleration voltage 9*a* at fully high speeds and accuracy levels using the equivalent acceleration voltage amplitude pattern 19*b*, without any problems in synchronizing with the fast-cycling magnetic excitation pattern 19 involving a complicated change in the acceleration voltage amplitude 9*k*.

Consequently, it can be said that it is possible to accelerate an arbitrary charged particle to an arbitrary energy level in every magnetic excitation pattern using the induced voltage control device 8 and its control method of the present invention.

Next, the charged particle beam orbit control device and its control method of the present invention will be described in detail according to the accompanying drawings. FIG. 15 is a schematic drawing of a synchrotron making use of an induction cell incorporating the charged particle beam orbit control device 106 of the present invention.

A synchrotron 101 making use of the charged particle beam orbit control device 106 of the present invention includes a vacuum chamber for covering a design orbit 102 for a charged particle beam accelerated to a given energy level and injected by a preinjector to circulate in; a focusing quadrupole electromagnet or bending electromagnet 104 or the like for ensuring strong focusing to an orbiting bunch 103; an induction cell for longitudinal confinement for applying a barrier voltage 122 to the bunch 103; an induction accelerating device for acceleration 105 for applying an induced voltage for acceleration 108 to the bunch 103; a bunch monitor 109 for sensing the passage of the bunch 103; a velocity monitor 110 for measuring the accelerated velocity of the bunch 103 in real time; and a beam position monitor 111 for detecting to what extent a charged particle beam deviates from the design orbit 102 toward the inside 102*b* or the outside 102*c* of a horizontal direction.

The bending electromagnet 104 is a device used to maintain the orbit of a charged particle beam on a closed curve. The bending electromagnet 104 has a structure in which a metallic conductor is wound in a coiled form around an iron core or an air core, whereby a magnetic flux density 103*a* perpendicular to the longitudinal axis of the charged particle beam is generated by flowing an electric current through the conductor. Since the magnetic flux density 103*a* present in the bending electromagnet 104 is proportional to the current flowing through the conductor, it is possible to determine the magnetic flux density 103*a* by evaluating the coefficient of this proportionality in advance and measuring and converting the amount of the current.

The bunch monitor 109 is a device for detecting the passage of the bunch 103 and outputting pulses. The bunch monitor 109 converts part of electromagnetic energy produced when a charged particle beam passes through a conductor or a magnetic material determined on the design orbit 102 into voltage or current pulses. The method of conversion includes utilizing a wall current induced in the vacuum chamber when the bunch 103 passes through the bunch monitor 109 and utilizing an induced voltage produced when the bunch 103 passes through a device in a form wherein a coil is wound around a magnetic material core.

The velocity monitor 110 is a device for generating signal with an analog voltage amplitude, an analog current amplitude or a digital numeric value appropriate for the revolution speed 103*c* of the bunch 103. As the beam velocity monitor 110, there are one having an analog configuration like the bunch monitor 109 in which voltage pulses or current pulses generated as a charged particle beam passes through the beam velocity monitor 110 are stored in a capacitor and converted into voltage values and one having a digital configuration in which the number of voltage pulses themselves is counted using a digital circuit.

The beam position monitor 111 is a device for outputting a voltage value proportional to a deviation from the design orbit 102 of the bunch 103. The beam position monitor 111 is comprised of, for example, two conductors having slits diagonal to an longitudinal axis direction of ions 103*d* and utilizes the fact that the time at which the two conductors sense the charged particle beam differs depending on the position the charged particle beam has passed through and, as a result, a difference arises between the voltage values induced in the two conductors.

For example, if the bunch 103 passes through the center of the beam position monitor 111, then the output voltage value obtained by finding the residual error between the voltages induced in the two conductors is 0 since the induced voltages are equal to each other. If the bunch 103 passes through the outside 102*c* of the design orbit 102, then the beam position monitor 111 outputs a positive voltage value proportional to a deviation from the center of the design orbit 102. Likewise, if the bunch 103 passes through the inside 102*b* of the design orbit 102, then the beam position monitor 111 outputs a negative voltage value.

Consequently, for the bending electromagnet 104, the bunch monitor 109, the beam velocity monitor 110 and the beam position monitor 111, it is possible to utilize those used in acceleration by an rf synchrotron.

The induction accelerating device for acceleration 105, which is connected to the vacuum chamber containing the design orbit 102 for the bunch 3 to circulate in, includes an induction cell for acceleration 107 for applying an induced voltage for acceleration 108 to accelerate the bunch 103 in the longitudinal axis direction of ions 103*d*, a high-speed switching electric power supply 105*a* for providing a pulse voltage 105*c* to the induction accelerating cell for acceleration 107, a DC power supply 105*b* for supplying power to the switching electric power supply 105*a*, and a charged particle beam orbit control device 106 for feedback-controlling the on/off actions of the switching electric power supply 105*a* to correct deviations from the design orbit 102 of a charged particle beam.

The charged particle beam orbit control device 106 of the present invention is comprised of a digital signal processor 112 for calculating the generation timing of the induced voltage for acceleration 108 in response to said electric or optical signals each of which contain information on the charged particle beam detected in real time by said various detectors provided on the design orbit 102 and a pattern generator 113 for generating a gate signal pattern 113*a* for driving the on/off states of the switching electric power supply 105*a* according to a master gate signal 112*a* output from the digital signal processor 112.

The master gate signal 112*a* is a rectangular voltage pulse output from the digital signal processor 112, like the passage signal 109*a*, the moment the variable delay time (FIG. 17) for synchronizing the timings of the charged particle beam and the induced voltage for acceleration 108 has elapsed. The pattern generator 113 comes into operation when it recognizes the rising edge of a pulse which is the master gate signal 112*a*.

The pattern generator 113 is a device for converting the master gate signal 112*a* into combinations of on/off states of the current paths of the switching electric power supply 105*a*.

The switching electric power supply 105*a* in general has a plurality of current paths and generates positive and negative voltages at a load (induction cell for acceleration 107 here) by adjusting a current passing through each of these paths and controlling the direction of the current (FIG. 23).

The gate signal pattern 113*a* refers to a pattern for modulating the induced voltage for acceleration 108 of the induction cell for acceleration 107. This pattern is formed of signals for determining the charging timing and the generation timing of the acceleration voltage 108*a* when applying the acceleration voltage 108*a* and the charging timing and the generation timing of the reset voltage 108*b* when applying the reset voltage 108*b* and for determining a quiescent time between the acceleration voltage 108*a* and the reset voltage 108*b*. It is therefore possible to adjust the gate signal pattern 113*a* in conformity with the length of the bunch 103 to be accelerated.

Specific signals used to control the generation timing of the induced voltage for acceleration 108 include a cycle signal 104*a* output from the bending electromagnet 104 (through the control device of a circular accelerator) at the moment a charged particle beam is injected from the preinjector, a beam-bending magnetic flux density signal 104*b* which is a real-time monitored magnetic excitation pattern, a passage signal 109*a* which is information from the bunch monitor 109 about the passage of a charged particle beam through the bunch monitor 109, a velocity signal 110*a* which is the revolution velocity 103*c* of the bunch 103, and a beam position signal 111*a* which is information from the beam position monitor 111 showing to what extent an orbiting charged particle beam has deviated from the design orbit 102.

FIG. 16 is a functional configuration diagram of a digital signal processor. A digital signal processor 112 is comprised of a variable delay time calculator 114, a variable delay time generator 115, an acceleration voltage calculator 116, and a master gate signal output module 117.

The variable delay time calculator 114 is a device for determining a variable delay time 118. The variable delay time calculator 114 is provided with information on the type of charged particle and definitional equations for the variable delay time 118 calculated according to a later-described magnetic excitation pattern (FIG. 19).

Information on the type of charged particle refers to the mass and charge number of a charged particle to be accelerated. As described above, energy that a charged particle receives from the induced voltage for acceleration 108 is proportional to the charge number and the revolution velocity 103*c* of the charged particle thus gained is dependent on the mass thereof. Since a change in the variable delay time 118 depends on the revolution velocity 103*c* of the charged particle, these pieces of information are provided in advance.

The variable delay time 118 can be calculated beforehand and provided as a required variable delay time pattern (FIG. 18) if the type of charged particle and a magnetic excitation pattern are already fixed.

However, if the charged particle beam deviates from the design orbit 102 toward the inside 102*b* or the outside 102*c* thereof in a case where the variable delay time is previously calculated, it is no longer possible to correct the orbit of the charged particle beam. Hence, if the variable delay time 118 is previously calculated, it is necessary to correct the acceleration voltage 108*a* using a later-described acceleration voltage calculator 116.

In addition, in a case where the variable delay time 118 is calculated in real time for each revolution of the bunch 103, it is only necessary to calculate the variable delay time 118 for each revolution of the bunch 103, as in the case where the variable delay time 118 is previously calculated by letting the variable delay time calculator 114 receive the magnetic flux density 103*a* at that time as the beam-bending magnetic flux density signal 104*b* from the bending electromagnet 104 (through the control device of a circular accelerator) composing the synchrotron 101 and provide information on the type of charged particle.

Furthermore, if the velocity signal 110*a*, which is the revolution velocity 103*c* of the charged particle beam, is input in real time to the variable delay time calculator 114 using the beam velocity monitor 110 for measuring the revolution velocity 103*c* of a charged particle beam, it is possible to calculate the variable delay time 118 in real time, without providing information on the type of charged particle according to Equations (6) and (7) to be discussed later.

By calculating the variable delay time 118 in real time, it is possible to correct the generation timing of the acceleration voltage 108*a* and thereby correct the orbit of the charged particle beam even if the acceleration voltage amplitude 108*i* deviates from a predetermined output voltage of a DC power supply 105*b*, a bank capacitor 124 or the like composing the induction accelerating device for acceleration 105 or even if a sudden fluctuation occurs in the revolution velocity 103*c* of the bunch 103 due to some sort of disturbance. This is referred to as orbit control of the charged particle beam.

That is, by carrying out the orbit feedback control of a charged particle beam, it is possible to accurately apply the acceleration voltage 108*a* to the bunch 103. As a result, it is possible to more reliably accelerate the charged particle beam. This means that an arbitrary charged particle can be accelerated to an arbitrary energy level using the induction cell.

The variable delay time 118 provided as described above is output to a variable delay time generator 115 as a variable delay time signal 114*a* which is digital data.

Note that a cycle signal 104*a* is input from the bending electromagnet 104 (through the control device of a circular accelerator) to the variable delay time calculator 114. The cycle signal 104*a* is a pulse voltage generated from the bending electromagnet 104 (through the control device of a circular accelerator) when the charged particle beam is injected into the synchrotron 101 and is also information on the start of acceleration. Under normal conditions, the synchrotron 101 repeats the injection, acceleration and extraction of a charged particle beam over and over again.

Accordingly, if the variable delay time 118 has been started previously, the variable delay time calculator 114 outputs the variable delay time signal 114*a* to the variable delay time generator 115, upon receipt of the cycle signal 104*a* informing the start of acceleration, according to the variable delay time 118 calculated in advance.

In response to the passage signal 109*a* from the bunch monitor 109 and the variable delay time signal 114*a* from the variable delay time calculator 114, the variable delay time generator 115 calculates the timing to generate the induced voltage for acceleration 108 for the next revolution of the bunch 103 for each bunch 103 having passed through the bunch monitor 109 and outputs a pulse 115*a* which is information on the variable delay time 118 to an acceleration voltage calculator 116.

The variable delay time generator 115 is a counter based on a given frequency and is a device for retaining a passage signal 109*a* within the digital signal processor 112 for a given time period and then letting the signal pass.

For example, if the counter in the generator operates at frequency of 1 kHz, then the numeric value 1000 thereof is equivalent to one second. This means that it is possible to control the length of the variable delay time 118 by inputting a numeric value corresponding to the variable delay time 118 to the variable delay time generator 115.

Specifically, the variable delay time generator 115 performs control, so as to stop the generation of the master gate signal 112*a* for a time period corresponding to the variable delay time 118 according to the variable delay time signal 114*a* which is a numeric value corresponding to the variable delay time 118 output by the variable delay time calculator 114. As a result, it is possible to synchronize the generation timing of the acceleration voltage 108*a* with the time at which the bunch 103 has reached the induction cell for acceleration 107.

For example, if the variable delay time signal 114*a* having a numeric value of 150 is output by the variable delay time calculator 114 to the variable delay time generator 115 which is a 1 kHz counter mentioned above, then the variable delay time generator 115 performs control, so as to delay the generation of the pulse 115*a* for a period of 0.15 seconds.

Note here that the passage signal 109*a* refers to a pulse generated in synchronization with the moment the bunch 103 passes through the bunch monitor 109. The pulse includes a voltage-type pulse, a current-type pulse and an optical-type pulse having an appropriate level of signal amplitude, depending on the type of medium or cable that transfers the pulse.

The passage signal 109*a* is used to provide the passage timing of a charged particle beam as time information to the digital signal processor 112. The position of the charged particle beam in its longitudinal axis direction of ions 103*d* on the design orbit 102 is determined by the rising edge of a pulse generated due to the passage of the charged particle beam. In other words, the passage signal 109*a* is a reference for the start of the variable delay time 118.

The acceleration voltage calculator 116 is a device for deciding whether to generate (on) or not generate (off) the induced voltage for acceleration 108.

For example, if in a case where the acceleration voltage amplitude 108*i* required at a given moment is 0.5 kV, "1" and "0" are defined as "1=Pulse 116*a* is generated; 0=Pulse 116*a* is not generated" and a pattern of 0s and 1s as to whether or not the acceleration voltage 108*a* is applied for each revolution of the bunch 103 using the acceleration voltage 108*a* having a fixed value of 1.0 kV as [1, 0, . . . , 0, 1] (five 1s and five 0s) while the bunch 103 circulates ten times, then an average acceleration voltage amplitude (FIG. 20) that the bunch 103 has received during the ten revolutions is equivalent to 0.5 kV. In this way, the acceleration voltage calculator 116 numerically controls the acceleration voltage 108*a*.

The acceleration voltage amplitude 108*i* required at a given operating point in time can be given as an equivalent acceleration voltage amplitude pattern (FIG. 19) corresponding to an ideal acceleration voltage amplitude pattern (FIG. 19) calculated from a magnetic excitation pattern in advance if the type of charged particle and the magnetic excitation pattern are previously fixed.

The equivalent acceleration voltage amplitude pattern refers to a data set wherein, for example, the acceleration voltage amplitude 108*i* is set to 0 kV for 0.1 seconds from the start of acceleration, to 0.1 kV for a period between 0.1 to 0.2 seconds, to 0.2 kV for a period between 0.2 to 0.3 seconds, . . . , and to 1.0 kV for a period between 0.9 to 1.0 second, in a case where the acceleration voltage amplitude 108*i* is varied from 0 V to 1 kV in 1 second and controlled at a time interval of 0.1 seconds.

If a control time block is "n" times revolutions and the acceleration voltage 108*a* is provided to a charged particle beam "m" times during that period, then an equivalent acceleration voltage amplitude that the charged particle beam receives within the control time block is "m/n" times the acceleration voltage 108*i* output by the induction cell for acceleration 107.

Note that obviously, "m" is always smaller than "n". This condition holds true when the control time block is sufficiently shorter than the rate at which the orbit of the charged particle beam changes. This control time block can be selected arbitrarily within a range between the lower limit at which voltage accuracy decreases and the control time block can no longer provide an appropriate voltage as the result of being shortened and the upper limit at which the control time block can no longer react to a change in the orbit as the result of being lengthened.

For example, if the control time block is 10 revolutions and the acceleration voltage amplitude is "$V_0$", then it is possible to control the acceleration voltage amplitude in 10 steps in increments of $0.1 \cdot V_0$. If the control time block is 20 revolutions of the bunch 103, then it is possible to control the equivalent acceleration voltage amplitude pattern in 20 steps in increments of $0.05 \cdot V_0$.

However, since the acceleration voltage 108*a* is not constant as described above or in order to correct the orbit if the charged particle beam deviates from the design orbit 102 due to a sudden problem during acceleration, it is necessary to stop the generation of the acceleration voltage 108*a*, i.e., change the pulse density (FIG. 20) (FIG. 21).

In order to correct the orbit of a charged particle beam using the acceleration voltage calculator 116, it is necessary to provide the acceleration voltage calculator 116 with information in advance, as basic data for correction, as to what extent the orbit of the charged particle beam deviates from the design orbit 102 toward the outside 102*c* thereof when a certain level of the acceleration voltage amplitude 108*i* is given to the charged particle beam.

Next, the acceleration voltage calculator 116 receives information, as a beam position signal 111*a* from the beam position monitor 111 on the design orbit 102, as to what extent the charged particle beam deviates from the design orbit 102 at a given operating point in time during acceleration, and performs in real time calculations for modulating the orbit of the charged particle beam for each revolution of the bunch 103.

The acceleration voltage per revolution necessary to correct the orbit of the charged particle beam for a control time block of "n" revolutions is determined approximately by Equation (1) shown below, assuming that the current orbit radius is "ρ", the time differentiation thereof is "ρ'", the magnetic flux density 103*a* is "B", the time differentiation thereof is "B'", and the overall length of the circular accelerator is "$C_0$".

$$V=C_0\times(B'\times\rho+B\times\rho') \quad \text{Equation (1)}$$

This V is an average acceleration voltage amplitude applied in the control time block by the induction cell.

$$V=(m/n)V_{acc}(m<n) \quad \text{Equation (2)}$$

where "$V_{acc}$" is an ideal acceleration voltage amplitude (FIG. 21) determined by Equation (12) to be discussed later.

"ρ'" and "B'" are respectively determined by Equations (3) and (4) shown below, assuming that the revolution time period per revolution of the bunch 103 is "t", the orbit radius within the control time block is "Δρ", a change in the magnetic flux density 103*a* within the control time block is "ΔB", and the amount given by summating "t" as many times as the number of revolutions "n" is "Σt".

$$\rho'=\Delta\rho/(\Sigma t) \quad \text{Equation (3)}$$

$$B'=\Delta B/(\Sigma t) \quad \text{Equation (4)}$$

Note that "ρ'" and "B'" are calculated by the acceleration voltage calculator 116 if the induced voltage for acceleration 108 is controlled in real time.

The revolution time period "t" of the bunch 103 per revolution is determined by Equation (5) shown below, assuming that the revolution velocity 103*c* obtained from the beam velocity monitor 110 or the like is "v" and the overall length of the circular accelerator is "$C_0$".

$$t=C_0/v \quad \text{Equation (5)}$$

This "t" takes a value different for each revolution of the bunch 103.

An acceleration voltage amplitude is calculated from these processes and the required acceleration voltage 108*a* is applied according to the result of calculation thus performed or the application of the acceleration voltage 108*a* corresponding to an excessive acceleration voltage amplitude is stopped.

Stopping the application of the acceleration voltage 108*a* refers to not generating the acceleration voltage 108*a* scheduled for the next time.

The reason for the orbit of the charged particle beam deviating from the design orbit 102 toward the outside 102*c* thereof is that the acceleration voltage amplitude 108*i* applied to the charged particle beam is excessively larger than the acceleration voltage amplitude 108*i* required at that moment and, therefore, cannot be synchronized with the magnetic excitation pattern of a bending electromagnet 4 (FIG. 24).

Accordingly, the excessive acceleration voltage amplitude 108*i* is calculated, either in advance or in real time, from the equivalent acceleration voltage amplitude pattern (FIG. 19) calculated from the magnetic excitation pattern (FIG. 19) and orbital deviations provided by the beam position signal 111*a*, to correct the pulse density by subtracting the excessive acceleration voltage amplitude 108*i* from the given equivalent acceleration voltage amplitude in advance (FIG. 21).

The correction of the pulse density is possible by stopping the application of the acceleration voltage 108*a* corresponding to the excessive acceleration voltage amplitude 108*i* according to the given acceleration voltage amplitude 108*i* required in advance at that moment and the pulse density in the control time block.

Note that it is also possible to correct the orbit of the charged particle beam by, for example, previously providing pulse densities and the like defined as "correct drastically," "correct gradually," and the like, to correct the orbit of the charged particle beam even if the beam only slightly deviates from the design orbit 102 toward the outside 102*c* thereof, in addition to the previously given equivalent acceleration voltage amplitude pattern, and then selecting a necessary pulse density as appropriate.

Also note that as a matter of course it is possible to expand the right-side member of Equation (1) to an arbitrary equation represented by a numerical calculating formula determined from modern control theory or the like.

By employing such a control method as described above, correct orbit control is possible also for a change in the orbit of the charged particle beam that greatly differs depending on the size of the circular accelerator.

Note that a magnetic excitation pattern or an equivalent acceleration voltage amplitude pattern, basic data for correction, and a pulse density for correction can be changed as rewritable data, according to the type of charged particle and the magnetic excitation pattern selected.

By simply rewriting these items of data, the charged particle beam orbit control device 106 of the present invention can also be utilized to accelerate arbitrary charged particles to an arbitrary energy level.

In order to control the orbit of the charged particle beam, however, it is necessary to calculate in real time the acceleration voltage amplitude 108*i* required at a given operating point in time for each revolution of the bunch 103. When calculating, in real time, the acceleration voltage amplitude 108*i* required at a given operating point in time, it is only necessary to perform calculations using the same equations as those used when previously calculating the acceleration voltage amplitude 108*i*, by receiving the magnetic flux density 103*a* at that time as the beam-bending magnetic flux density signal 104*b* from the bending electromagnet 104 composing the synchrotron 101 making use of induction cells (through the control device of a circular accelerator).

By calculating in real time the acceleration voltage amplitude 108*i* required at a given operating point in time, it is possible to correct the generation timing of the acceleration voltage 108*a* and the acceleration voltage amplitude 108*i* and accurately apply the acceleration voltage 108*a* to the charged particle beam even if the acceleration voltage amplitude 108*i* deviates from a predetermined output voltage of a DC power supply 105*b*, a bank capacitor 124 or the like composing the induction accelerating device for acceleration 105. As a result, it is possible to even more reliably accelerate the charged particle beam.

Note that by feeding back an induced voltage signal 126*a* which is an induced voltage value available at an induced voltage monitor 126 which is the ammeter shown in FIG. 23 to either the variable delay time calculator 114 of a digital signal processor 112 or the acceleration voltage calculator 116 or to both, it is also possible calculate the equivalent acceleration voltage amplitude 108*i* corresponding to the variable delay time 118 and the ideal acceleration voltage amplitude 108*i*.

In addition, it is possible to more precisely monitor the orbital deviation of a charged particle beam by concurrently using the beam position monitor 111 and the induced voltage monitor 126. Consequently, it is possible to more precisely control the orbit of the charged particle beam.

A pulse 116*a* for controlling the generation of the master gate signal 112*a* determined according to the acceleration voltage amplitude 108*i* required at a given operating point in time during the acceleration of the charged particle beam, which is given as described above, is output to a master gate signal output module 117.

Accordingly, the acceleration voltage calculator 116 has the function of intermittently outputting the pulse 116*a*, in order to measure the acceleration voltage amplitude 108*i* necessary to correct the orbit of the charged particle beam in real time and correct the pulse density based on the equivalent acceleration voltage amplitude pattern (FIG. 20) provided to the acceleration voltage calculator 116 in advance, rather than simply outputting the acceleration voltage 108*a* every time for each revolution of the bunch 103 using the passage signal 109*a* sent from the bunch monitor 109.

The master gate signal output module 117 is a device for generating a pulse, i.e., the master gate signal 112*a*, for transferring the pulse 116*a*, which has passed through the digital signal processor 112 and contains information on both the variable delay time 118 and the on/off states of the induced voltage for acceleration 108, to the pattern generator 113.

The rising edge of the pulse, which is the master gate signal 112*a* output from the master gate signal output module 117, is used as the generation timing of the induced voltage for acceleration 108. In addition, the master gate signal output module 117 also plays the role of converting the pulse 116*a* output from the acceleration voltage calculator 116 to a voltage-type pulse, a current-type pulse or an optical-type pulse having an appropriate level of signal amplitude, depending on the type of medium or cable that transfers the pulse to the pattern generator 113.

The digital signal processor 112 configured as described above outputs the master gate signal 112*a*, on which the gate signal pattern 113*a* for controlling the drive of the switching electric power supply 105*a* is based, to the pattern generator 113 with reference to the passage signal 109*a* from the bunch monitor 109 on the design orbit 102 for a charged particle beam to circulate in. It is therefore can be said that the digital signal processor 112 digitally controls the on/off states of the induced voltage for acceleration 108.

It is now possible to apply the acceleration voltage 108*a* synchronized with the revolution frequency of a charged particle beam according to the magnetic excitation pattern of the synchrotron 101 without having to change any settings, by calculating the variable delay time 118 and the required acceleration voltage amplitude 108*i* in real time.

FIG. 17 explains a variable delay time for ensuring timing between the orbiting of a charged particle beam and the generation of the acceleration voltage 108*a*. A time period from when the passage signal 109*a* from the bunch monitor 109 is input to the variable delay time generator 115 to when the master gate signal 112*a* is output is the variable delay time 118.

Controlling this variable delay time 118 is equivalent to controlling the generation timing of the acceleration voltage 108*a*. This is because the time interval from the generation of the master gate signal 112*a* to the generation of the acceleration voltage 108*a* is always a fixed time period.

In order to accelerate the charged particle beam using the induced voltage for acceleration 108, the acceleration voltage 108*a* must be applied in synchronization with the time at which the bunch 103 reaches the induction cell for acceleration 107.

Furthermore, the revolution frequency at which the charged particle beam being accelerated circulates on the design orbit 102 (revolution frequency: $f_{REV}$) changes through acceleration. For example, when accelerating a proton beam in the 12 GeVPS of KEK, the revolution frequency of the proton beam varies from 667 kHz to 882 kHz.

Consequently, in order to accelerate the charged particle beam just as intended, the acceleration voltage 108*a* must be applied in synchronization with the circulating time 3*e* of the bunch 103 that changes with the acceleration time and the reset voltage 108*b* must be generated within a time duration during which the bunch 103 does not exist in the induction cell for acceleration 107.

Furthermore, there is the need to route signal cables for connecting between respective devices composing a circular accelerator over prolonged distances since the circular accelerator including a synchrotron 101 making use of induction cells is determined in commodious premises. In addition, the speed of a signal propagating through a signal line has a certain finite value.

Therefore, if the configuration of the circular accelerator is altered, there is no guarantee that the transmission time at which a signal passes through each device is the same as that before the configuration is altered. For this reason, in the case of a circular accelerator including a synchrotron 101 making use of induction cells, the charging timing must be re-set each time an alteration is made to the components of the accelerator.

Hence, in order to solve the aforementioned problems, it was decided to adjust the time period from when the passage signal 109*a* of the bunch monitor 109 was generated to when the acceleration voltage 108*a* was applied, using the digital signal processor 112. Specifically, it was decided to control the variable delay time 118, within the digital signal processor 112, for the time period from when the passage signal 109*a* is received from the bunch monitor 109 to when the master gate signal 112*a* is generated.

Even under the above-described conditions, the acceleration voltage 108*a* must be applied in synchronization with the timing at which the charged particle beam passes through the induction cell for acceleration 107. By using the variable delay time generator 115, it is possible to apply the acceleration voltage 108*a* in synchronization with the passage of the bunch 103.

"Δt", which is the variable delay time 118, can be evaluated by Equation (6) shown below, assuming that a circulating time 3*e* taken by the bunch 103 to reach the induction cell for acceleration 107 from the bunch monitor 109 placed in any position on the design orbit 102 is "$t_0$", a transmission time 109*b* taken by the passage signal 109*a* to travel from the bunch monitor 109 to the digital signal processor 112 is "$t_1$", and a transmission time 109*c* required until the acceleration voltage 108*a* is applied by the induction cell for acceleration 107 according to the master gate signal 112*a* output from the digital signal processor 112 is "$t_2$".

$$\Delta t = t_0 - (t_1 + t_2) \qquad \text{Equation (6)}$$

For example, assuming that the circulating time 3*e* of the bunch 103 at a certain acceleration time is 1 μs, the transmission time 109*b* of the passage signal 109*a* is 0.2 μs, and the transmission time 109*c* taken from when the master gate signal 112*a* is generated to when the acceleration voltage 108*a* is generated is 0.3 μs, then the variable delay time 118 is 0.5 μs.

"Δt" varies with the lapse of the acceleration time. This is because "$t_0$" varies with the lapse of the acceleration time as the result of the charged particle beam being accelerated.

Consequently, in order to apply the acceleration voltage 108*a* to the charged particle beam, "Δt" needs to be calculated for each revolution of the bunch 103. On the other hand, "$t_1$" and "$t_2$" are set to fixed values once respective components composing the synchrotron 101 making use of induction cells are determined.

"$t_0$" can be evaluated from the revolution frequency ($f_{REV}$(t)) of the charged particle beam and a length (L) from the bunch monitor 109 to the induction cell for acceleration 107 of the design orbit 102 for the charged particle beam to circulate in. Alternatively, "$t_0$" may be actually measured.

Here, there is shown a method of evaluating "$t_0$" from the revolution frequency ($f_{REV}$(t)) of the charged particle beam. Assuming that the overall length of the design orbit 102 for the charged particle beam to circulate in is "$C_0$", then "$t_0$" can be calculated in real time by Equation (7) shown below.

$$t_0=L/(f_{REV}(t)\cdot C_0)\ [\text{sec}] \qquad \text{Equation (7)}$$

$f_{REV}$(t) can be evaluated by Equation (8) shown below.

$$f_{REV}(t)=\beta(t)\cdot c/C_0\ [\text{Hz}] \qquad \text{Equation (8)}$$

where β(t) is a relativistic particle velocity and "c" is a light speed ($c=2.998\times10^8$ [m/s]). "β(t)" can be evaluated by Equation (9) shown below.

$$\beta(t)=\sqrt{(1-(1/(\gamma(t)^2))}[\text{dimensionless}] \qquad \text{Equation (9)}$$

where "γ(t)" is a relativistic coefficient. "γ(t)" can be evaluated by Equation (10) shown below.

$$\gamma(t)=1+\Delta T(t)/E_0[\text{dimensionless}] \qquad \text{Equation (10)}$$

where "ΔT(t)" is an energy increment given by the acceleration voltage 108*a* and E0 is the energy corresponds to the static mass of the charged particle. "ΔT(t)" can be evaluated by Equation (11) shown below.

$$\Delta T(t)=\rho\cdot C_0\cdot e\cdot\Delta B(t)\ [\text{eV}] \qquad \text{Equation (11)}$$

where "e" is the electric charge of the charged particle has and "ΔB(t)" is an increment in the magnetic flux density 103*a* from the start of acceleration.

The energy corresponds to the static mass (E0) and the electric charge of (e) of the charged particle vary depending on the type thereof.

The abovementioned series of equations for evaluating "Δt", which is the variable delay time 118, is referred to as definitional equations. When evaluating the variable delay time 118 in real time, the definitional equations are programmed in the variable delay time calculator 114 of a digital signal processor 8*d*.

Consequently, the variable delay time 118 is uniquely determined by the revolution frequency of a charged particle beam once the distance (L) from the bunch monitor 109 to the induction cell for acceleration 107 and the length ($C_0$) of the design orbit 102 for the charged particle beam to circulate in are determined. In addition, the revolution frequency of the charged particle beam is also uniquely determined by a magnetic excitation pattern.

Furthermore, once the type of charged particle and the settings of the synchrotron making use of induction cells are determined, the variable delay time 118 required at a certain point of acceleration is also uniquely determined. Accordingly, assuming that the bunch 103 accelerates in an ideal manner according to the magnetic excitation pattern, it is possible to previously calculate the variable delay time 118.

FIG. 18 is a graphical drawing of the correlation between an acceleration energy level and a variable delay time, wherein FIG. 18(A) shows the correlation between the energy level of a proton beam and the time at which the variable delay time 118 is output. Note that the graph represents values obtained when the charged particle beam orbit control device 106 of the present invention was built in the 12 GeVPS of KEK and a proton beam was injected (119*c*) into the experimental synchrotron 101 making use of induction cells.

The axis of abscissa "MeV" represents the energy level of a proton beam in units of megaelectronvolts. 1 MeV corresponds to $1.602\times10^{-13}$ joule.

The axis of ordinate "Δt(μs)" represents, in units of microseconds, a delay (variable delay time 118) in the output timing of a gate signal pattern 113*a* for modulating the acceleration voltage 108*a* to be generated in the induction cell for acceleration 107, assuming that the time at which the bunch 103 has passed through the bunch monitor 109 is 0. The variable delay time 118 is calculated by the digital signal processor 112, as described above, in response to the passage signal 109*a* from the bunch monitor 109.

The energy level of the proton beam is uniquely determined by the revolution velocity 103*c*. In addition, the revolution velocity 103*c* of the proton beam is synchronized with the magnetic excitation pattern of the synchrotron 101. Consequently, it is possible to calculate the variable delay time 118 in advance from the revolution velocity 103*c* or the magnetic excitation pattern, rather than calculating it in real time.

The graph shown in FIG. 18(A) represents the ideal variable delay time pattern 118*a* and the required variable delay time pattern 118*b* corresponding to the ideal variable delay time 118*a*.

The ideal variable delay time pattern 118*a* refers to the variable delay time 118 adapted to a change in the energy level and required in a period from the time when the bunch 103 passes through the bunch monitor 109 to the time when the digital signal processor 112 outputs the master gate signal 112*a*, assuming that the variable delay time 118 is adjusted for each revolution of the proton beam in order to apply the acceleration voltage 108*a* in synchronization with a change in the revolution velocity of the proton beam.

The required variable delay time pattern 118*b* refers to the variable delay time 118 adapted to a change in the energy level, whereby the acceleration voltage 108*a* can be applied to a charged particle beam, as with the ideal variable delay time pattern 118*a*. This is because the control accuracy of a pulse 115*a* appropriate for the variable delay time 118 of the variable delay time generator 115 is ±0.01 μs and because it is possible to carry out fully efficient acceleration without losing the charged particle even if the variable delay time 118 is not calculated and controlled for each revolution of the bunch 103, though it is ideally desirable to control the variable delay time 118 for each revolution of the charged particle beam.

Hence, the variable delay time 118 is controlled by a given unit of fixed time. This unit is referred to as a control time block 18*c*, which is 0.1 μs here.

From the graph shown in FIG. 18(A), it is understood that a proton beam at a low energy level immediately after the injection (119*c*) requires a variable delay time 118 with a length of approximately 1.0 μs in acceleration using the 12 GeVPS of KEK. In addition, the proton beam increases its energy level as the acceleration time elapses and the variable delay time 118 shortens accordingly. In particular, it is understood that the value of the variable delay time 118 is extremely close to 0 in a period from the point of approximately 4500 MeV to a point near the end of acceleration.

FIG. 18(B) shows a condition in which the time taken until the variable delay time 118 of the master gate signal 112*a* calculated and output by the digital signal processor 112 becomes shorter as the acceleration time elapses. The axis of abscissa "t(μs)" represents the variable delay time 118 in units of microseconds. Note that the axis of abscissa "t(μs)" corresponds to the axis of ordinate shown in FIG. 18(A).

For example, a proton beam that requires the variable delay time 118 to be 1 μs immediately after injection (119*c*) only requires the variable delay time 118 to be as short as 0.2 μs for a time duration near an energy level of 2000 MeV.

This means that by controlling the variable delay time 118 of the master gate signal 112*a* by the digital signal processor 112 according to the passage signal 109*a* available from the bunch monitor 109, it is possible to apply the acceleration voltage 108*a* in synchronization with the revolution frequency of the bunch 103, from a lower energy level immediately after injection (119*c*) to a high energy level in the last half period of acceleration.

Consequently, by using the charged particle beam orbit control device 106 of the present invention in the synchrotron 101 making use of induction cells, it is possible to accelerate an arbitrary charged particle to an arbitrary energy level also for the revolution frequency of the arbitrary charged particle by rewriting the equivalent acceleration voltage amplitude pattern 108*d* calculated from the magnetic excitation pattern of the variable delay time calculator 114 to a magnetic excitation pattern appropriate for the charged particle selected or to the required variable delay time pattern 118*b* appropriate for the ideal variable delay time pattern 118*a* calculated from the magnetic excitation pattern.

FIG. 19 is a graphical drawing of the correlation of a slow cycle with an ideal acceleration voltage amplitude and with an equivalent acceleration voltage amplitude. Note that FIG. 19 shows the magnetic excitation pattern 119 when a proton beam is accelerated using the 12 GeVPS of KEK.

The axis of abscissa "t" represents the operating time based on the time at which a charged particle beam is injected (119*c*) into the synchrotron 101 making use of induction cells. The first axis of ordinate B represents the magnetic flux density 103*a* of a bending electromagnet 104 composing the synchrotron 101 making use of induction cells. The second axis of ordinate "v" represents the acceleration voltage amplitude 108*i*.

Slow cycling refers to acceleration based on the slow-cycling magnetic excitation pattern 119 of the synchrotron 101 wherein one period, which is a time from when a charged particle is injected (119*c*) from a preinjector, accelerated and extracted to when the next injection (119*c*) is ready, is in the order of several seconds.

This magnetic excitation pattern 119 gradually increases the magnetic flux density 103*a* immediately after the charged particle beam is injected (119*c*), up to the maximum magnetic flux density at a point in time of emission. In particular, the magnetic flux density 103*a* increases exponentially since the injection (119*c*) of the charged particle beam. The magnetic excitation pattern 119 in this time duration is referred to as the nonlinear excitation region 119*a*. Thereafter, the magnetic flux density 103*a* increases linearly until the end of acceleration. The magnetic excitation pattern 119 in this time duration is referred to as the linear excitation region 119*b*.

Consequently, in order to accelerate the charged particle beam using the synchrotron 101 making use of induction cells, the acceleration voltage 108*a* needs to be generated in synchronization with this magnetic excitation pattern 119. An ideal acceleration voltage ($V_{acc}$) synchronized with the magnetic excitation pattern 119 of the synchrotron 101 at that time has the correlation relationship represented by Equation (12) shown below.

$$V_{acc} \propto dB/dt \qquad \text{Equation (12)}$$

This means that the acceleration voltage amplitude 108*i* required at a given operating point in time is proportional to the rate of temporal change in the magnetic excitation pattern 119 at that time.

Accordingly, a required induction voltage value changes in linear proportion to a temporal change in the acceleration time since the magnetic flux density 103*a* increases in a quadric manner in the nonlinear excitation region 119*a*.

On the other hand, the ideal acceleration voltage 108*k* in the linear excitation region 119*b* is constant, irrespective of a change in the acceleration time. Hence, the content of Non-patent Document 2 mentioned earlier is the demonstration that a proton can be accelerated by applying the constant acceleration voltage 108*a* at regular time intervals in this linear excitation region 119*b*. Furthermore, since it is not possible to continue applying the acceleration voltage 108*a* as described above, the reset voltage 108*b* must be applied the next time after the acceleration voltage 108*a* is applied.

Consequently, in order to synchronize this acceleration voltage 108*a* with the magnetic excitation pattern 119 of the nonlinear excitation region 119*a*, it is necessary to increase the acceleration voltage amplitude 108*j* along with temporal change.

However, since the induction cell for acceleration 107 itself does not have any induced voltage modulation mechanisms, the acceleration voltage amplitude 108*i* is only available as a constant voltage. It is conceivable though that the acceleration voltage amplitude 108*i* is varied by controlling the charging voltage of a bank capacitor 124 generated by the induction cell for acceleration 107. It is in reality not possible, however, to use the method of modulating the charging voltage of the bank capacitor 124 for the purpose of promptly modulated the acceleration voltage amplitude 108*i*, since the bank capacitor 124 is normally loaded for the purpose of suppressing fluctuations in the charging voltage due to output fluctuations.

Figure 20:
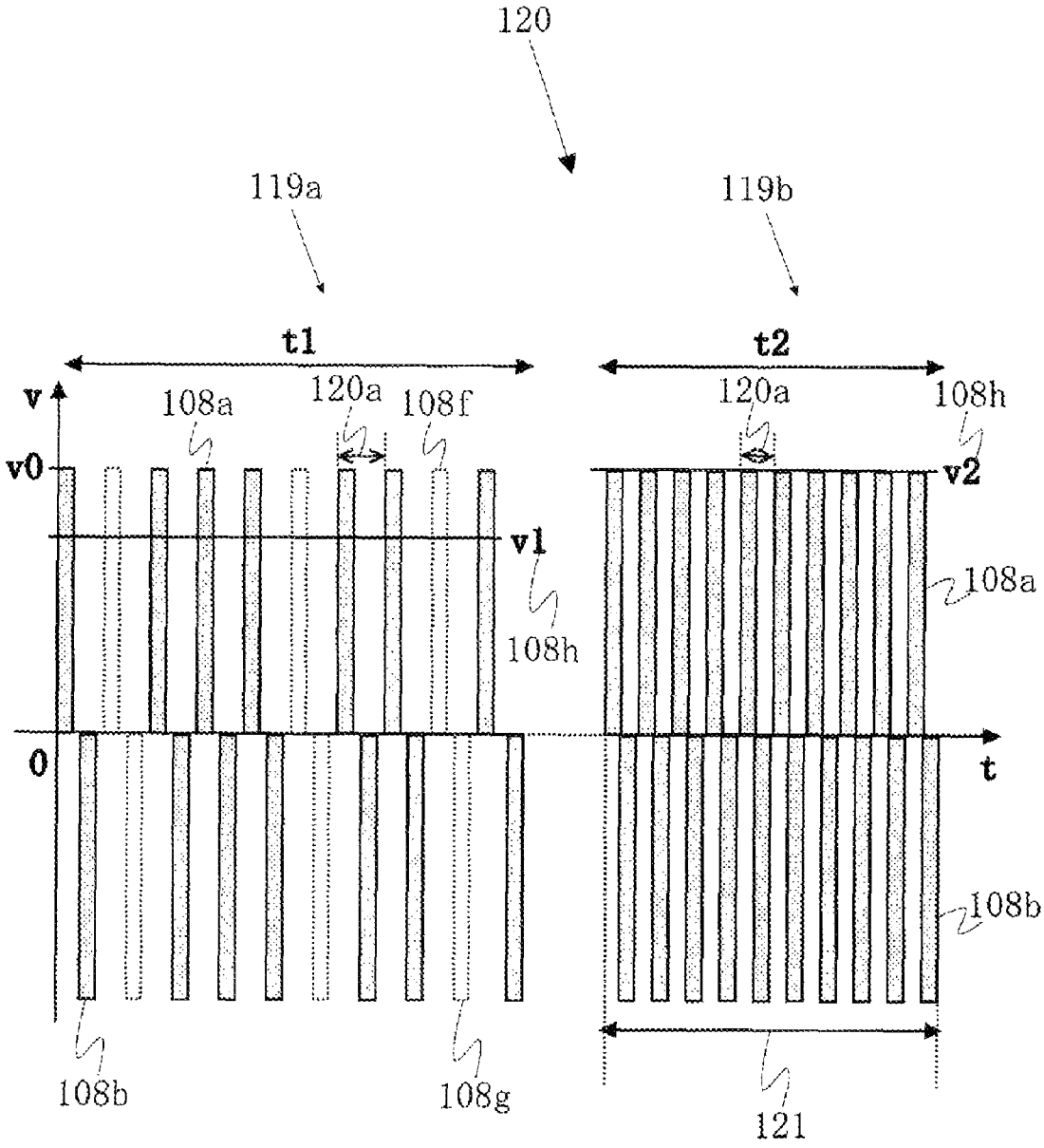
FIG. 20 is a graphical drawing of a method of controlling an acceleration voltage by means of pulse density modulation.
Figure 2:
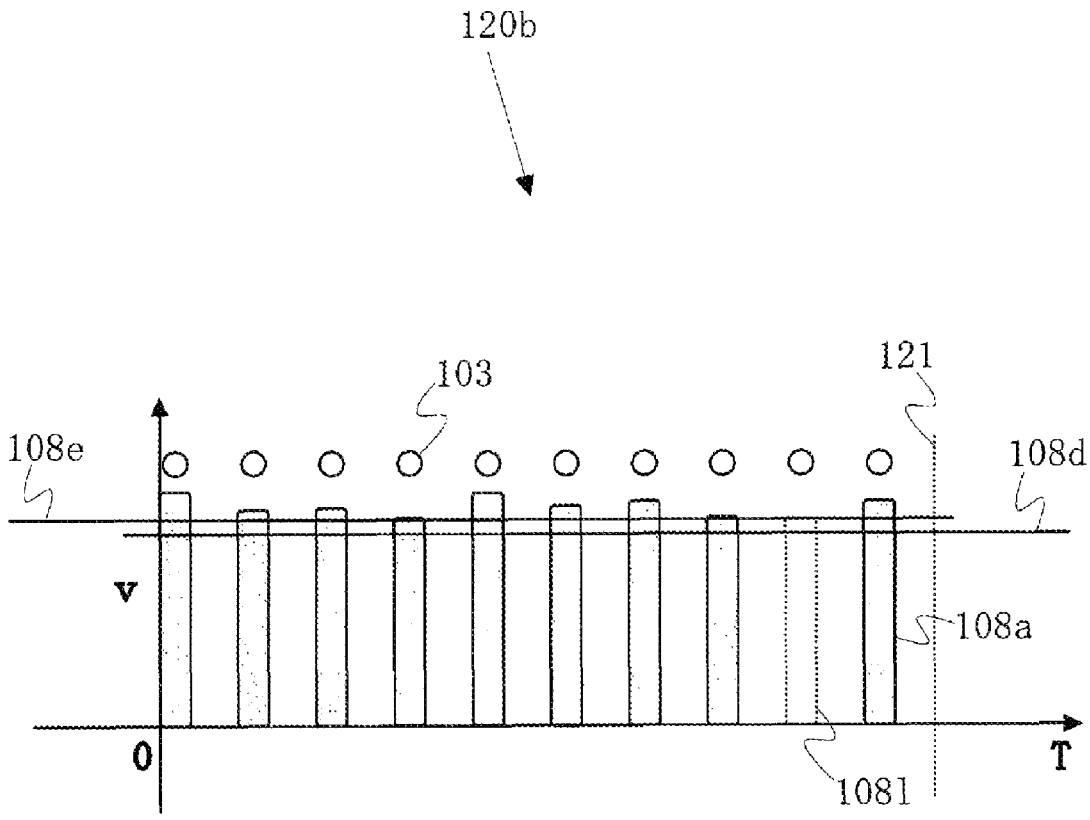
Figure 2:
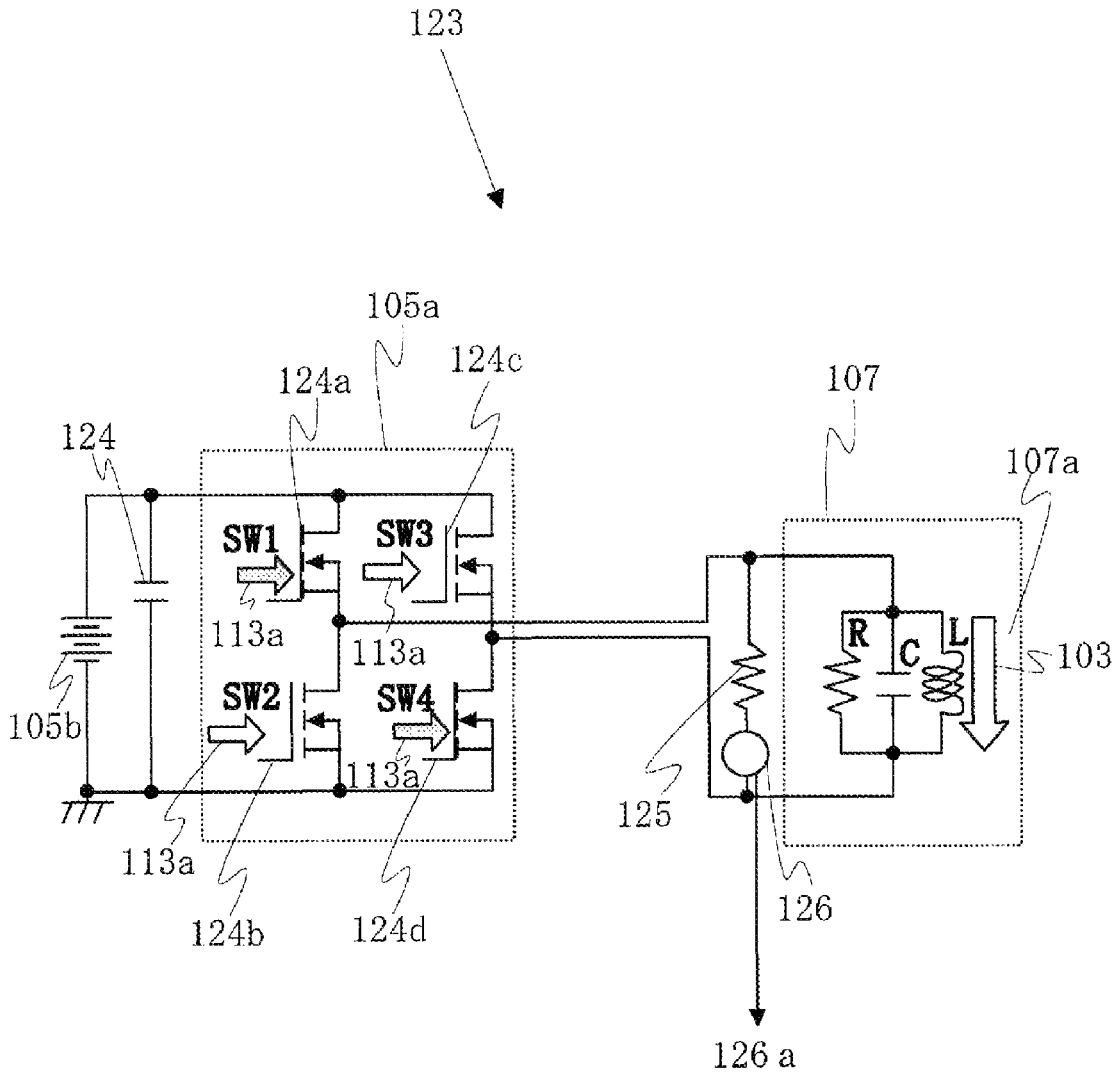
Figure 2:
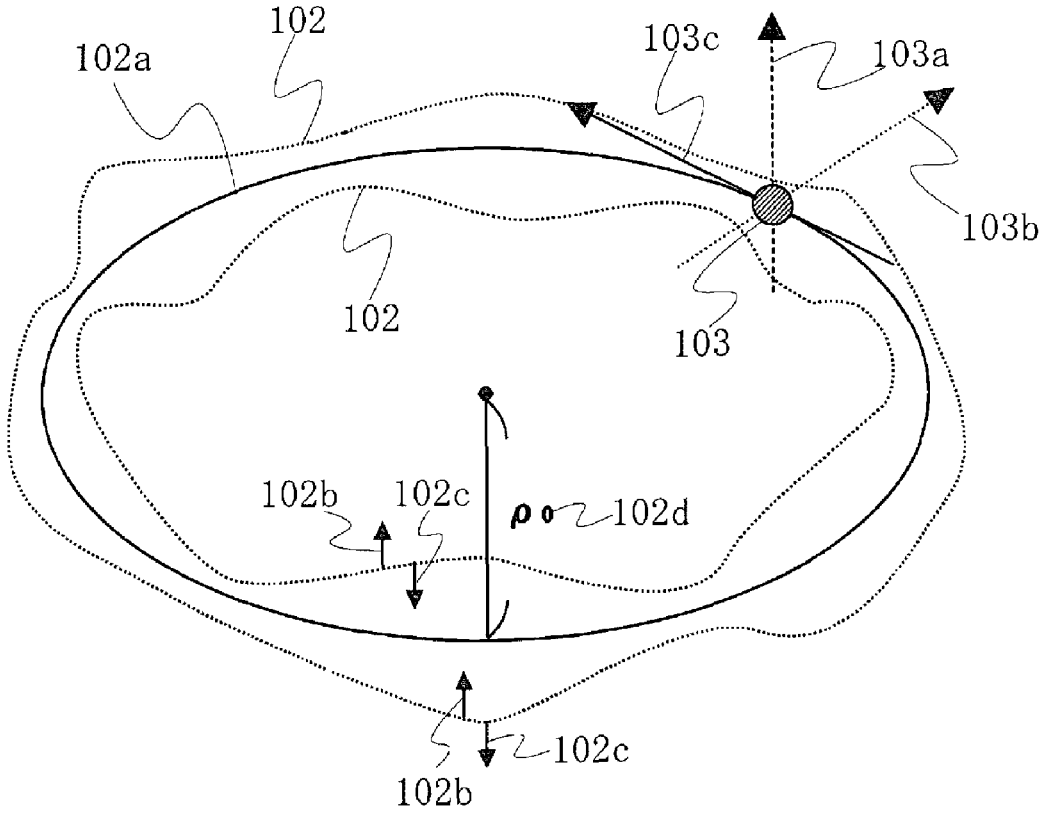

Hence, it was decided to synchronize the generation timing of the acceleration voltage 108*a* with the magnetic excitation pattern 119 of the nonlinear excitation region 119*a* using the pulse density shown in FIG. 20 and the charged particle beam orbit control device 106.

That is, it is possible to provide the acceleration voltage amplitude 108*i*, which is equivalent to the ideal acceleration voltage amplitude pattern 108*c* in the control time block, by increasing the frequency of applying the acceleration voltage 108*a* in the control time block in incremental steps from 0 so that the acceleration voltage 108*a* is applied for each revolution of the bunch 103. A group of such equivalent acceleration voltage amplitudes 108*i* is referred to as an equivalent acceleration voltage amplitude pattern 108*d*.

For example, if the control time block of the 4.7 kV acceleration voltage 108*a* is 10 revolutions, then it is possible to modulate the acceleration voltage amplitude 108*i* in increments of 0.47 kV from 0 kV to 4.7 kV. As a result, it is possible to divide the equivalent acceleration voltage amplitude pattern 108*d* in the nonlinear excitation region 119*a* into 10 steps of the acceleration voltage amplitude 108*i*.

If the acceleration voltage amplitude 108*i* having a smaller value required, it is only necessary to modulate the ratio of the application frequency of the acceleration voltage 108*a* to the revolution frequency of the bunch 103. For example, if 0.093 kV is required as the acceleration voltage amplitude 108*i*, it is only necessary to apply the acceleration voltage 108*a* twice for every 100 revolutions of the bunch 103.

Assuming here that the nonlinear excitation region 119*a* is defined as 0.1 seconds, then the time length of each step when the control time block is specified as 10 is 0.01 seconds.

This means that even in a case where the constant acceleration voltage 108*a* is applied, the ideal acceleration voltage amplitude pattern 108*c* has been provided for a fixed time period 119*d* using the equivalent acceleration voltage amplitude pattern 108*d* corresponding to the ideal acceleration voltage amplitude pattern 108*c* by controlling the generation timing of the acceleration voltage 108*a* by means of pulse density modulation.

Note that in order to accelerate a charged particle beam in synchronization with the largely-varying magnetic excitation pattern 119 of the synchrotron 101, it must first be premised that the constant acceleration voltage 108*a* can be applied for each revolution of the bunch 103 of a proton beam using the induction cell for acceleration 107 capable of applying the required acceleration voltage amplitude 9*k* in the linear excitation region 119*b*.

FIG. 20 is a graphical drawing of a method of controlling an acceleration voltage by means of pulse density modulation. The meanings of the symbols "t" and "v" are the same as those of FIG. 19.

A group of the generation timings of the induced voltage for acceleration 108 shown in FIG. 20 is referred to as a pulse density 120. The number of the bunch 103's revolutions for which the pulse density 120 is controlled by grouping a given number of revolutions as described above is referred here to as a control time block 121.

Symbol "$t_1$" denotes the time required for the control time block 121 in a case where the control time block 121 in the nonlinear excitation region 119*a* is ten-odd revolutions. Symbol "$t_2$" denotes the time required for the control time block 121 in a case where the control time block 121 in the linear excitation region 119*b* is ten-odd revolutions.

The pulse density 120 can be provided in advance to the acceleration voltage calculator 116 as the equivalent acceleration voltage amplitude pattern 108*d* or can be calculated in real time using the acceleration voltage calculator 116, as described above.

Symbol "$v_1$" denotes an average acceleration voltage 108*h* applied to the bunch 103 during "$t_1$". The value of "$v_1$" can be calculated as $v_1=7/10\cdot v_0=0.7v_0$ when the acceleration voltage 108*a* having a fixed value of "$v_0$" is applied for seven passages during "$t_1$", i.e., the time period during which the bunch 103 passes through the induction cell for acceleration 107 ten times.

An acceleration voltage 108*f* shown by a dotted line means that the acceleration voltage 108*a* is not applied even if the bunch 103 reaches the induction cell for acceleration 107. Likewise, a reset voltage 108*g* shown by a dotted line means that the reset voltage 108*b* is not applied.

By controlling the pulse density 120 by the charged particle beam orbit control device 106 as described above, it is possible to achieve synchronization with the magnetic excitation pattern 119 in the largely-varying nonlinear excitation region 119*a* by providing the induction cell for acceleration 107 with the equivalent acceleration voltage amplitude pattern 108*d* corresponding to the ideal acceleration voltage amplitude pattern 108*c*, even if using the induction cell for acceleration 107 capable of applying only the constant acceleration voltage 108*a*.

As a matter of course, it is also possible to achieve synchronization with the ideal constant acceleration voltage amplitude 108*k* which is required for the linear excitation region 119*b*. As v2, which is the average acceleration voltage amplitude 108*h* at that time, the acceleration voltage 108*a* having a fixed value of $v_0$ is applied to the bunch 103 passing through the induction cell for acceleration 107 for each revolution of the bunch 103. This means that $v2=10/10\cdot v_0=v_0$.

Consequently, the acceleration voltage amplitude ($V_{ave}$) applied to the charged particle beam during the control time block 121 is determined by Equation (13) shown below from the constant acceleration voltage amplitude ($V_0$) applied by the induction cell for acceleration 107 and from the number of times the acceleration voltage 108*a* of the control time block 121 has been applied ($N_{on}$) and the number of times the application of the acceleration voltage 108*a* has been stopped by the acceleration voltage 108*f* ($N_{off}$).

$$V_{ave}=V_0\cdot N_{on}/(N_{on}+N_{off}) \qquad \text{Equation (13)}$$

Note that by gradually shortening the time interval between the continuously applied acceleration voltages 108*a* (hereinafter referred to as the pulse interval 120*a*), it is possible to cope with the shortening of the revolution time period of the bunch 103.

FIG. 21 is a graphical drawing of a method of controlling the orbit of a charged particle beam by interrupting the generation of an acceleration voltage. FIG. 21 shows the pulse density 120*b* of the acceleration voltage 108*a* actually applied during the control time block 121 (10 revolutions) of the nonlinear excitation region 119*b* in FIG. 19. The axis of abscissa "T" represents the number of revolutions of a charged particle beam and the axis of ordinate "v" represents the acceleration voltage amplitude 108*i*.

The ideal acceleration voltage amplitude 108*k* in the linear excitation region 119*b* is constant, irrespective of temporal change. Consequently, it is only necessary to apply the constant acceleration voltage 108*a* for each revolution of the bunch 103 using the induction cell for acceleration 107 capable of applying the ideal acceleration voltage amplitude 108*k*.

However, even if the ideal acceleration voltage amplitude 108*k* in the linear excitation region 119*b* calculated, for example, by Equation (12) is constant irrespective of temporal change, it is not possible to apply the constant acceleration voltage amplitude 108*i*.

The actual acceleration voltage amplitude 108*i* applied increases or decreases within a certain range and deviates from a acceleration voltage setpoint 108*e*. This is due to the charging voltage of a bank capacitor 124 deviating from an ideal value.

Accordingly, even if the previously calculated acceleration voltage amplitude pattern 108*d* is stored in the acceleration voltage calculator 116 and the acceleration voltage 108*a* is applied using the pulse density 120*b* based on the equivalent acceleration voltage amplitude pattern 108*d*, the charged particle beam will deviates from the design orbit 102 sooner or later.

For example, if the actually applied acceleration voltage amplitude 108*i* is smaller than the ideal acceleration voltage amplitude 108*k* (equivalent acceleration voltage amplitude in the fixed time period 119*d*), then the charged particle beam circulates in an orbit on the inside 102*b* of the design orbit 102 and will fail to synchronize with the magnetic excitation pattern 119 of the bending electromagnet 104 sooner or later, thus colliding with the walls of a vacuum chamber and disappearing.

On the other hand, if the actually applied acceleration voltage amplitude 108*i* is larger than the ideal acceleration voltage amplitude 108*k* (equivalent acceleration voltage amplitude in the fixed time period 119*d*), then the charged particle beam circulates in an orbit on the outside 102*c* of the design orbit 102 and will fail to synchronize with the magnetic excitation pattern 119 of the bending electromagnet 104 sooner or later, thus also colliding with the walls of a vacuum chamber and disappearing.

Hence, the synchrotron 101 making use of induction cells has made it possible to maintain the charged particle beam on the design orbit by modulating the pulse density 120 based on the previously calculated equivalent acceleration voltage amplitude pattern 108*d* in order to reduce the loss of the charged particle beam and repeat efficient acceleration.

The pulse density 120 can be corrected by interrupting the generation of an acceleration voltage 108*l*, which corresponds to an extra amount and is shown by a dotted line, against the calculated equivalent acceleration voltage amplitude pattern 108*d* in advance for each control time block 121.

Specifically, this is a method wherein the acceleration voltage calculator 116 receives from the beam position monitor 111 the beam position signal 111*a*, which is information as to what extent the orbit of the charged particle beam deviates from the design orbit 102 toward the outside 102*c* thereof, thereby stopping the generation of the pulse 116*a* corresponding to the extra acceleration voltage amplitude of the pulse density 120 based on the equivalent acceleration voltage amplitude pattern 108*d* previously stored in the acceleration voltage calculator 116.

Alternatively, it is also possible to maintain the orbit of the charged particle beam on the design orbit 102 by substituting another pulse density 120 stored in the acceleration voltage calculator 116 for the pulse density 120 of the control time block 121 for a given time of the equivalent acceleration voltage amplitude pattern 108*d* described above.

In addition, in a case where the variable delay time 118 and the on/off states of the acceleration voltage 108*a* are controlled in real time, it is possible to consequently position the orbit of the charged particle beam on the design orbit 102 by controlling the acceleration voltage 108*a* for each revolution of the bunch 103.

Note that the orbit of the charged particle beam needs to be controlled also in the nonlinear excitation region 119*a* as in the linear excitation region 119*b* and, hence, the value of the induced voltage for acceleration 108 is automatically calculated by Equation (1) from the value of the beam-bending magnetic flux density signal 104*b*.

Accordingly, it is desirable to set the acceleration voltage setpoint 108*e* so that there can be obtained the acceleration voltage amplitude 108*i* higher than the equivalent acceleration voltage amplitude pattern 108*d* corresponding to the ideal acceleration voltage amplitude pattern 108*c*, since it is possible to maintain the charged particle beam deviated toward the outside 102*c* on the design orbit 102 by interrupting the generation of the acceleration voltage 108*l* corresponding to an extra amount.

As a result, the actual acceleration voltage amplitude 108*i* becomes larger than the ideal acceleration voltage amplitude pattern 108*c*. Hence, in order to realize synchronization with the magnetic excitation pattern 119, it is only necessary to stop the generation of the acceleration voltage 108*a* using the method described above and correct the pulse density 120 in a given control time block 121.

By modulating the pulse density 120 of the control time block 121 as described above using the charged particle beam orbit control device 106 of the present invention, it is possible for even the induction cell for acceleration 107 capable of applying only the acceleration voltage 108*a* having an almost fixed value ($V_0$) to apply the acceleration voltage 108*a* to a proton beam in synchronization with the slow-cycling magnetic excitation pattern 119 of the synchrotron 101.

In addition, it is now possible to position the charged particle beam, which has received an excessive acceleration voltage and deviated from the design orbit 102 toward the outside 102*c* thereof, back on the original design orbit 102 by modulating the pulse density in real time using the charged particle beam orbit control device 106 of the present invention.

Furthermore, according to the charged particle beam orbit control device 106 and its control method, it is possible to apply the acceleration voltage 108*a* to the charged particle beam in synchronization with even the fast-cycling magnetic excitation pattern of the synchrotron 101 by modulating the pulse density 120 per control time block 121 and applying the constant acceleration voltage 108*a*.

Still furthermore, it is also possible to position the orbit of the charged particle beam which has deviated toward the outside 102*c* back on the design orbit 102.

Fast cycling refers to acceleration based on the fast-cycling magnetic excitation pattern of the synchrotron 101 wherein one period, which is a time from when a proton beam is injected from a preinjector, accelerated and extracted to when the next injection is ready, is in the order of several tens of milliseconds.

In order to synchronize with the fast-cycling magnetic excitation pattern, it should be noted that the required ideal acceleration voltage amplitude pattern increases or decreases drastically with time, compared with the slow-cycling magnetic excitation pattern 119 of the synchrotron 101.

However, by using the charged particle beam orbit control device 106 of the present invention and its control method, it is possible to position the orbit of the charged particle beam back on the design orbit 102.

Accordingly, it is now possible to maintain a charged particle beam on the design orbit 102 for every magnetic excitation pattern without allowing the beam to deviate therefrom, by controlling the variable delay time 118 and the pulse density 120 of an induced voltage using the charged particle beam orbit control device 106 of the present invention and its control method.

Since the above-described advantages are available from the induced voltage control device 8 of the present invention, it is possible to modify a existing rf synchrotron 21 making use of the rf cavity 4 into a synchrotron making use of induction cells at low costs.

In addition, since the above-described advantages are available from the charged particle beam orbit control device 106 and its control method of the present invention, it is possible to reliably accelerate arbitrary charged particles including heavy charged particles to an arbitrary energy level which has been impossible with an existing cyclotron or rf synchrotron. In particular, the charged particle beam orbit control device of the present invention can be expected to provide a wide range of applications in the medical and physics fields as an easy-to-operate circular accelerator capable of automatically maintaining the orbit of a charged particle beam.

INDUSTRIAL APPLICABILITY

Since the charged particle beam orbit control device 106 and its control method of the present invention are constituted as described above, there are available the advantages described hereunder. It is possible to apply the acceleration voltage 9 to a charged particle beam in synchronization with every type of magnetic excitation pattern of a synchrotron making use of induction cells.

Furthermore, although there have been restrictions on the type of charged particles to be accelerated in the existing rf synchrotron, it is now possible to reliably and easily raise the energy of an arbitrary charged particle to an arbitrary energy level even with the almost constant acceleration voltage 9*a* applied by the induction cell for acceleration 6, without being subjected to such restrictions, by controlling the pulse density 17 in the control time block 15*c* which is a fixed number of the bunch 3's revolutions using the induced voltage control device 8 and its control method of the present invention.

Since the charged particle beam orbit control device and its control method of the present invention are constituted as described above, there are available the advantages described hereunder. In a synchrotron making use of induction cells, it is possible to stably and reliably accelerate an arbitrary charged particle to an arbitrary energy level by modulating the orbital deviations of a charged particle beam.

Furthermore, since the orbital deviations of the charged particle beam can be corrected using induction cells, it is possible to make an induction cell for confinement undertake a longitudinal confinement function without the need for any rf cavities. As a result, it is now possible to construct a synchrotron making use of induction cells adapted to arbitrary charged particles at low costs by utilizing an existing rf synchrotron.

Still furthermore, it is possible to correct the orbital deviations of the charged particle beam in every mode of synchrotron operation, i.e., in synchronization with every magnetic excitation pattern of a bending electromagnet.

In addition, it is also possible to make the charged particle beam circulate in an arbitrary orbit, either the inside 102*b* or the outside 102*c* of the design orbit 102.

The invention claimed is:

1. An induced voltage control device for controlling the generation timing of an induced voltage for acceleration in a synchrotron making use of induction cells, characterized by comprising:

a variable delay time pattern calculator for storing a required variable delay time pattern corresponding to an ideal variable delay time pattern calculated according to a magnetic excitation pattern and generating a variable delay time signal according to said required variable delay time pattern;

a variable delay time generator for generating a pulse corresponding to said variable delay time in response to the passage signal of a bunch from a bunch monitor placed on a design orbit for a charged particle beam to circulate in and to said variable delay time signal from said variable delay time calculator;

an trigger on/off selector for storing an equivalent acceleration voltage amplitude pattern corresponding to an ideal acceleration voltage amplitude pattern calculated according to said magnetic excitation pattern and generating a trigger pulse for on/off-selecting an induced voltage for acceleration in response to a pulse corresponding to said variable delay time from said variable delay time generator;

a digital signal processor including a master gate signal output module for generating a master gate signal which is a pulse suited for a pattern generator and outputting said master gate signal after the elapse of said variable delay time in response to said pulse from said on/off selector; and said pattern generator for converting said master gate signal to the gate signal pattern of a switching electric power supply, which drives an induction cell for acceleration.

2. A method of induced voltage control in a synchrotron making use of induction cells, characterized by comprising:

using a variable delay time pattern calculator for storing a required variable delay time pattern corresponding to an ideal variable delay time pattern calculated according to a magnetic excitation pattern and generating a variable delay time signal according to said required variable delay time pattern, a variable delay time generator for generating a pulse corresponding to said variable delay time in response to the passage signal of a bunch from a bunch monitor placed on a design orbit for a charged particle beam to circulate in and to said variable delay time signal from said variable delay time calculator, an on/off selector for storing an equivalent acceleration voltage amplitude pattern corresponding to an ideal acceleration voltage amplitude pattern calculated according to said magnetic excitation pattern and generating a pulse for on/off-selecting an induced voltage for acceleration in response to a pulse corresponding to said variable delay time from said variable delay time generator, a digital signal processor including a master gate signal output module for generating a master gate signal which is a pulse suited for a pattern generator and outputting said master gate signal after the elapse of said variable delay time in response to said pulse from said on/off selector, and said pattern generator for converting said master gate signal to the gate signal pattern of a switching electric power supply, which drives an induction cell for acceleration; and thereby regulating the pulse density of the induced voltage of a control unit in order to accelerate an arbitrary charged particle to an arbitrary energy level.

3. A method of induced voltage control in a synchrotron making use of induction cells, characterized by comprising:

using a variable delay time pattern calculator for numerically processing a variable delay time in real time according to a beam-bending magnetic flux density signal which is a magnetic flux density from a bending electromagnet composing said synchrotron and the revolution frequency of a charged particle beam on a design orbit and generating a variable delay time signal according to said variable delay time, a variable delay time generator for generating a pulse corresponding to said variable delay time in response to the passage signal of a bunch from a bunch monitor placed on a design orbit for a charged particle beam to circulate in and to said variable delay time signal from said variable delay time calculator, an on/off selector for calculating an acceleration voltage amplitude in real time according to said beam-bending magnetic flux density signal which is said magnetic flux density from said bending electromagnet composing said synchrotron and on/off-selecting an induced voltage for acceleration in response to a pulse corresponding to said variable delay time from said variable delay time generator, a digital signal processor including a master gate signal output module for generating a master gate signal which is a pulse suited for a pattern generator and outputting said master gate signal after the elapse of said variable delay time in response to said pulse from said on/off selector, and said pattern generator for converting said master gate signal to the gate signal pattern of a switching electric power supply, which drives an induction cell for acceleration; and thereby real-time controlling the pulse density of said induced voltage for acceleration of a control time block in order to accelerate an arbitrary charged particle to an arbitrary energy level.

4. A charged particle beam orbit control device in a synchrotron making use of induction cells, characterized by comprising:

a digital signal processor for controlling the generation timing of an induced voltage in response to a beam position signal from a beam position monitor for sensing the deviation of a charged particle beam on the design orbit of said synchrotron from said design orbit and a passage signal from a bunch monitor for sensing the passage of a bunch; and a pattern generator for generating a gate signal pattern for on/off-selecting a switching electric power supply, which drives an induction cell for acceleration, according to a master gate signal generated by said digital signal processor.

5. The charged particle beam orbit control device according to claim 4, characterized by further including:

a variable delay time calculator wherein said digital signal processor stores a required variable delay time pattern corresponding to an ideal variable delay time pattern calculated according to a magnetic excitation pattern and generating a variable delay time signal according to said required variable delay time pattern;

a variable delay time generator for generating a pulse corresponding to said variable delay time in response to the passage signal of said bunch from said bunch monitor placed on said design orbit for a charged particle beam to circulate in and to said variable delay time signal from said variable delay time calculator;

an acceleration voltage calculator for storing an equivalent acceleration voltage amplitude pattern corresponding to an ideal acceleration voltage amplitude pattern calculated according to said magnetic excitation pattern and generating a pulse for on/off-selecting an induced voltage for acceleration in response to a pulse corresponding to said variable delay time from said variable delay time generator and said beam position signal from said beam position monitor for sensing the deviation of said charged particle beam on said design orbit from said design orbit; and a master gate signal output module for generating a gate master signal which is a pulse suited for said pattern generator, in response to said output pulse from said acceleration voltage calculator.

6. A method of charged particle beam orbit control in a synchrotron making use of induction cells, characterized by comprising:

using a variable delay time calculator for generating a variable delay time signal, a variable delay time generator for generating a pulse corresponding to said variable delay time in response to the passage signal of a bunch from a bunch monitor placed on a design orbit for a charged particle beam to circulate in and to said variable delay time signal from said variable delay time calculator, an acceleration voltage calculator for on/off-selecting an induced voltage for acceleration in response to a pulse corresponding to said variable delay time from said variable delay time generator and a beam position signal from a beam position monitor for sensing the deviation of a charged particle beam on a design orbit from said design orbit, a digital signal processor including a master gate signal output module for generating a master gate signal which is a pulse suited for a pattern generator in response to said pulse from said acceleration voltage calculator, and said pattern generator for converting said master gate signal to the gate signal pattern of a switching electric power supply, which drives an induction cell for acceleration; and thereby controlling the pulse density of a control time block.

* * * * *